US007603726B2

(12) United States Patent
Sawalski et al.

(10) Patent No.: US 7,603,726 B2
(45) Date of Patent: Oct. 20, 2009

(54) TOILET BOWL CLEANING AND/OR DEODORIZING DEVICE

(75) Inventors: Michael M. Sawalski, Racine, WI (US); Scott M. Kouri, Long Grove, IL (US); Stephen J. Gaynes, McHenry, IL (US)

(73) Assignee: S.C. Johnson & Son, Inc., Racine, WI (US)

( * ) Notice: Subject to any disclaimer, the term of this patent is extended or adjusted under 35 U.S.C. 154(b) by 505 days.

(21) Appl. No.: 11/312,281

(22) Filed: Dec. 20, 2005

(65) Prior Publication Data

US 2007/0136937 A1 Jun. 21, 2007

(51) Int. Cl.
*E03D 9/02* (2006.01)

(52) U.S. Cl. ..... 4/223

(58) Field of Classification Search ..... 4/223
See application file for complete search history.

(56) References Cited

U.S. PATENT DOCUMENTS 1,366,426 A 1/1921 Silvers
2,075,266 A 3/1937 Bowman
2,397,677 A 4/1946 MacGlashan
2,614,265 A 10/1952 Vierra
2,760,209 A 8/1956 Ewing et al.
2,796,293 A * 6/1957 Becker ..... 239/204
3,088,125 A 5/1963 Southwood
3,178,070 A 4/1965 Leland
3,946,448 A 3/1976 Sioufy
3,953,902 A 5/1976 Taylor
4,183,105 A 1/1980 Womack
4,560,108 A 12/1985 Rubinstein
4,562,867 A 1/1986 Stouffer
4,618,077 A 10/1986 Corsette
4,660,765 A 4/1987 Rosenberg
4,670,916 A 6/1987 Bloom
4,763,839 A 8/1988 Greenberg
4,777,670 A 10/1988 Klinkhammer et al.
4,817,869 A 4/1989 Rubinstein
4,873,729 A 10/1989 Micallef (Continued)

FOREIGN PATENT DOCUMENTS

DE 2721433 A1 11/1978

(Continued)

OTHER PUBLICATIONS

English Language Machine Translation of JP 2000-166818.

(Continued)

*Primary Examiner*—Tuan N Nguyen

(57) ABSTRACT

A device for spraying an inner surface of a toilet bowl with a cleaning and/or deodorizing chemical is disclosed. The device includes a container for the chemical, a spray nozzle through which the chemical can be sprayed laterally around a perimeter of the nozzle, a conduit in fluid communication with the container and the spray nozzle, fluid delivery means for delivering chemical from the container through the conduit and to the spray nozzle, and means for attaching the spray nozzle near a rim of the toilet bowl. The spray nozzle of the automatic or manual toilet bowl cleaning device can operate such that the chemical is applied to the entire circumference of the inner surface of the toilet bowl whereby the entire toilet bowl is cleaned around the inner circumference of the toilet bowl.

28 Claims, 37 Drawing Sheets

U.S. PATENT DOCUMENTS

| | | | | |
|---|---|---|---|---|
| 5,123,124 | A | 6/1992 | Brower | |
| 5,143,293 | A * | 9/1992 | Pairis | 239/222.17 |
| 5,347,661 | A | 9/1994 | Fly et al. | |
| 5,457,822 | A | 10/1995 | Klammsteiner | |
| 5,862,532 | A | 1/1999 | Cain | |
| 5,906,298 | A | 5/1999 | Ward | |
| 6,000,067 | A | 12/1999 | Cascia | |
| 6,029,286 | A | 2/2000 | Funk | |
| 6,162,371 | A | 12/2000 | Rees et al. | |
| 6,178,563 | B1 | 1/2001 | Helfet | |
| 6,178,564 | B1 | 1/2001 | Leonard et al. | |
| 6,230,334 | B1 | 5/2001 | Camp et al. | |
| 6,279,174 | B1 | 8/2001 | Candusso | |
| 6,347,414 | B2 | 2/2002 | Contadini et al. | |
| 6,394,310 | B1 | 5/2002 | Muderlak et al. | |
| 6,425,406 | B1 | 7/2002 | Klinkhammer et al. | |
| 6,471,974 | B1 | 10/2002 | Rees et al. | |
| 6,494,384 | B1 | 12/2002 | Meyer | |
| 6,588,026 | B2 | 7/2003 | Meier et al. | |
| 6,694,536 | B1 | 2/2004 | Haygreen | |
| 6,739,479 | B2 | 5/2004 | Contadini et al. | |
| 6,769,580 | B2 | 8/2004 | Muderlak et al. | |
| 6,772,450 | B1 | 8/2004 | Savlor et al. | |
| 6,812,196 | B2 | 11/2004 | Rees et al. | |
| 6,820,821 | B2 | 11/2004 | Linstedt et al. | |
| 6,932,279 | B2 | 8/2005 | Burcham | |
| 6,944,890 | B1 | 9/2005 | Sim | |
| 7,007,312 | B1 | 3/2006 | Sim | |
| 2002/0130146 | A1 | 9/2002 | Borut et al. | |
| 2002/0148908 | A1 | 10/2002 | Linstedt et al. | |
| 2003/0056587 | A1 | 3/2003 | Carpenter et al. | |
| 2003/0188377 | A1 | 10/2003 | Contadini et al. | |
| 2004/0050959 | A1 | 3/2004 | Mazooji et al. | |
| 2005/0005378 | A1 | 1/2005 | Soller et al. | |
| 2005/0133540 | A1 | 6/2005 | Hornsby et al. | |
| 2006/0006253 | A1 | 1/2006 | Nelson | |
| 2007/0000941 | A1 | 1/2007 | Hadden et al. | |
| 2007/0040045 | A1 | 2/2007 | Cohen | |
| 2007/0045337 | A1 | 3/2007 | Hornsby et al. | |
| 2007/0158359 | A1 | 7/2007 | Rodrian | |
| 2007/0187427 | A1 | 8/2007 | Shaw et al. | |
| 2007/0204387 | A1 | 9/2007 | Cornelius et al. | |
| 2007/0204388 | A1 | 9/2007 | Zyskowski et al. | |
| 2007/0204389 | A1 | 9/2007 | Graefe et al. | |
| 2007/0240251 | A1 | 10/2007 | Pagani | |
| 2007/0245470 | A1 | 10/2007 | Nguyen et al. | |
| 2007/0289054 | A1 | 12/2007 | Han et al. | |
| 2008/0078780 | A1 | 4/2008 | Sanger et al. | |

FOREIGN PATENT DOCUMENTS

| | | | |
|---|---|---|---|
| EP | 0 274 785 | A1 | 7/1988 |
| FR | 2588742 | A | 4/1987 |
| FR | 2874038 | | 2/2006 |
| GB | 1140900 | A | 2/1969 |
| JP | 1-97423 | | 4/1989 |
| JP | 3-9714 | | 1/1991 |
| JP | 3-228718 | | 1/1991 |
| JP | 5-222757 | | 8/1993 |
| JP | 6-170286 | | 6/1994 |
| JP | 2000-70797 | A | 3/2000 |
| JP | 2000-166818 | A | 6/2000 |
| JP | 2002-04884 | | 2/2002 |
| JP | 2002-108518 | | 6/2002 |
| JP | 2002-286833 | | 10/2002 |
| JP | 2004-100212 | | 4/2004 |
| JP | 2004-283811 | | 10/2004 |
| JP | 2005-36511 | | 2/2005 |
| JP | 2005-46769 | | 2/2005 |
| JP | 2005-52754 | | 3/2005 |
| JP | 2005-103367 | | 4/2005 |
| JP | 2005-211164 | | 8/2005 |
| JP | 2005-344300 | | 12/2005 |
| WO | WO93/03232 | A | 2/1993 |
| WO | WO 99/66139 | A1 | 12/1999 |
| WO | WO 99/66140 | A1 | 12/1999 |
| WO | WO 01/14652 | A1 | 3/2001 |
| WO | WO 01/44591 | A1 | 6/2001 |
| WO | WO 2005/070474 | A1 | 8/2005 |
| WO | WO 2006/013321 | A1 | 2/2006 |
| WO | 2008044201 | | 4/2008 |
| WO | 2008076346 | | 6/2008 |

OTHER PUBLICATIONS

English Language Abstract of FR 2588742.
English Language Translation of JP 2000-70797.
English Language Translation of JP 6-170286.
English Language Machine Translation of JP 5-222757.
English Language Machine Translation of JP 2002-048884.
English Language Abstract of JP 3-9714.
English Language Abstract of JP 3-228718.
English Language Abstract of FR 2874038.
International Search Report & Written Opinion for PCT/US2006/048658 dated Jun. 13, 2007.
English Language Abstract of JP 1-97423.
English Language Machine Translation of JP 2002-180518.
English Language Machine Translation of JP 2005-344300.
English Language Machine Translation of JP 2004-100212.
English Language Machine Translation of JP 2002-286833.
English Language Machine Translation of JP 2005-36511.
English Language Machine Translation of JP 2005-211164.
English Language Machine Translation of JP 2005-103367.
English Language Machine Translation of JP 2005-52754.
English Language Machine Translation of JP 2005-46769.
English Language Machine Translation of JP 2004-283811.

* cited by examiner

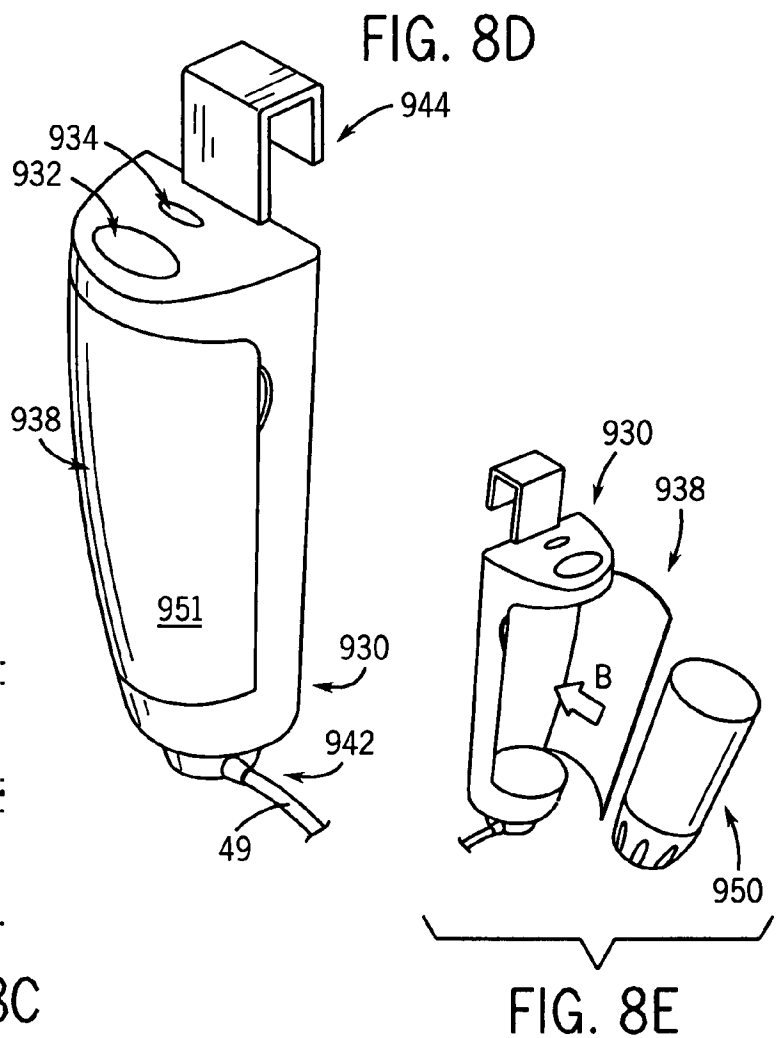
FIG. 8E
FIG. 8D
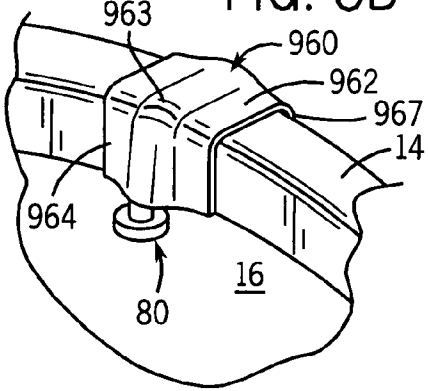
FIG. 8B
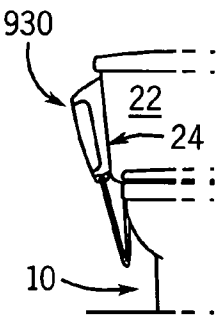
FIG. 8C
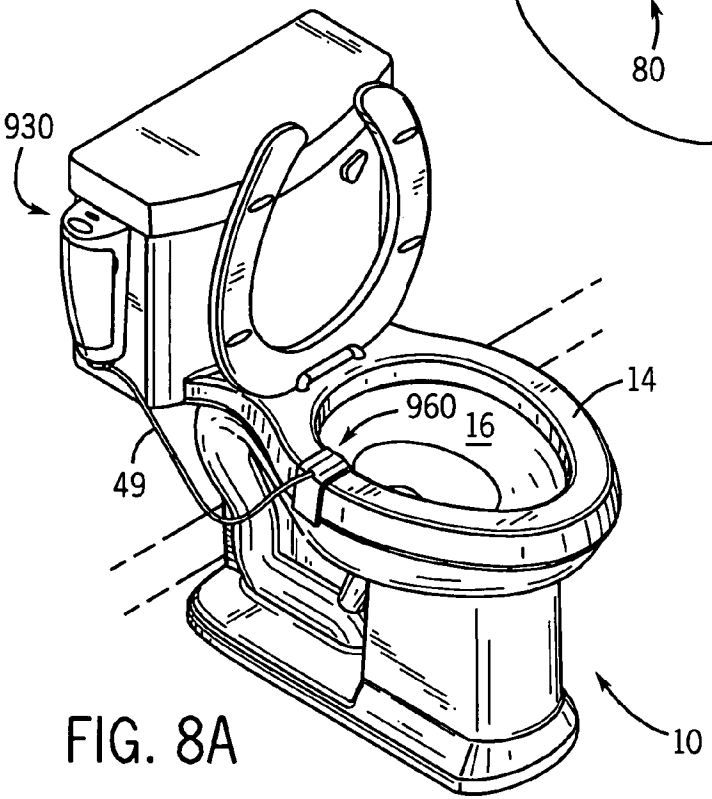
FIG. 8A 20
10
30f 20
97f
99f
14
16
10
22

30f
49
32f
34f 38f
50f
30f
A

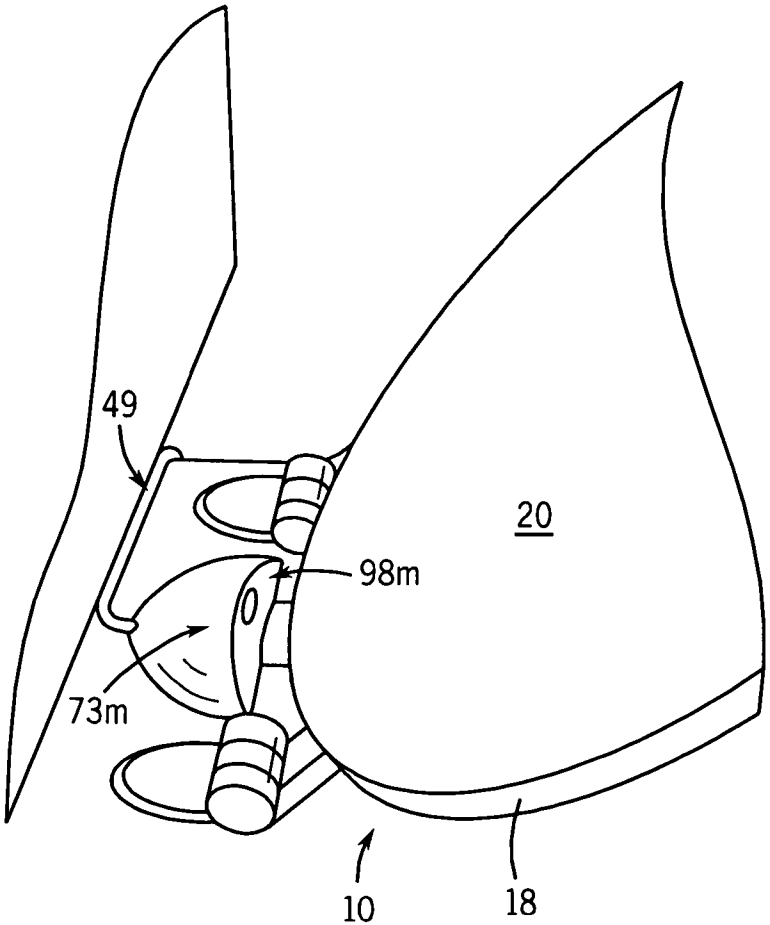
FIG. 20B
FIG. 20A
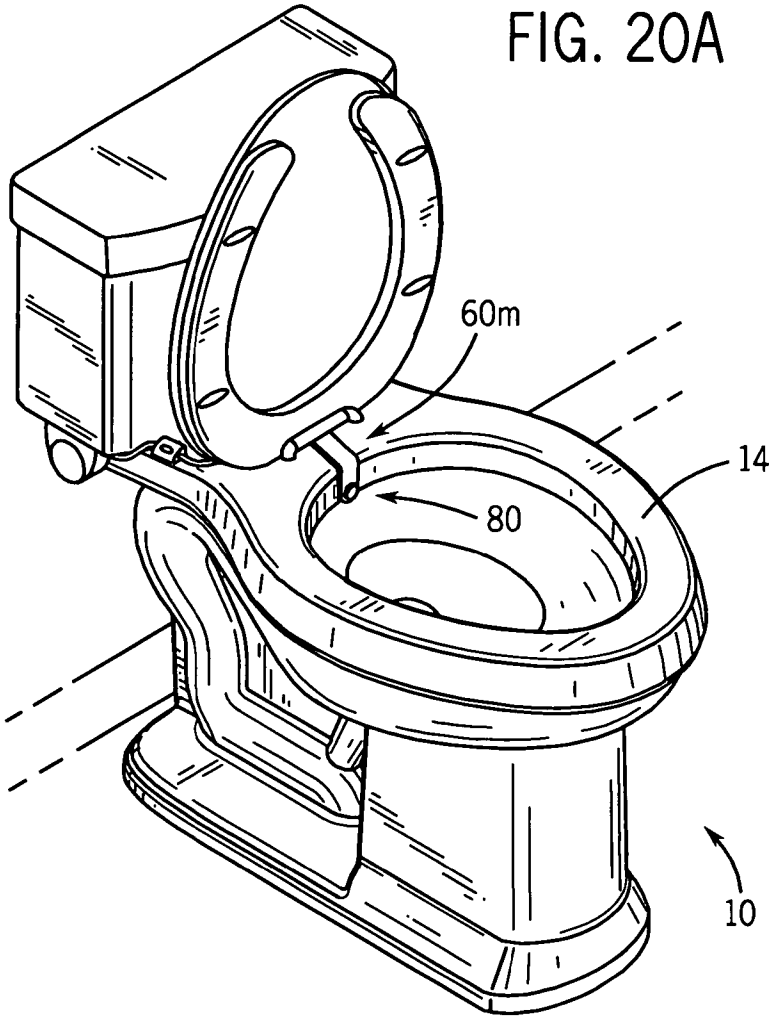

TOILET BOWL CLEANING AND/OR DEODORIZING DEVICE

CROSS-REFERENCES TO RELATED APPLICATIONS

Not Applicable.

STATEMENT REGARDING FEDERALLY SPONSORED RESEARCH

Not Applicable.

BACKGROUND OF THE INVENTION

1. Field of the Invention

This invention relates to an automatic or manual toilet bowl cleaning device where the inner surface of the toilet bowl can be cleaned around the entire circumference of the toilet bowl at locations below the toilet waterline, and/or locations at the toilet waterline, and/or locations above the toilet waterline, and/or locations under the toilet rim.

2. Description of the Related Art

Toilet bowls require care to prevent the buildup of unsightly deposits, to reduce odors and to prevent bacteria growth. Traditionally, toilet bowls have been cleaned, deodorized and disinfected by manual scrubbing with a liquid or powdered cleaning and sanitizing agent. This task has required manual labor to keep the toilet bowl clean.

In order to eliminate the manual scrubbing, various toilet bowl cleaner dispensers have been proposed. One type of dispenser comprises a solid block or solid particles of a cleansing and freshening substance that is suspended from the rim of a toilet bowl in a container that is placed in the path of the flushing water. U.S. Pat. No. 4,777,670 (which is incorporated herein by reference along with all other documents cited herein) shows an example of this type of toilet bowl cleaning system. Typically, a portion of the solid block is dissolved in the flush water with each flush, and the flush water having dissolved product is dispensed into the toilet bowl for cleaning the bowl.

Other toilet bowl cleaning systems use a liquid cleaning agent that is dispensed into a toilet bowl. For example, U.S. Pat. Nos. 6,178,564 and 6,230,334, and PCT International Publication Nos. WO 99/66139 and WO 99/66140 all disclose cleansing and/or freshening devices capable of being suspended from the rim of a toilet bowl for the purpose of introducing liquid active substances from a bottle into the flushing water with each flush. In these under the toilet rim devices, the liquid active substances are delivered downward from a reservoir to a dispensing plate that is supported by a base that is suspended from the toilet bowl rim. The device is suspended from the toilet rim such that the flow of flush water from the toilet contacts the dispensing plate during a flush. The flush water carries the liquid active substances that are on the dispensing plate into the toilet bowl to clean and freshen the toilet.

Other toilet bowl dispensers use an aerosol deodorizing and/or cleaning agent that is dispensed into a toilet bowl through a conduit attached to the toilet bowl rim. For example, U.S. Pat. No. 3,178,070 discloses an aerosol container mounted by a bracket on a toilet rim with a tube extending over the rim; and U.S. Pat. Nos. 6,029,286 and 5,862,532 disclose dispensers for a toilet bowl including a pressurized reservoir of fluid, a conduit connected to the source of fluid, and a spray nozzle which is installed on the toilet rim.

One disadvantage with these known toilet rim dispensing devices is that these devices may only apply the deodorizing and/or cleaning agent to one location in the toilet water or a limited area in the toilet water or on the inner surface of the toilet bowl. As a result, the cleaning of the inner surface of the toilet bowl may be limited to an area of the toilet bowl near the device.

Thus, there is a need for an improved automatic or manual toilet bowl cleaning device where the inner surface of the toilet bowl is cleaned around the entire circumference of the toilet bowl.

SUMMARY OF THE INVENTION

The foregoing need can be met with a toilet bowl cleaning and/or deodorizing device according to the invention that automatically or manually delivers a chemical into the toilet bowl. The term "chemical" or "chemistry" means one chemical or a mixture of chemical ingredients. Various cleaning and/or deodorizing chemicals are suitable for use with a toilet bowl cleaning device according to the invention. The toilet bowl cleaning and/or deodorizing device includes appropriate chemistry and a dispensing system. As used herein, the term "cleaning" also includes sanitizing and/or disinfecting, and the term "deodorizing" also includes freshening.

Regarding the chemistry, a chemical is applied directly onto the inner surface of the toilet bowl and/or into the toilet water so as to continuously clean and freshen the toilet bowl. If applied to the inner surface of the toilet bowl, the chemical will either be a liquid (either single or multiple chemistry system, the multiple chemistry system combining at the point of use to create a new formula which is most effective by mixing it at that point) or a flowable powder. If added to the toilet water, the chemistry may be liquid (single or multiple chemistries) or a flowable solid (powder or crystals) that is added to the water to act as a preventive, or to create an environment that will work to clean the toilet automatically. An example of this would be to create chlorine dioxide using the toilet water, thus creating the chemistry in a gaseous state. The gas would work to coat the bowl surface and work on the various culprits.

With respect to the dispensing system, the system includes several subsystems which are the means for applying the appropriate chemistry to the inner surface of the toilet bowl to conduct the cleaning process. The dispensing system may include (but is not limited to): (i) a chemistry storage container; (ii) a chemical propulsion system; (iii) a chemical delivery system; (iv) a toilet interface; and (v) a case for the container.

The chemistry storage container is used to hold and store the chemistry used to clean the toilet bowl. Non-limiting examples include a standard plastic bottle, such as that found on a trigger sprayer, or an aerosol can.

The chemical propulsion system provides a method of providing the appropriate energy to the chemistry to move it through the delivery system so that it can move from the storage container to the appropriate area within the toilet bowl. Examples of this subsystem include an aerosol container using propellants such as liquid petroleum gas or a similar hydrocarbon based propellant, air, nitrogen or carbon dioxide. Another set of examples uses a pump or pumping mechanism to move a liquid such as a vein pump, impeller driven pump, peristaltic pump or gear driven pump. In a third example chemical propulsion system, a piston or screw mechanism is used to push the chemical into the delivery system. This system would use a motor or worm gear to drive a platform against the liquid, continuing to move the liquid at a constant pressure into the system. In a fourth example system, a mechanical means of throwing a powder or a liquid into the toilet is employed. Finally, a mechanical means to blow a powder into the toilet can be employed (in conjunction with an air stream).

The chemical delivery system provides a method of taking moving chemistry from its storage container to the appropriate area within the toilet bowl. This delivery subsystem can include a spigot, actuator, hose and nozzle.

The toilet interface provides a means and method of attachment to the toilet to keep the hose out of the way, keep it uncrimped, and secure the nozzle into place on the toilet rim or toilet lid.

The case provides a place to stabilize and store the chemical storage container. The case can include a base and housing unit.

These subsystems work together to deliver the appropriate chemistry at predetermined times (using predetermined amounts) over the course of each day to deliver the desired consumer benefit.

Therefore, the invention provides a device for spraying an inner surface of a toilet bowl with a chemical. The device includes a container for the chemical, a spray nozzle through which the chemical can be sprayed laterally at least halfway around a perimeter of the nozzle, a conduit in fluid communication with the container and the spray nozzle, fluid delivery means for delivering chemical from the container through the conduit and to the spray nozzle, and means for attaching the spray nozzle near a rim of the toilet bowl. Optionally, the spray nozzle can spray laterally around the entire perimeter of the nozzle.

In one form, the spray nozzle is a rotating nozzle such that the chemical can be sprayed laterally around the entire perimeter of the nozzle. For example, the spray nozzle may include a fluid spinner having a helical groove and a deflection plate that rotates when contacted by the chemical exiting the helical groove thereby spraying chemical laterally around the entire perimeter of the nozzle such that chemical covers the entire circumference of the inner surface of the toilet bowl.

In one version of the invention, the container is pressurized, and the fluid delivery means comprises a propellant in the container and a valve in the conduit. The valve has an open position for delivering chemical from the container through the conduit and to the spray nozzle. The propellant may be selected from the group consisting of hydrocarbon based propellants, air, nitrogen, and carbon dioxide. A case may be provided for the container, and the case may include an activator for moving the valve into the open position thereby delivering chemical from the container through the conduit and to the spray nozzle. The valve may be opened either manually or automatically, and in one form, the valve is a tilt valve.

The fluid delivery means may further include (i) an actuator for moving the valve into the open position and keeping the valve in the open position during a spray cycle, and (ii) a timing circuit for automatically initiating and terminating the spray cycle. The timing circuit provides a method of automatically spraying the chemical. The timing circuit initiates a first countdown. At the expiration of the first countdown, the actuator (e.g., solenoid) is activated automatically to open the valve and deliver chemical from the container through the conduit and to the spray nozzle. The timing circuit also automatically initiates a second countdown at the end of which the spray cycle is automatically terminated. The fluid delivery means may further include a proximity sensor for detecting presence of a person or household pet near the toilet bowl. The proximity sensor is in electrical communication with the timing circuit for preventing automatic initiation of the spray cycle when a person or household pet is near the toilet bowl.

Alternatively, the fluid delivery means may be a pump for delivering chemical from the container through the conduit and to the spray nozzle when the pump is activated either manually or automatically. In one embodiment, the pump is automatically activated during a spray cycle in that the fluid delivery means includes a timing circuit for automatically initiating and terminating the spray cycle. The timing circuit provides a method of automatically spraying the chemical. The timing circuit initiates a first countdown. At the expiration of the first countdown, the pump is activated automatically to deliver chemical from the container through the conduit and to the spray nozzle. The timing circuit also automatically initiates a second countdown at the end of which the spray cycle is automatically terminated by deactivating the pump. The fluid delivery means may further include a proximity sensor for detecting presence of a person or household pet near the toilet bowl. The proximity sensor is in electrical communication with the timing circuit for preventing automatic initiation of the spray cycle when a person or household pet is near the toilet bowl. The pump may be selected from the group consisting of vein pumps, impeller driven pumps, peristaltic pumps, gear driven pumps, bellows pumps, and piston pumps. A case may be provided for the container, and the case may include an activator for activating the pump.

The means for attaching the spray nozzle near a rim of the toilet bowl may be a clip having a base wall and having opposed spaced apart side walls extending away from the base wall that forms a generally U-shaped clip. Optionally, the opposed spaced apart side walls of the clip are movable toward and away from each other such that a distance between the opposed spaced apart side walls is adjustable. This allows for mounting on the clip on toilet bowl rims having various dimensions. Alternatively, the means for attaching the spray nozzle near a rim of the toilet bowl may a suction device (e.g., a suction cup) or an adhesive material that allows the nozzle to be mounted on a surface.

The container may have a translucent wall so that a user can see the amount of chemical in the container and know when to replace an empty container with a full container. When a case is provided for the container, the case may include an access door for inserting and removing the container. The case may also including an audible or visual indicator (e.g., a light emitting diode) that signals a level of chemical in the container. For example, the indicator may indicate that no chemical remains in the container such that a user should replace the container with a full container.

The case may also include a waste bin, or a receptacle for a toilet cleaning device, such as the toilet brush described in U.S. Patent Application Publication No. 2005/0005378. The case may rest on the floor next to the toilet, or the case may have a hanger for suspending the case from a toilet tank. Alternatively, the case may include means for suspending the case from a vertical surface such as a wall. Adhesive materials are an example of such means for suspending the case from a vertical surface.

In another aspect, the invention provides a device for spraying an inner surface of a toilet bowl with a chemical. The device includes a container for the chemical, a rotating spray nozzle through which the chemical can be sprayed laterally around a perimeter of the toilet bowl, a conduit in fluid communication with the container and the spray nozzle, fluid delivery means for delivering chemical from the container through the conduit and to the spray nozzle, and means for attaching the spray nozzle near a rim of the toilet bowl. The spray nozzle may include a fluid spinner having a helical groove and a deflection plate that rotates when contacted by the chemical exiting the helical groove. The deflection plate may include upwardly extending ribs that are contacted by the chemical exiting the helical groove to rotate the deflection plate.

In yet another aspect, the invention provides a device for spraying an inner surface of a toilet bowl with a chemical. The device includes a container for the chemical, a spray nozzle through which the chemical can be sprayed laterally around a perimeter of the toilet bowl, a conduit in fluid communication with the container and the spray nozzle, fluid delivery means for delivering chemical from the container through the conduit and to the spray nozzle, and means for positioning the spray nozzle so that in use the spray nozzle is near a rim of the toilet bowl. Preferably, the spray nozzle is structured such that that chemical can be sprayed laterally around the entire perimeter of the nozzle. The spray nozzle may be a rotating nozzle. In one form, the spray nozzle includes a fluid spinner having a helical groove and a deflection plate that rotates when contacted by the chemical exiting the helical groove.

In still another aspect, the invention provides a device for spraying an inner surface of a toilet bowl with a chemical from a container. The device includes a spray nozzle through which the chemical can be sprayed laterally at least halfway around a perimeter of the nozzle, a conduit in fluid communication the spray nozzle, and means for attaching the spray nozzle near a rim of the toilet bowl. Preferably, the spray nozzle is structured such that that chemical can be sprayed laterally around the entire perimeter of the nozzle. In one form, the spray nozzle is a rotating nozzle. In another form, the spray nozzle includes a fluid spinner having a helical groove and a deflection plate that rotates when contacted by the chemical exiting the helical groove.

The means for attaching the spray nozzle may be a clip having a base wall and having opposed spaced apart side walls extending away from the base wall. The opposed spaced apart side walls of the clip are preferably movable toward and away from each other such that a distance between the opposed spaced apart side walls is adjustable. In another form, the means for attaching the spray nozzle comprises a bracket and a flexible attachment strip having at least one suction cup for attaching to the toilet. In yet another form, the means for attaching the spray nozzle includes a suction device, or an adhesive material. In one embodiment, the means for attaching the spray nozzle further comprises a proximity sensor for detecting presence of a person near the toilet bowl.

It is therefore an advantage of the invention to provide a toilet bowl cleaning device where the inner surface of the toilet bowl is cleaned around the entire circumference of the toilet bowl. The device provides for overall toilet bowl cleanliness by enhanced shine and the retardation of biofilm, mold and/or mildew growth. The device can remove or eliminate stains (hard water, metals, organic), mold, mildew, germs, odors, and bacteria.

These and other features, aspects, and advantages of the present invention will become better understood upon consideration of the following detailed description, drawings, and appended claims.

BRIEF DESCRIPTION OF THE DRAWINGS

FIG. 8A is a perspective view of a toilet bowl cleaning device according to a eighth embodiment of the invention.

FIG. 8B is a perspective view showing the mounting clip and spray nozzle of the toilet bowl cleaning device of FIG. 8A.

FIG. 8C is a side view of the chemical container case of the toilet bowl cleaning device of FIG. 8A suspended from the toilet tank.

FIG. 8D is a front right perspective view showing the chemical container case of the toilet bowl cleaning device of FIG. 8A.

FIG. 8E is a perspective view showing the chemical container being inserted in the container case of the toilet bowl cleaning device of FIG. 8A.

FIG. 20A is a perspective view of a toilet bowl cleaning device according to a twentieth embodiment of the invention.

FIG. 20B is a perspective view showing the mounting base and spray nozzle of the toilet bowl cleaning device of FIG. 20A.

Like reference numerals will be used to refer to like parts from Figure to Figure in the following description of the drawings.

DETAILED DESCRIPTION OF THE INVENTION

The invention provides a device for spraying an inner surface of a toilet bowl with a chemical. Various embodiments of the invention will now be described with reference to the Figures. The embodiments are shown and described for the purposes of illustration and are not intended to limit the invention in any way.

Figure 1C:
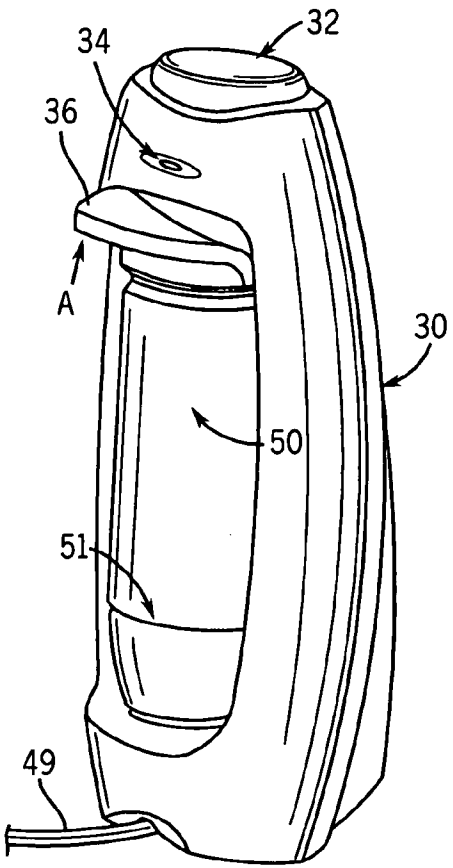
FIG. 1C is a perspective view showing the chemical container and container case of the toilet bowl cleaning device of FIG. 1A.
Figure 1B:
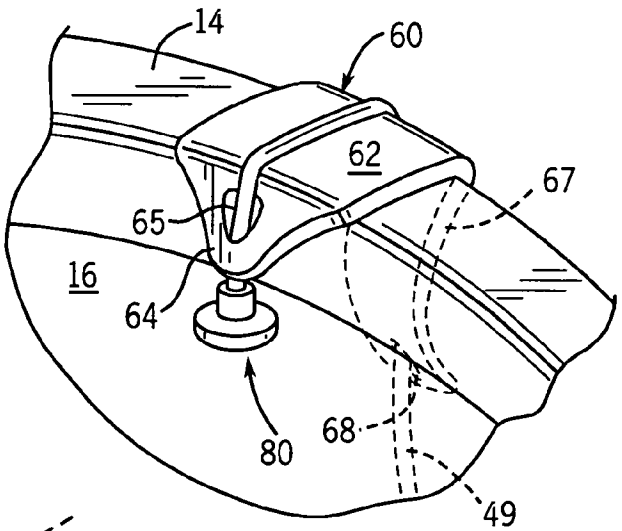
FIG. 1B is a perspective view taken along line 1B-1B of FIG. 1A showing the mounting clip and spray nozzle of the toilet bowl cleaning device of FIG. 1A.
Figure 1A:
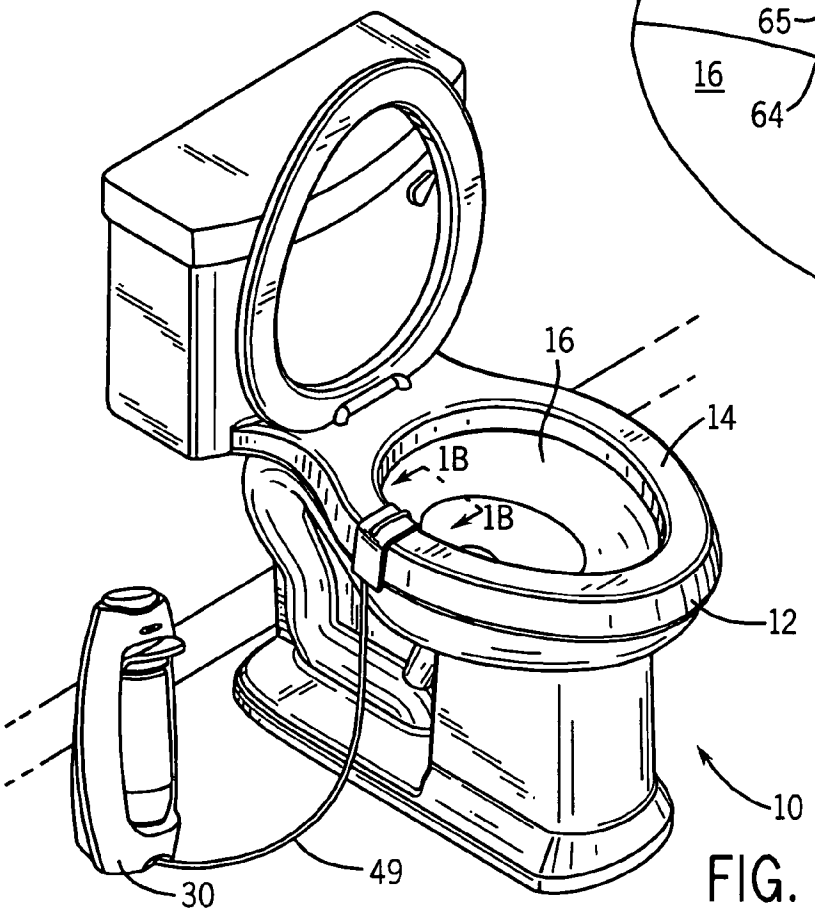
FIG. 1A is a perspective view of a toilet bowl cleaning device according to a first embodiment of the invention.

Turning to FIGS. 1A-1C, there is shown an embodiment of the invention. The toilet bowl cleaning and/or deodorizing device includes a container 50 for a chemical, a spray nozzle 80 through which the chemical can be sprayed laterally around a perimeter of the nozzle 80, a fluid supply conduit 49 in fluid communication with the container 50 and the spray nozzle 80, and a mounting clip 60 for attaching the spray nozzle 80 near the rim 14 of the toilet bowl 12 of the toilet 10. The chemical can be sprayed by the spray nozzle 80 directly onto the inner surface 16 of the toilet bowl 12 and/or into the toilet water so as to continuously clean and deodorize the toilet bowl 12 as described below.

The container 50 is housed upside down in a case 30. A fitment is provided in the case 30 for engaging an outlet of the container 50. The fitment of the case 30 is also connected to the fluid supply conduit 49. A wall 51 of the container 50 may be translucent so the user can see when the container is empty. The case 30 includes a container holder 36 that keeps the container 50 securely mounted in the case 30. In one form, the container holder 36 is downwardly biased plate that may be lifted by a user in the direction of arrow A to release and remove an empty container 50 and thereafter load a new container 50.

A use-up cue light emitting diode (LED) 34 is provided in the case 30. A pressure sensor senses a pressure drop in the container 50 when the container 50 is empty and the pressure sensor triggers the LED to emit light and signal that an empty container 50 exists. Optionally, the pressure sensor triggers an audible alarm to signal that an empty container 50 exists. Alternatively, the LED is part of a control circuit including a counter. The counter is incremented after each depression of an activator button (such as manual activator button 32 described below). After a certain number of depressions of the activator button, the counter triggers the LED to emit light and signal that an empty container 50 exists.

The case 30 also includes a manual activator button 32. In one version of the invention, the container 50 is pressurized and includes a propellant in the container 50 and an outlet valve. The manual activator button 32 moves the valve into an open position for delivering chemical from the container 50 through the conduit 49 and to the spray nozzle 80. For example, the activator button 32 pushes the container 50 downward such that the valve at the bottom of the container 50 opens.

FIG. 1B shows the mounting clip 60 for attaching the spray nozzle 80 near the rim 14 of the toilet bowl 12 of the toilet 10. The mounting clip 60 has a base wall 62, a first side wall 64, and a second side wall 67 spaced from the first side wall 64 to create an inverted generally U-shaped clip 60. The clip 60 is formed from a flexible plastic to allow for expansion and contraction to accommodate various toilet bowl rim sizes. The conduit 49 is threaded through a hole 65 in the first side wall 64, over the base wall 62, and through a hole 68 in the second side wall 67. This controls location of the conduit 49 to next to the mounting clip 60 and serves to hide part of the conduit 49. The spray nozzle 80 engages an end of the conduit 49 as shown in FIG. 1B and receives chemical from the conduit 49.

Referring now to FIGS. 2A-2E, there is shown another embodiment of the invention. The toilet bowl cleaning and/or deodorizing device includes a container 150 for a chemical, a spray nozzle 80 through which the chemical can be sprayed laterally around a perimeter of the nozzle 80, a fluid supply conduit 49 in fluid communication with the container 150 and the spray nozzle 80, and a mounting clip 160 for attaching the spray nozzle 80 near the rim 14 of the toilet bowl 12 of the toilet 10. The chemical can be sprayed by the spray nozzle 80 directly onto the inner surface 16 of the toilet bowl 12 and/or into the toilet water as described below.

Figures 2A, 2B, 2C, 2D, 2E:
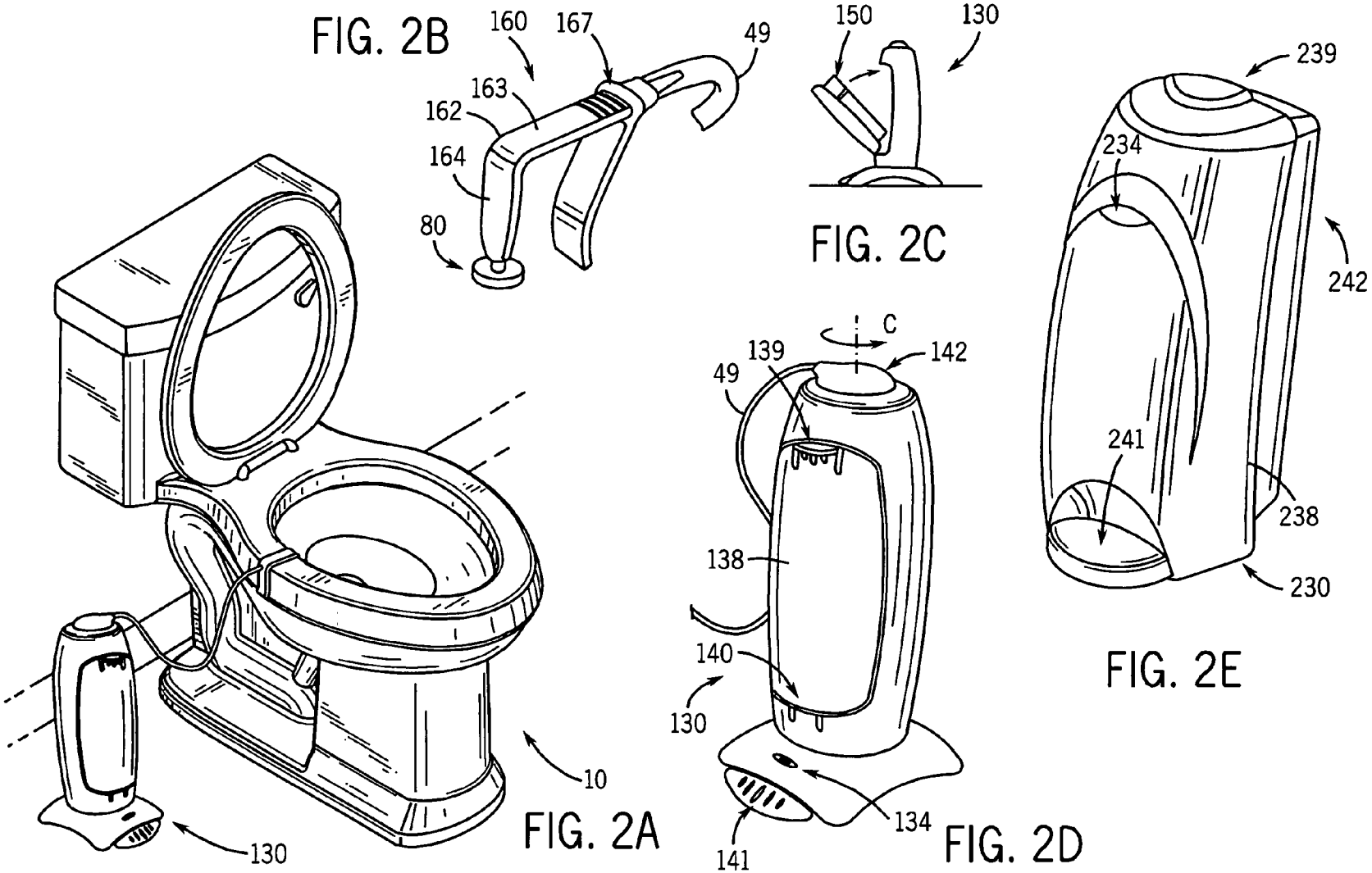
FIG. 2A is a perspective view of a toilet bowl cleaning device according to a second embodiment of the invention.
FIG. 2B is a perspective view showing the mounting and spray nozzle of the toilet bowl cleaning device of FIG. 2A.
FIG. 2C is a side view showing the chemical container being inserted in the container case of the toilet bowl cleaning device of FIG. 2A.
FIG. 2D is a perspective view showing the chemical container case of the toilet bowl cleaning device of FIG. 2A.
FIG. 2E is a perspective view showing an alternative chemical container case for use with the toilet bowl cleaning device of FIG. 2A.

The container 150 is housed in a case 130. A fitment is provided in the case 130 for engaging an outlet of the container 150. The fitment of the case 130 is connected to the fluid supply conduit 49 by a rotating hose connector 142 that allows the conduit 49 to rotate in direction C. The case 130 includes an access door 138 that may be opened by a user as shown in FIG. 2C to remove an empty container 150 and thereafter load a new container 150. A hinge 140 is provided at the bottom of the door 138 for swinging movement of the door 138. A latch 139 keeps the door 138 shut until a user unlatches the door 138. A use-up cue light emitting diode (LED) 134 is provided in the case 130. A pressure sensor senses a pressure drop in the container 150 when the container 150 is empty and the pressure sensor triggers the LED to emit light and signal that an empty container 150 exists. Alternatively, the LED 134 is part of a control circuit including a counter. The counter is incremented after each depression of an activator button or foot pedal (such as manual activator foot pedal 141 described below). After a certain number of depressions of the activator button or foot pedal, the counter triggers the LED 134 to emit light and signal that an empty container exists.

The case 130 also includes a manual activator foot pedal 141. In one version of the invention, the container 150 is pressurized and includes a propellant in the container 150 and an outlet valve. The manual activator foot pedal 141 moves the container 150 upward such that the valve at the top of the container 150 opens and delivers chemical to the conduit 49. The valve may be a standard vertical aerosol valve in this embodiment.

FIG. 2B shows the mounting clip 160 for attaching the spray nozzle 80 near the rim 14 of the toilet bowl 12 of the toilet 10. The mounting clip 160 has a base wall 162, a first side wall 164, and a second side wall 167 spaced from the first side wall 164 to create an inverted generally U-shaped clip 160. The second side wall 167 slides on the base wall 162 such that the first side wall 164 and the second side wall are movable toward and away from each other. This expansion and contraction of the clip 160 accommodates various toilet bowl rim sizes. The conduit 49 is connected to a passageway 163 in the base wall 162. The spray nozzle 80 engages an end of the passageway 163 as shown in FIG. 2B and receives chemical from the passageway 163.

FIG. 2E shows another case 230 for the container 150. A fitment is provided in the case 230 for engaging an outlet of the container 150. The case 230 includes an access door 238 that may be opened by a user to remove an empty container 150 and thereafter load a new container 150. A hinge is provided at the bottom of the door 238 for swinging movement of the door 238. A latch button 239 keeps the door 238 shut until a user unlatches the door 238. A use-up cue light emitting diode (LED) 234 is provided in the case 230 and operates as LED 134 described above. The case 230 also includes a manual activator foot pedal 241 which operates as manual activator foot pedal 141 described above.

Figure 3C:
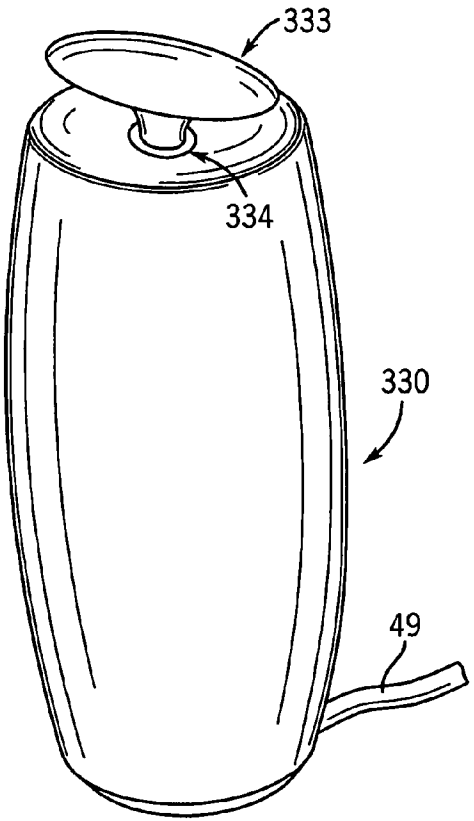
FIG. 3C is a perspective view showing the chemical container case of the toilet bowl cleaning device of FIG. 3A.
Figure 3B:
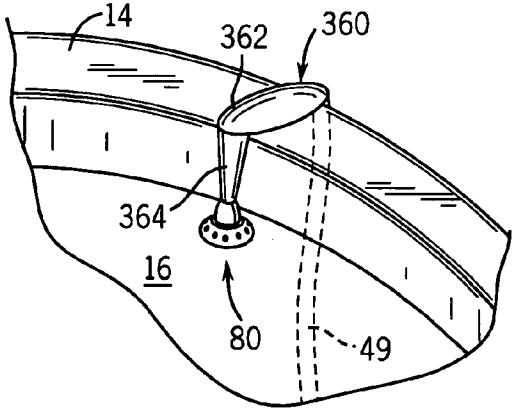
FIG. 3B is a perspective view showing the mounting clip and spray nozzle of the toilet bowl cleaning device of FIG. 3A.
Figure 3A:
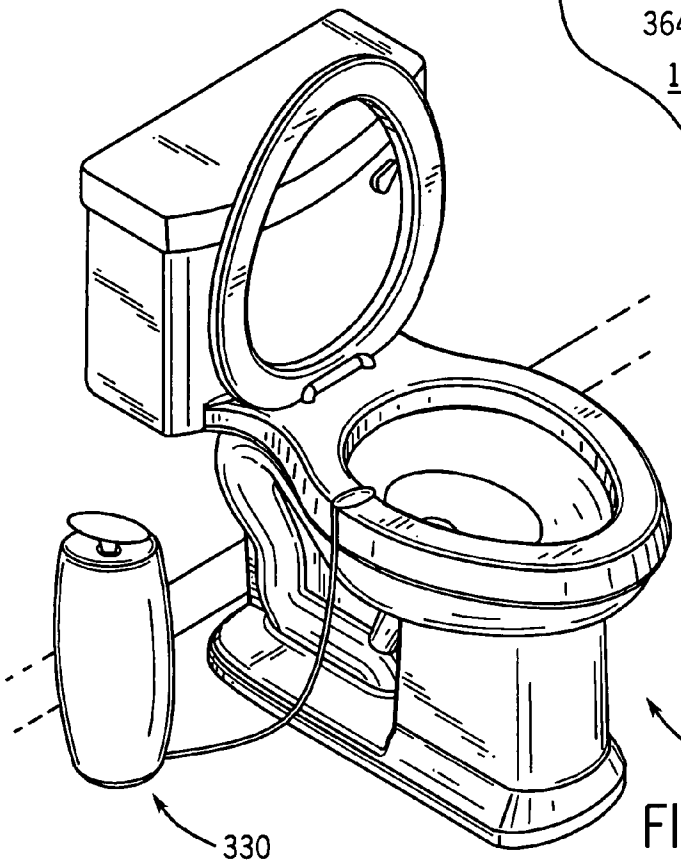
FIG. 3A is a perspective view of a toilet bowl cleaning device according to a third embodiment of the invention.

Turning to FIGS. 3A-3C, there is shown another embodiment of the invention. The toilet bowl cleaning and/or deodorizing device includes a container for a chemical, a spray nozzle 80 through which the chemical can be sprayed laterally around a perimeter of the nozzle 80, a fluid supply conduit 49 in fluid communication with the container and the spray nozzle 80, and a mounting clip 360 for attaching the spray nozzle 80 near the rim 14 of the toilet bowl 12 of the toilet 10. The chemical can be sprayed by the spray nozzle 80 directly onto the inner surface 16 of the toilet bowl 12 and/or into the toilet water as described below.

The container is housed in a case 330. The container may be exposed at the rear of the case 330. A fitment is provided in the case 330 for engaging an outlet of the container. The fitment of the case 330 is connected to the fluid supply conduit 49. The case 330 includes a T-shaped activator handle 333. The container may be pressurized and include a propellant in the container and an outlet valve. The activator handle 333 pushes the container 50 downward such that the valve at the bottom of the container 50 opens for delivering chemical from the container through the conduit 49 and to the spray nozzle 80. The handle 333 also allows the case 300 to be carried around by a user. A circular use-up cue light emitting diode (LED) 334 is provided in the case 330 around the base of the handle 333. The LED 334 operates as LED 134 described above.

FIG. 3B shows the mounting clip 360 for attaching the spray nozzle 80 near the rim 14 of the toilet bowl 12 of the toilet 10. The mounting clip 360 has a base wall 362 and a side wall 164 to create an inverted generally L-shaped clip 160 that may be adhered to the toilet rim 14 by an adhesive or a suction cup. The conduit 49 is connected to a passageway in the base wall 362. The spray nozzle 80 engages an end of the passageway 363 as shown in FIG. 3B and receives chemical from the passageway.

Referring now to FIGS. 4A-4D, there is shown another embodiment of the invention. The toilet bowl cleaning and/or deodorizing device includes a container 550 for a chemical, a spray nozzle 80 through which the chemical can be sprayed laterally around a perimeter of the nozzle 80, a fluid supply conduit 49 in fluid communication with the container 550 and the spray nozzle 80, and a mounting assembly 560 for attaching the spray nozzle 80 near the rim 14 of the toilet bowl 12 of the toilet 10. The chemical can be sprayed by the spray nozzle 80 directly onto the inner surface 16 of the toilet bowl 12 and/or into the toilet water as described below.

Figures 4A, 4B, 4C, 4D:
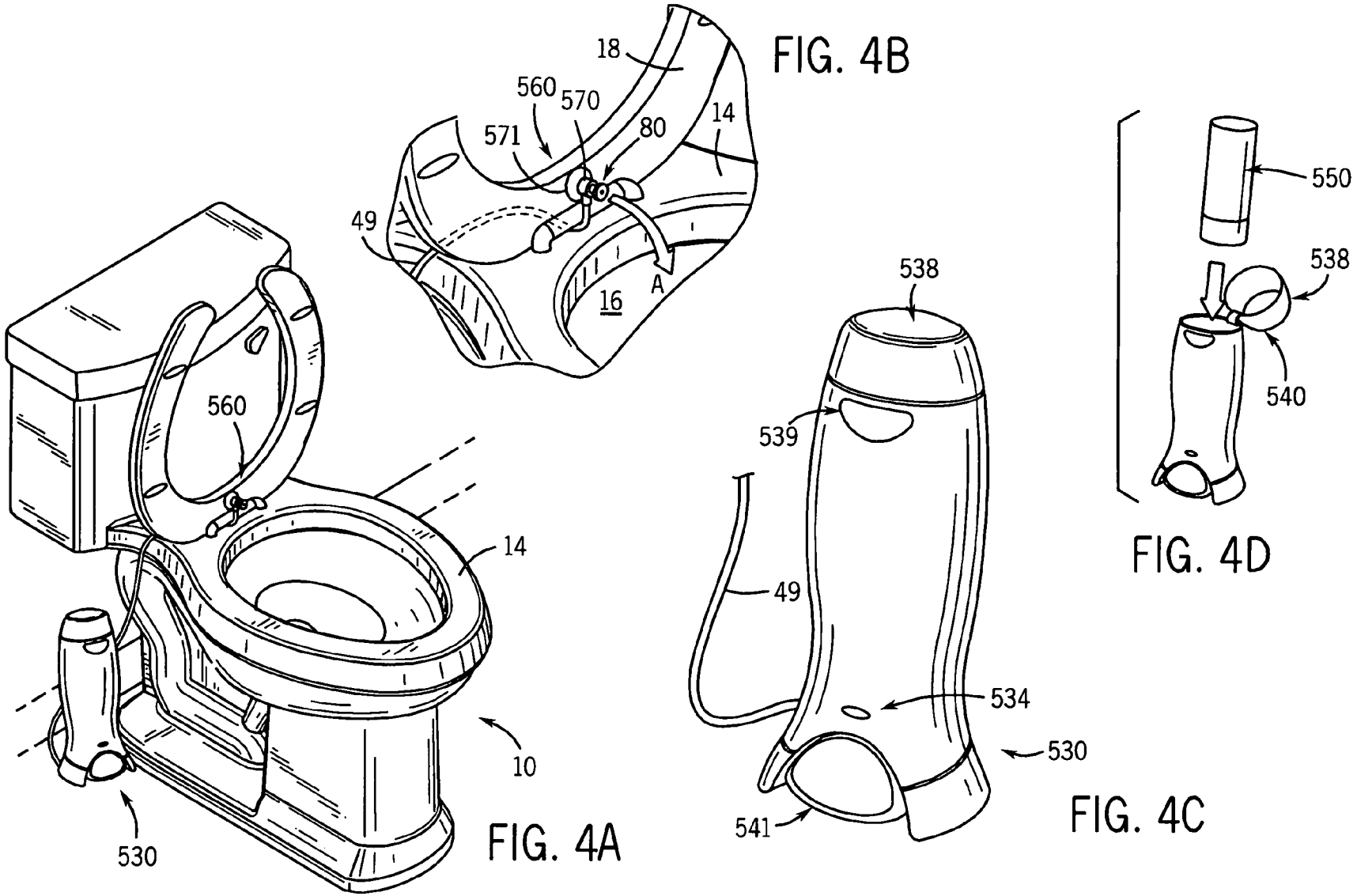
FIG. 4A is a perspective view of a toilet bowl cleaning device according to a fourth embodiment of the invention.
FIG. 4B is a perspective view showing the mounting bracket and spray nozzle of the toilet bowl cleaning device of FIG. 4A.
FIG. 4C is a perspective view showing the chemical container case of the toilet bowl cleaning device of FIG. 4A.
FIG. 4D is a perspective view showing the chemical container being inserted in the container case of the toilet bowl cleaning device of FIG. 4A.

The container 550 is housed in a case 530. A fitment is provided in the case 530 for engaging an outlet of the container 550. The fitment of the case 530 is connected to the fluid supply conduit 49 which exits at the back of the case 530. The case 530 includes a top access door 538 that may be opened by a user as shown in FIG. 4D to remove an empty container 550 and thereafter load a new container 550. A hinge 540 is provided at the bottom rear of the door 538 for swinging movement of the door 538. A latch 539 keeps the door 538 shut until a user unlatches the door 538. A use-up cue light emitting diode (LED) 534 is provided in the case 530. A pressure sensor senses a pressure drop in the container 550 when the container 550 is empty and the pressure sensor triggers the LED to emit light and signal that an empty container 550 exists.

The case 530 also includes a manual activator foot pedal 541. In one version of the invention, the container 550 is pressurized and includes a propellant in the container 550 and an outlet valve. The manual activator foot pedal 541 moves the container 550 such that the valve of the container 550 opens and delivers chemical to the conduit 49.

FIG. 4B shows the mounting assembly 560 for attaching the spray nozzle 80 under the toilet seat 18 of the toilet 10. The mounting assembly 560 has a T-shaped bracket 570 and a suction cup 571 that may be adhered to the toilet seat 18. The conduit 49 is connected to a passageway in the T-shaped bracket 570. The spray nozzle 80 engages an end of the passageway as shown in FIG. 4B and receives chemical from the passageway.

Turning to FIGS. 5A-5D, there is shown another embodiment of the invention. The toilet bowl cleaning and/or deodorizing device includes a container 650 for a chemical, a spray nozzle 80 through which the chemical can be sprayed laterally around a perimeter of the nozzle 80, a fluid supply conduit 49 in fluid communication with the container 650 and the spray nozzle 80, and a mounting bracket 660 for attaching the spray nozzle 80 near the rim 14 of the toilet bowl 12 of the toilet 10. The chemical can be sprayed by the spray nozzle 80 directly onto the inner surface 16 of the toilet bowl 12 and/or into the toilet water as described below.

Figure 5D:
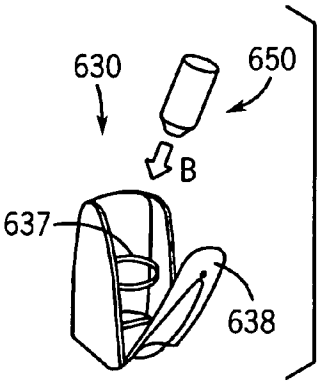
FIG. 5D is a perspective view showing the chemical container being inserted in the container case of the toilet bowl cleaning device of FIG. 5A.
Figure 5C:
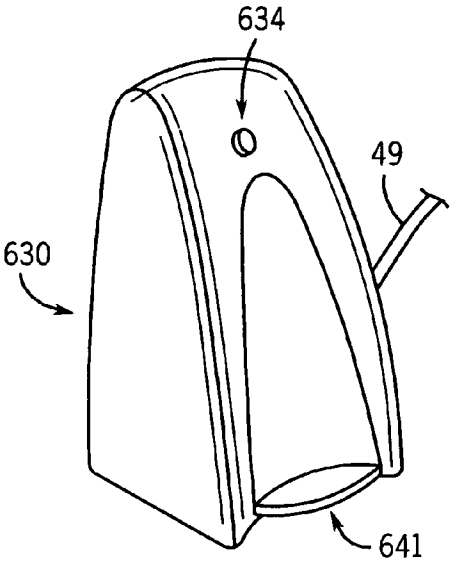
FIG. 5C is a perspective view showing the chemical container case of the toilet bowl cleaning device of FIG. 5A.

The container 650 is housed in a case 630. A retaining ring 637 keeps the container 650 secure in the case 630. A fitment is provided in the case 630 for engaging an outlet of the container 650. The fitment of the case 630 is connected to the fluid supply conduit 49. The case 630 includes an access door 638 that may be opened forwardly by a user as shown in FIG. 5D to remove an empty container 650 and thereafter load a new container 650 in direction B shown in FIG. 5D. A hinge is provided at the bottom of the door 638 for swinging movement of the door 638. A latch keeps the door 638 shut until a user unlatches the door 638. A use-up cue light emitting diode (LED) 634 is provided in the case 630. The LED 634 operates as LED 134 described above. The case 630 also includes a manual activator foot pedal 641. In one version of the invention, the container 650 is pressurized and includes a propellant in the container 650 and an outlet valve. The manual activator foot pedal 641 moves the container 650 such that the valve of the container 650 opens and delivers chemical to the conduit 49.

Figure 5B:
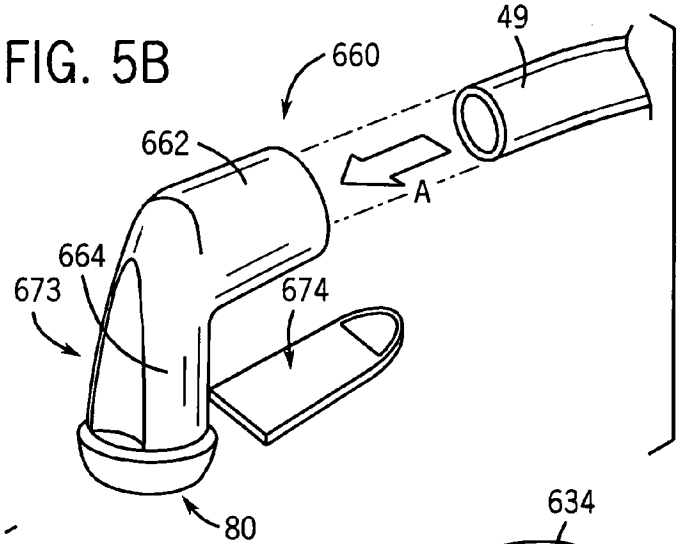
FIG. 5B is a perspective view showing the mounting strip and spray nozzle of the toilet bowl cleaning device of FIG. 5A.
Figure 5A:
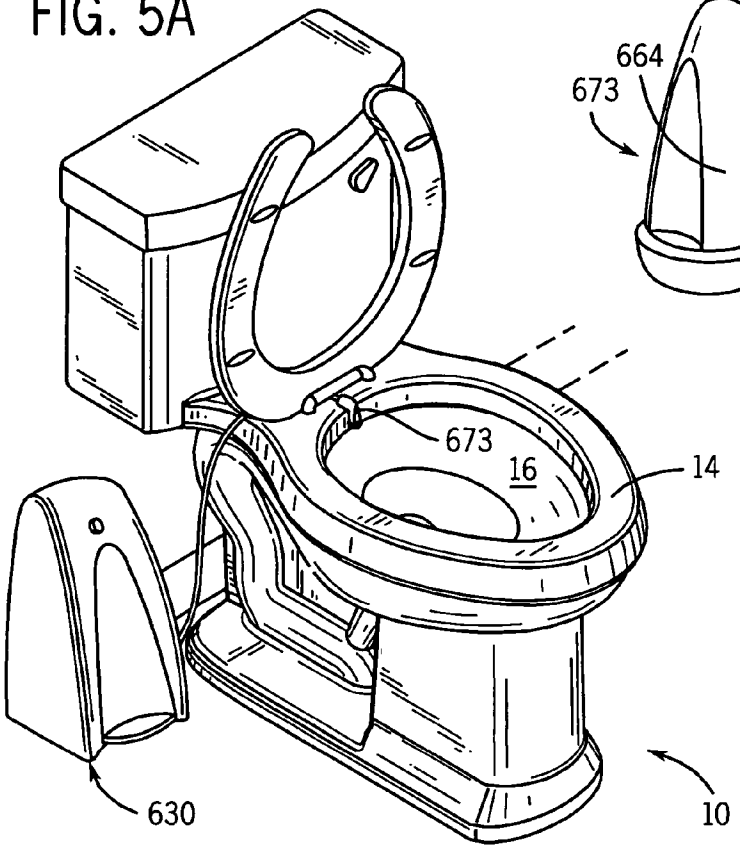
FIG. 5A is a perspective view of a toilet bowl cleaning device according to a fifth embodiment of the invention.

FIG. 5B shows the mounting clip 660 for attaching the spray nozzle 80 near the rim 14 of the toilet bowl 12 of the toilet 10. The mounting clip 660 has a base wall 662 and a side wall 664 to create an inverted generally L-shaped bracket 673 that may be adhered to the toilet rim 14 by a double sided adhesive strip 674. The adhesive strip 674 can be removed by pulling the tab. The conduit 49 is connected to a passageway in the L-shaped bracket 673 by moving the conduit 49 in the direction of arrow A. The spray nozzle 80 engages an end of the passageway as shown in FIG. 5B and receives chemical from the passageway.

Referring now to FIGS. 6A-6D, there is shown another embodiment of the invention. The toilet bowl cleaning and/or deodorizing device includes a container 750 for a chemical, spray nozzles 778 through which the chemical can be sprayed laterally around a perimeter of the nozzles 778, a fluid supply conduit 49 in fluid communication with the container 750 and the spray nozzles 778, and a mounting assembly 760 having the spray nozzles 778 which are positioned near the rim 14 of the toilet bowl 12 of the toilet 10. The chemical can be sprayed by the spray nozzles 778 directly onto the inner surface 16 of the toilet bowl 12 and/or into the toilet water as described below.

The container 750 is housed in a case 730 and displayed at an angle from vertical. The container 750 may be translucent so the user can see when the container is empty. The case 730 includes a container holder 736 that keeps the container 750 securely mounted in the case 730. In one form, the container holder 736 is downwardly biased plate that may be lifted upward by a user to release and remove an empty container 750 and thereafter load a new container 750. A fitment is provided in the case 730 for engaging an outlet of the container 750. The fitment of the case 730 is connected to the fluid supply conduit 49. The case 730 also includes a manual activator button 732. In one version of the invention, the container 750 is pressurized and includes a propellant in the container 750 and an outlet valve. The manual activator button 732 moves the valve into an open position for delivering chemical from the container 750 through the conduit 49 and to the spray nozzle 80. For example, the activator button 732 pushes the container 750 downward such that the valve at the bottom of the container 750 opens. A use-up cue light emitting diode (LED) 734 is also provided in the case 730. The LED 734 operates as LED 134 described above.

Figure 6D:
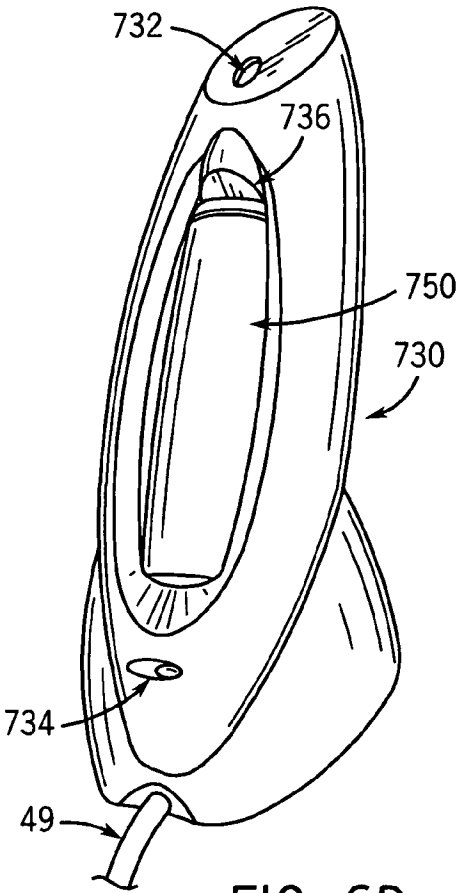
FIG. 6D is a perspective view showing the chemical container and container case of the toilet bowl cleaning device of FIG. 6A.
Figure 6B:
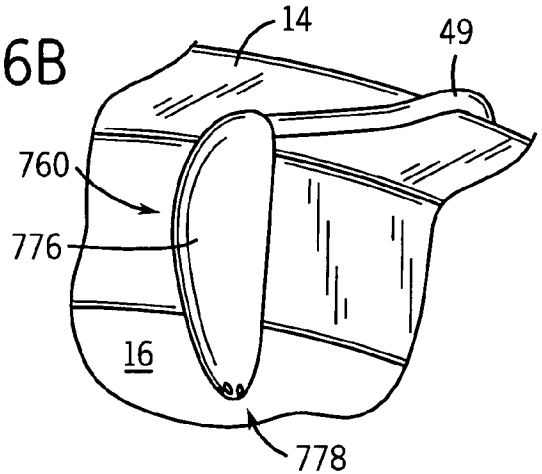
FIG. 6B is a perspective view showing the mounting case and spray nozzle of the toilet bowl cleaning device of FIG. 6A.
Figure 6C:
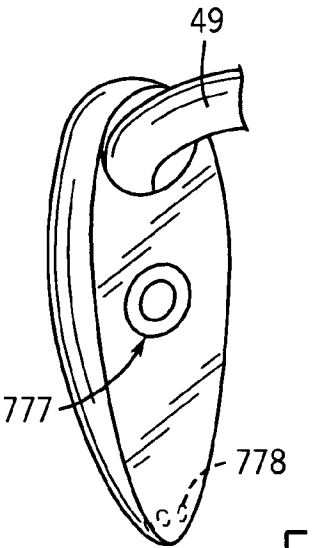
FIG. 6C is a rear view showing the mounting case of the spray nozzle of the toilet bowl cleaning device of FIG. 6A.
Figure 6A:
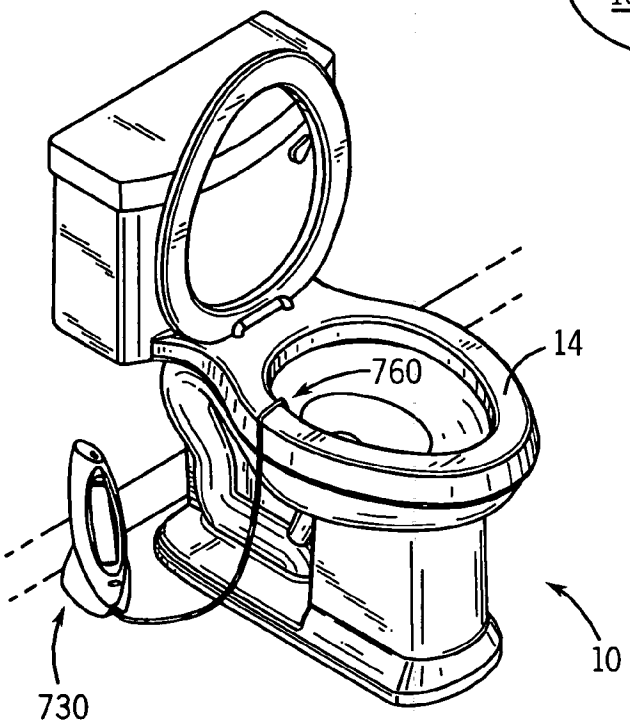
FIG. 6A is a perspective view of a toilet bowl cleaning device according to a sixth embodiment of the invention.

FIG. 6B shows the mounting assembly 760 which positions the spray nozzles 778 near the rim 14 of the toilet bowl 12 of the toilet 10. The mounting assembly 760 has a housing wall 776 that may be adhered to the toilet rim 14 by suction cup 777. The conduit 49 is connected to the spray nozzles 778 via a passageway in the mounting assembly 760.

Figure 7B:
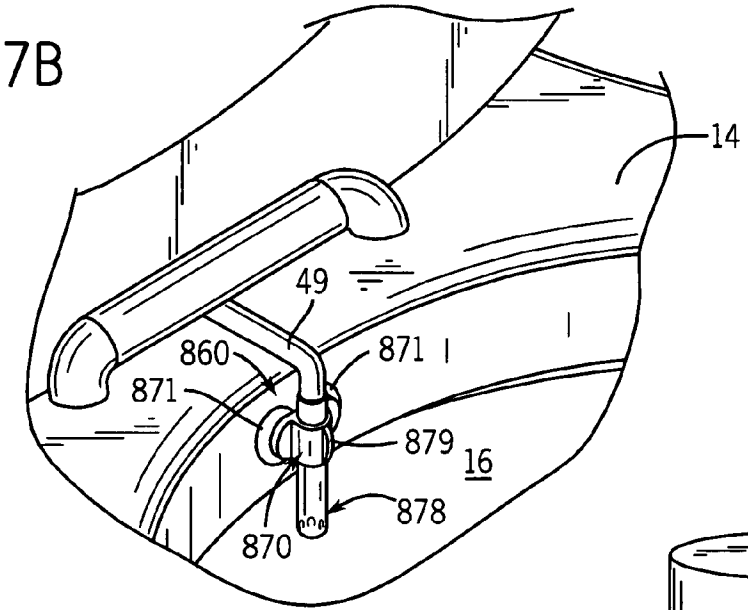
FIG. 7B is a perspective view showing the mounting bracket and spray nozzle of the toilet bowl cleaning device of FIG. 7A.
Figure 7C:
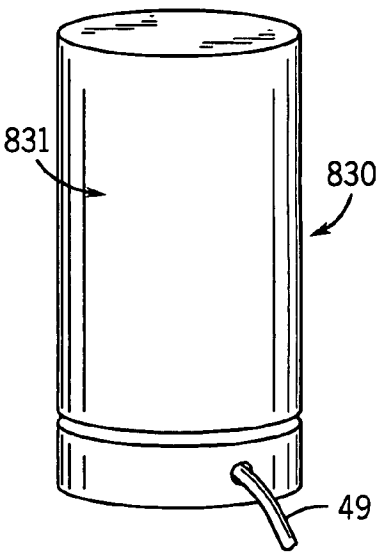
FIG. 7C is a perspective view showing the chemical container case of the toilet bowl cleaning device of FIG. 7A.
Figure 7A:
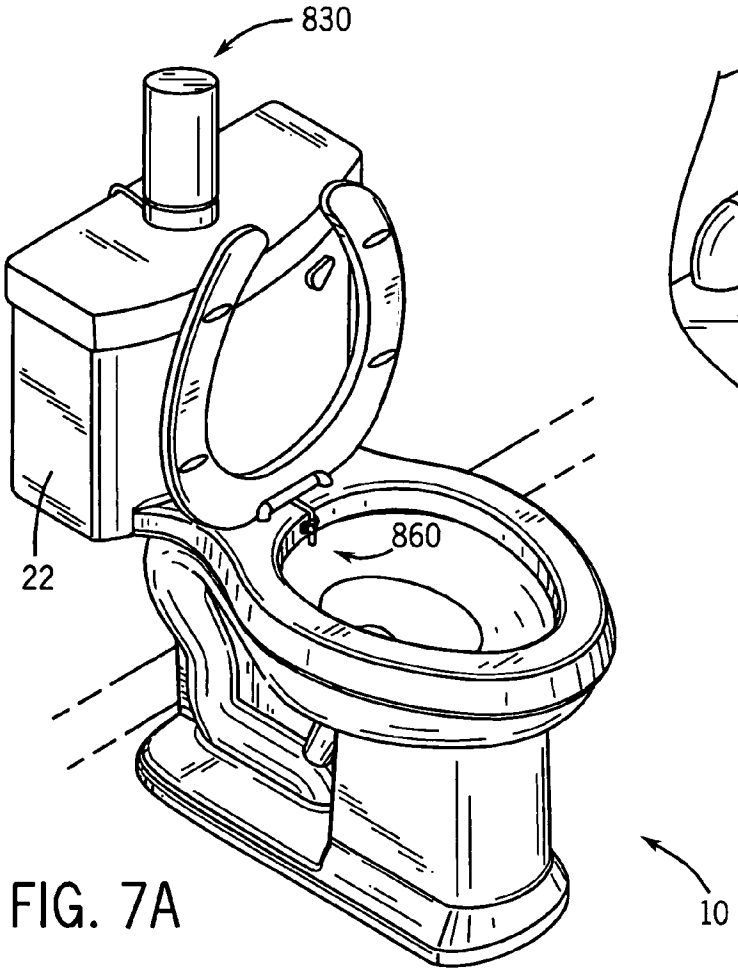
FIG. 7A is a perspective view of a toilet bowl cleaning device according to a seventh embodiment of the invention.

Turning to FIGS. 7A-7C, there is shown another embodiment of the invention. The toilet bowl cleaning and/or deodorizing device includes a container for a chemical, spray nozzles 878 through which the chemical can be sprayed laterally around a perimeter of the spray nozzles 878, a fluid supply conduit 49 in fluid communication with the container 750 and the spray nozzles 878, and a mounting assembly 860 having the spray nozzles 878 which are positioned near the rim 14 of the toilet bowl 12 of the toilet 10. The chemical can be sprayed by the spray nozzles 878 directly onto the inner surface 16 of the toilet bowl 12 and/or into the toilet water as described below.

The container is housed in a case 830. The case 830 may be a translucent housing 831 so the user can see when the container is empty. The case 830 includes a container holder that keeps the container securely mounted in the case 830. A fitment is provided in the case 830 for engaging an outlet of the container. The fitment of the case 830 is connected to the fluid supply conduit 49. The case 830 acts as a manual activator button. In one version of the invention, the container is pressurized and includes a propellant in the container and an outlet valve. The case 830 acts as a manual activator button by moving the valve into an open position for delivering chemical from the container through the conduit 49 and to the spray nozzles 878. For example, the case 830 pushes the container downward such that the valve at the bottom of the container opens. The translucent housing 831 may also provide a use-up cue. A pressure sensor senses a pressure drop in the container when the container is empty and the pressure sensor triggers a light within the translucent housing 831. The housing 831 then glows to signal that an empty container exists.

FIG. 7B shows a mounting bracket 860 which positions the spray nozzles 878 near the rim 14 of the toilet bowl 12 of the toilet 10. The mounting bracket 860 has a T-shaped bracket 870 that may be adhered to the toilet rim 14 by suction cups 871. The conduit 49 is connected to the spray nozzles 878 via a passageway in the T-shaped bracket 870. A plastic tab 879 allows a user to grab the T-shaped bracket 870 without unwanted interaction with the toilet 10.

Referring now to FIGS. 8A-8E, there is shown another embodiment of the invention. The toilet bowl cleaning and/or deodorizing device includes a container 950 for a chemical, a spray nozzle 80 through which the chemical can be sprayed laterally around a perimeter of the nozzle 80, a fluid supply conduit 49 in fluid communication with the container 950 and the spray nozzle 80, and a mounting clip 960 for attaching the spray nozzle 80 near the rim 14 of the toilet bowl 12 of the toilet 10. The chemical can be sprayed by the spray nozzle 80 directly onto the inner surface 16 of the toilet bowl 12 and/or into the toilet water as described below.

The container 950 is housed in a case 930. A wall 951 of the container 950 may be translucent so the user can see when the container 950 is empty. A fitment is provided in the case 930 for engaging an outlet of the container 950. The fitment of the case 930 is connected to the fluid supply conduit 49 by a rotating hose connector 942. The case 930 includes an access door 938 that may be opened by a user as shown in FIG. 8E to remove an empty container 950 and thereafter load a new container 950 in direction B shown in FIG. 8E. A hinge is provided at the side of the door 938 for swinging movement of the door 938. A latch keeps the door 938 shut until a user unlatches the door 938. A use-up cue light emitting diode (LED) 934 is provided in the case 930. The LED 934 operates as LED 134 described above. The case 930 also includes a manual activator button 932. In one version of the invention, the container 950 is pressurized and includes a propellant in the container 950 and an outlet valve. The manual activator button 932 moves the container 950 such that the valve of the container 950 opens and delivers chemical to the conduit 49. The case 930 has an inverted J-shaped hanger 944 that extends upwardly from the case 930. The hanger 944 of the case 930 allows a user to suspend the case 930 from a side wall 24 of the toilet tank 22 as shown in FIG. 8C.

FIG. 8B shows the mounting clip 960 for attaching the spray nozzle 80 near the rim 14 of the toilet bowl 12 of the toilet 10. The mounting clip 960 has a base wall 962, a first side wall 964, and a second side wall 967 spaced from the first side wall 964 to create an inverted generally U-shaped clip 960. The mounting clip 960 is flexible such that the first side wall 164 and the second side wall are movable toward and away from each other. This expansion and contraction of the clip 960 accommodates various toilet bowl rim sizes. The conduit 49 is connected to a passageway 963 in the mounting clip 960. The spray nozzle 80 engages an end of the passageway 963 as shown in FIG. 8B and receives chemical from the passageway 963. The low profile wide bowl clip 960 hides the appearance of the conduit 49.

Figure 9C:
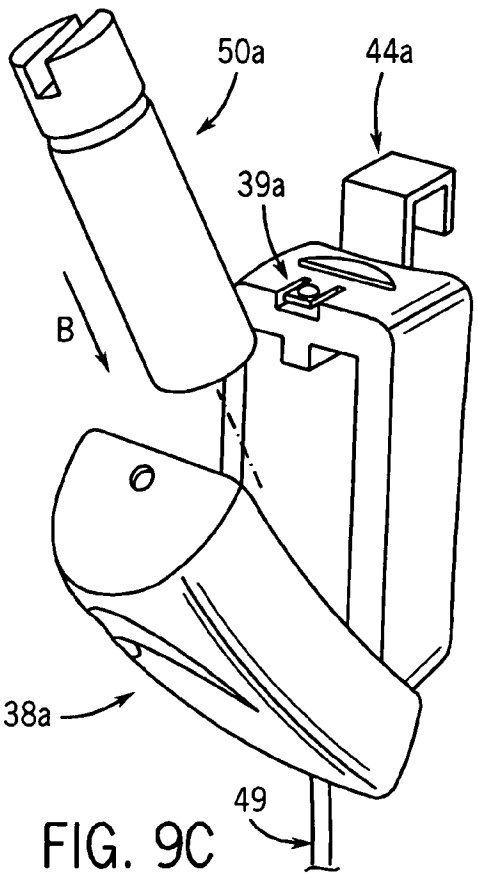
FIG. 9C is a perspective view showing the chemical container being inserted in the container case of the toilet bowl cleaning device of FIG. 9A.
Figure 9B:
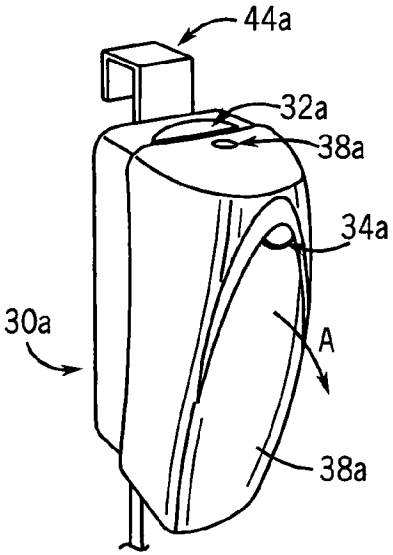
FIG. 9B is a perspective view showing the container case of the toilet bowl cleaning device of FIG. 9A.
Figure 9A:
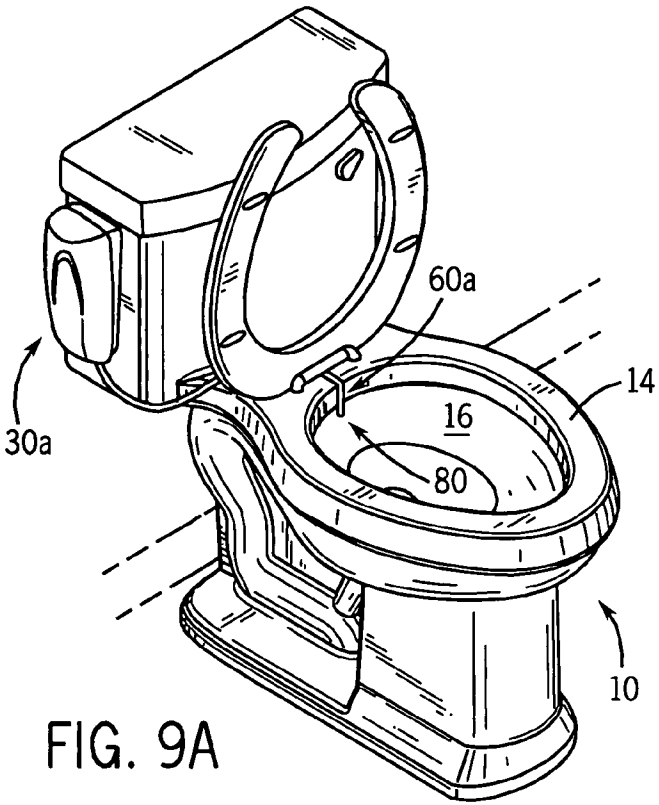
FIG. 9A is a perspective view of a toilet bowl cleaning device according to a ninth embodiment of the invention.

Turning to FIGS. 9A-9C, there is shown another embodiment of the invention. The toilet bowl cleaning and/or deodorizing device includes a container 50*a* for a chemical, a spray nozzle 80 through which the chemical can be sprayed laterally around a perimeter of the nozzle 80, a fluid supply conduit 49 in fluid communication with the container 50*a* and the spray nozzle 80, and a mounting clip 60*a* for attaching the spray nozzle 80 near the rim 14 of the toilet bowl 12 of the toilet 10. The chemical can be sprayed by the spray nozzle 80 directly onto the inner surface 16 of the toilet bowl 12 and/or into the toilet water as described below.

The container 50*a* is housed in a case 30*a*. A fitment is provided in the case 30*a* for engaging an outlet of the container 50*a*. The fitment of the case 30*a* is connected to the fluid supply conduit 49. The case 30*a* includes an access door 38*a* that may be opened by a user as shown in FIG. 9C to remove an empty container 50*a* and thereafter load a new container 50*a* in direction B shown in FIG. 9C. A hinge is provided at the bottom of the door 38*a* for swinging movement of the door 38*a* in direction A of FIG. 9B. A latch 39*a* keeps the door 38*a* shut until a user unlatches the door 38*a*. A use-up cue light emitting diode (LED) 34*a* is provided in the case 30*a*. The LED 34*a* operates as LED 134 described above. The case 30*a* also includes a manual activator button 32*a*. In one version of the invention, the container 50*a* is pressurized and includes a propellant in the container 50*a* and an outlet valve. The manual activator button 32*a* moves the container 50*a* such that the valve of the container 50*a* opens and delivers chemical to the conduit 49. The case 30*a* has an inverted J-shaped hanger 44*a* that extends upwardly from the case 30*a*. The hanger 44*a* of the case 30*a* allows a user to suspend the case 30*a* from a side wall 24 of the toilet tank 22 as shown in FIG. 9A.

Referring now to FIGS. 10A-10E, there is shown another embodiment of the invention. The toilet bowl cleaning and/or deodorizing device includes a container for a chemical, a spray nozzle 80 through which the chemical can be sprayed laterally around a perimeter of the nozzle 80, a fluid supply conduit 49 in fluid communication with the container and the spray nozzle 80, and a mounting clip 60*b* for attaching the spray nozzle 80 near the rim 14 of the toilet bowl 12 of the toilet 10. The chemical can be sprayed by the spray nozzle 80 directly onto the inner surface 16 of the toilet bowl 12 and/or into the toilet water as described below.

The container is housed in a case 30*b*. A fitment is provided in the case 30*b* for engaging an outlet of the container. The fitment of the case 30*b* is connected to the fluid supply conduit 49. The case 30*b* includes a top access door 38*b* that may be opened by a user to remove an empty container and thereafter load a new container. A hinge is provided on the door 38*b* for swinging movement of the door 38*b*. The case 30*b* also includes a well 45*b* and a pair opposed spaced apart protrusions 46*b*. The head of a toilet brush 58*b* may be placed in the well 45*b* and the handle 59*b* of the toilet brush 58*b* may rest between the protrusions 46*b*. The case 30*b* may rest on the floor next to the toilet and conveniently hold the toilet brush 58*b* as shown.

Figure 10C:
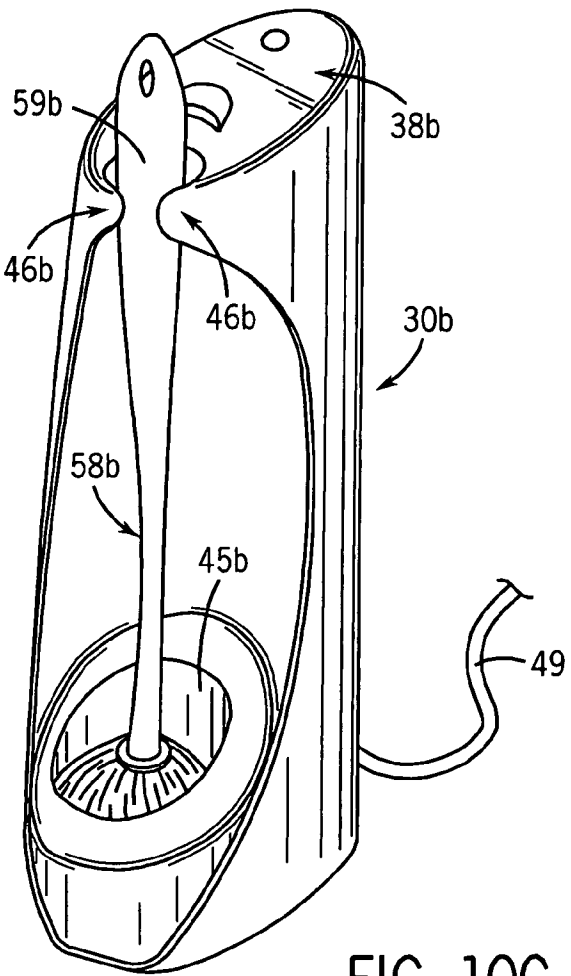
FIG. 10C is a perspective view showing the chemical container case and toilet brush of the toilet bowl cleaning device of FIG. 10A.
Figure 10B:
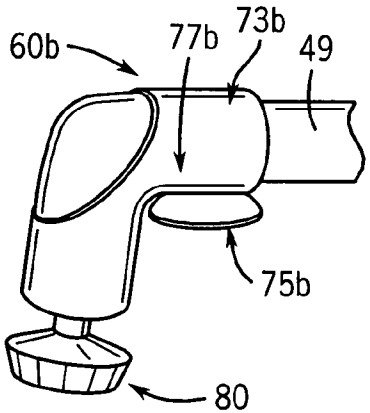
FIG. 10B is a perspective view showing the mounting clip and spray nozzle of the toilet bowl cleaning device of FIG. 10A.
Figure 10A:
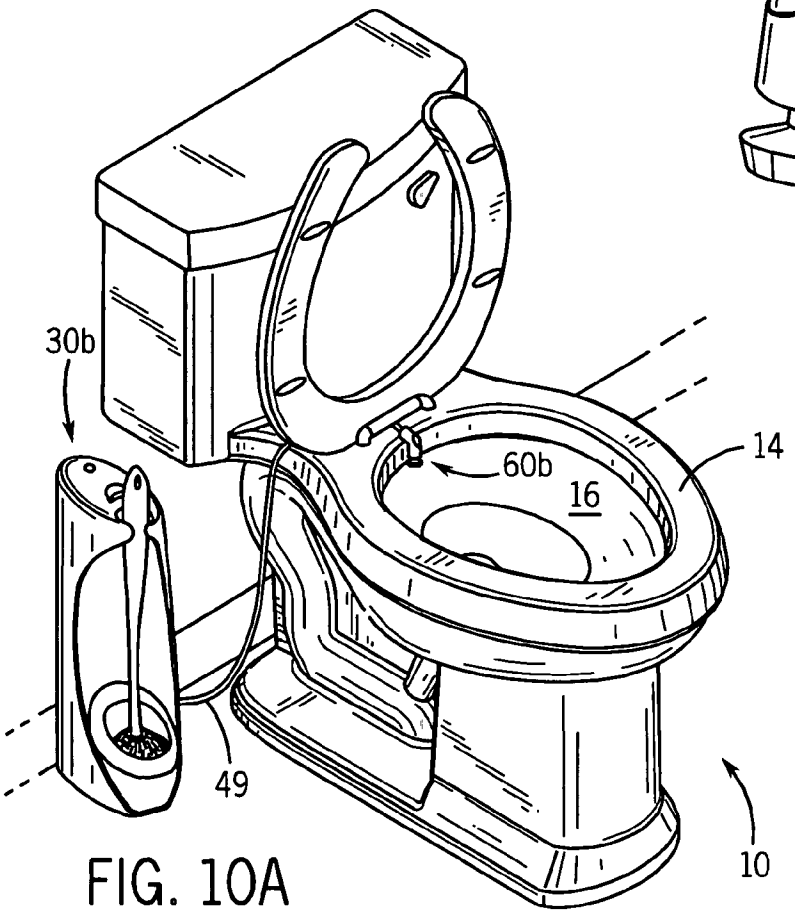
FIG. 10A is a perspective view of a toilet bowl cleaning device according to a tenth embodiment of the invention.

FIG. 10B shows the mounting clip 60*b* for attaching the spray nozzle 80 near the rim 14 of the toilet bowl 12 of the toilet 10. The mounting clip 60*b* has a base wall and a side wall to create an inverted generally L-shaped clip 73*b* that may be adhered to the toilet rim 14 by a suction cup 75*b*. The conduit 49 is connected to a passageway in the L-shaped clip 73*b*. The spray nozzle 80 engages an end of the passageway as shown in FIG. 10B and receives chemical from the passageway.

Turning to FIGS. 11A-11D, there is shown another embodiment of the invention. The toilet bowl cleaning and/or deodorizing device includes a container 50*c* for a chemical, a spray nozzle 80 through which the chemical can be sprayed laterally around a perimeter of the nozzle 80, a fluid supply conduit 49 in fluid communication with the container 50*c* and the spray nozzle 80, and a mounting clip 60*c* for attaching the spray nozzle 80 near the rim 14 of the toilet bowl 12 of the toilet 10. The chemical can be sprayed by the spray nozzle 80 directly onto the inner surface 16 of the toilet bowl 12 and/or into the toilet water as described below.

Figure 11D:
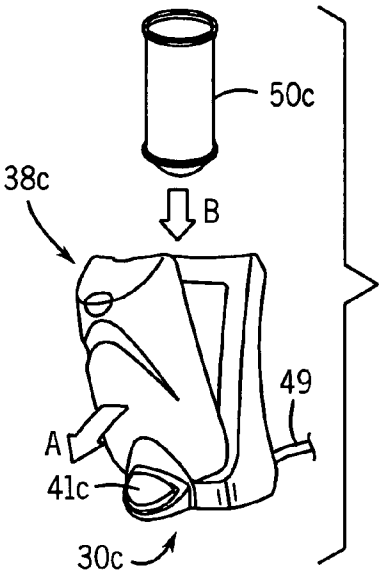
FIG. 11D is a perspective view showing the chemical container being inserted in the container case of the toilet bowl cleaning device of FIG. 11A.
Figure 11C:
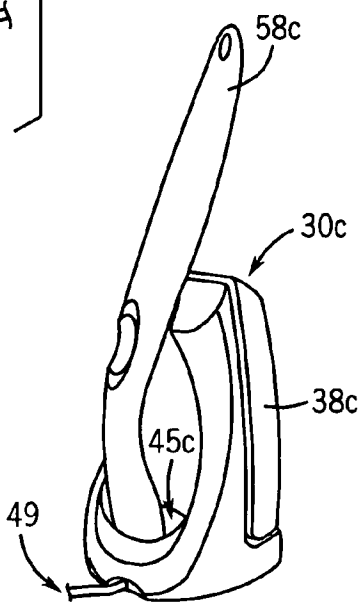
FIG. 11C is a rear perspective view showing the chemical container case and toilet brush of the toilet bowl cleaning device of FIG. 11A.
Figure 11B:
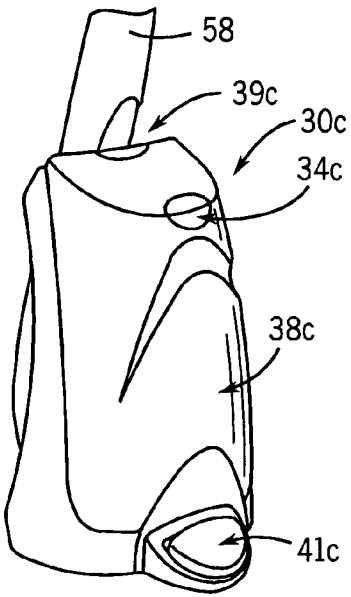
FIG. 11B is a front perspective view showing the chemical container case and toilet brush of the toilet bowl cleaning device of FIG. 11A.
Figure 11A:
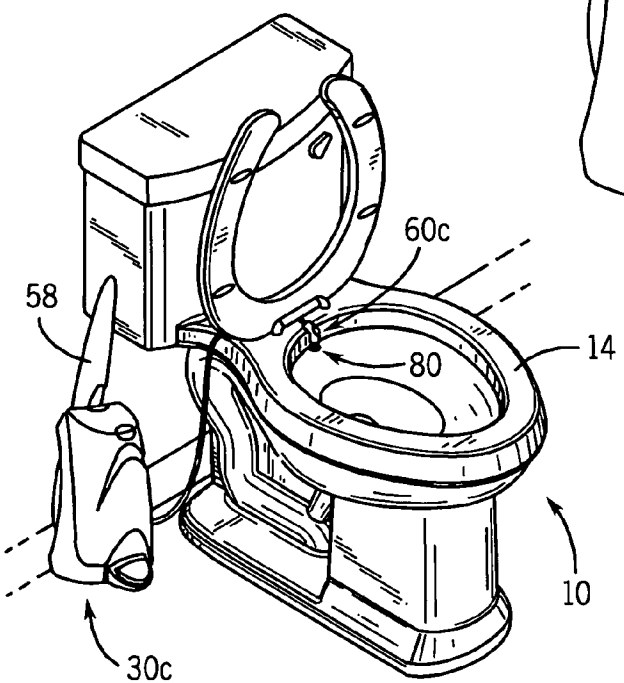
FIG. 11A is a perspective view of a toilet bowl cleaning device according to a eleventh embodiment of the invention.

The container 50*c* is housed in a case 30*c*. A fitment is provided in the case 30*c* for engaging an outlet of the container 50*c*. The fitment of the case 30*c* is connected to the fluid supply conduit 49. The case 30*c* includes an access door 38*c* that may be opened by a user by latch 39*c* to remove an empty container and thereafter load a new container 50*c*. A hinge is provided on the door 38*c* for swinging movement of the door 38*c* in direction A of FIG. 11D. The case 30*c* also includes a rear well 45*c*. The head of a toilet brush 58*c* may be placed in the well 45*c* and the handle of the toilet brush 58*b* may rest against the case 30*c* as shown in FIG. 11C. The case 30*c* may rest on the floor next to the toilet and conveniently hold the toilet brush 58*c* in the back of the case 30*c* as shown.

A use-up cue light emitting diode (LED) 34*c* is provided in the case 30*c*. A pressure sensor senses a pressure drop in the container 50*c* when the container 50*c* is empty and the pressure sensor triggers the LED to emit light and signal that an empty container 50*c* exists. The case 30*c* also includes a manual activator foot pedal 41*c*. In one version of the invention, the container 50*c* is pressurized and includes a propellant in the container 50*c* and an outlet valve. The manual activator foot pedal 41*c* moves the container 50*c* such that the valve of the container 50*c* opens and delivers chemical to the conduit 49.

Figure 12B:
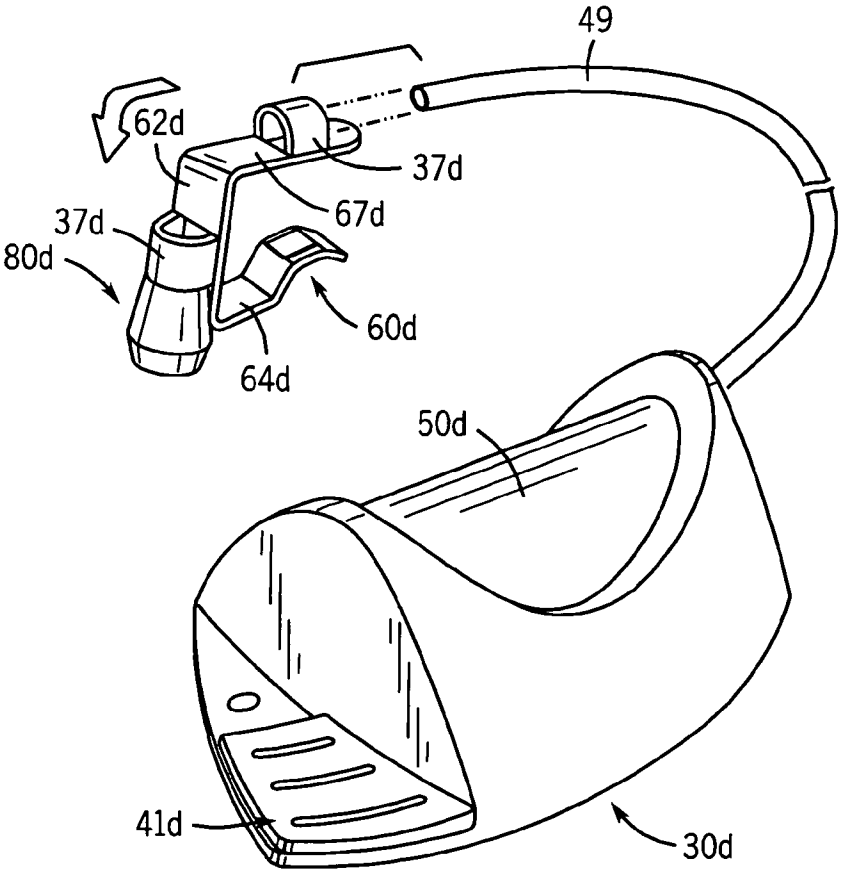
FIG. 12B is an exploded perspective view showing the mounting clip, spray nozzle, cleaner container, and container case of the toilet bowl cleaning device of FIG. 12A.
Figure 12A:
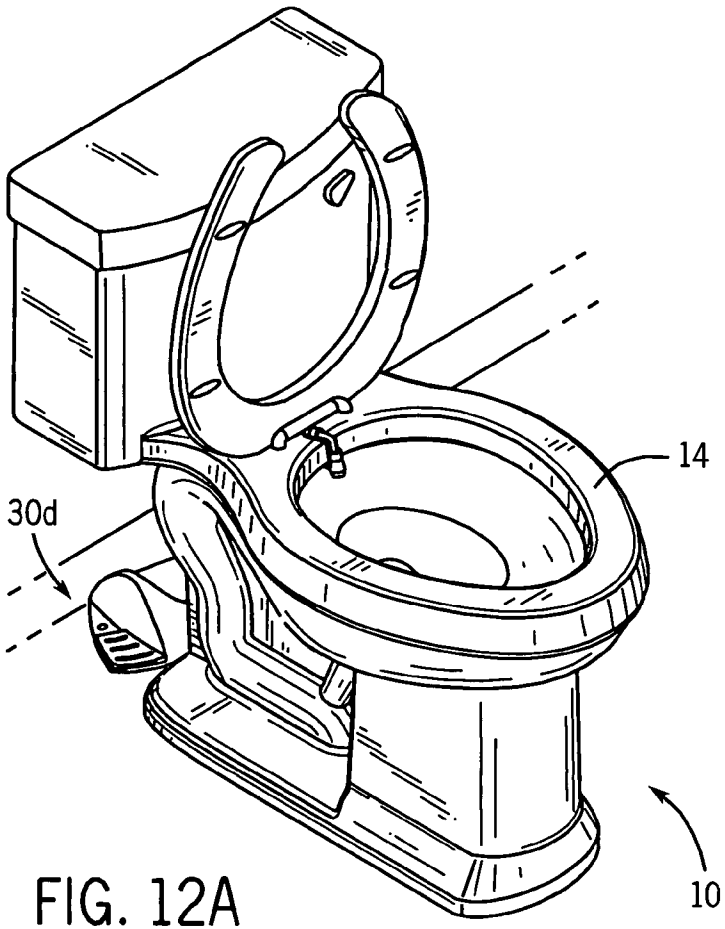
FIG. 12A is a perspective view of a toilet bowl cleaning device according to a twelfth embodiment of the invention.

Referring now to FIGS. 12A-12B, there is shown another embodiment of the invention. The toilet bowl cleaning and/or deodorizing device includes a container 50*d* for a chemical, a spray nozzle 80 through which the chemical can be sprayed laterally around a perimeter of the nozzle 80, a fluid supply conduit 49 in fluid communication with the container 50*d* and the spray nozzle 80, and a mounting clip 60*d* for attaching the spray nozzle 80 near the rim 14 of the toilet bowl 12 of the toilet 10. The chemical can be sprayed by the spray nozzle 80 directly onto the inner surface 16 of the toilet bowl 12 and/or into the toilet water as described below.

The container 50*d* is housed horizontally in a case 30*d*. A fitment is provided in the case 30*d* for engaging an outlet of the container 50*d*. The fitment of the case 30*d* is connected to the fluid supply conduit 49. The container 50*d* may be reloaded from the bottom or back of the case 30*d*. The case 30*d* may rest on the floor behind the toilet as shown in FIG. 12A. The case 30*d* includes a manual activator foot pedal 41*d*. In one version of the invention, the container 50*d* is pressurized and includes a propellant in the container 50*d* and an outlet valve. The manual activator foot pedal 41*d* moves the container 50*d* such that the valve of the container 50*d* opens and delivers chemical to the conduit 49. FIG. 12B shows that the container 50*d* may mounted horizontally in the case 30*d*. This demonstrates another mounting orientation in addition to the upside down (valve at the bottom) orientation of FIG. 1C, and the right side up (valve at the top) orientation of FIG. 2D. Thus, the invention does not limit orientation of the container.

FIG. 12B shows the mounting clip 60*d* for attaching the spray nozzle 80*d* near the rim 14 of the toilet bowl 12 of the toilet 10. The mounting clip 60*d* has a base wall 62*d*, a first side wall 64*d*, and a second side wall 67*d* spaced from the first side wall 64*d* to create a generally C-shaped clip 60*d*. The clip 60*d* is formed from a flexible plastic to allow for expansion and contraction to accommodate various toilet bowl rim sizes. The second side wall 67*d* rests on the top of the toilet rim 14 when installed. The conduit 49 is threaded through a retaining ring 37*d* on the second side wall 67*d* and through a retaining ring 37*d* on the base wall 62*d*. The spray nozzle 80*d* engages an end of the conduit 49 as shown in FIG. 12B and receives chemical from the conduit 49.

Turning to FIGS. 13A-13D, there is shown another embodiment of the invention. The toilet bowl cleaning and/or deodorizing device includes a container 50*e* for a chemical, a spray nozzle 80 through which the chemical can be sprayed laterally around a perimeter of the nozzle 80, a fluid supply conduit 49 in fluid communication with the container 50*e* and the spray nozzle 80, and a mounting clip 60*e* for attaching the spray nozzle 80 near the rim 14 of the toilet bowl 12 of the toilet 10. The chemical can be sprayed by the spray nozzle 80 directly onto the inner surface 16 of the toilet bowl 12 and/or into the toilet water as described below.

The container 50*e* is housed in a case 30*e*. A fitment is provided in the case 30*e* for engaging an outlet of the container 50*e*. The fitment of the case 30*e* is connected to the fluid supply conduit 49. The case 30*e* includes a top access door 38*e* that may be opened by a user as shown in FIG. 13D to remove an empty container 50*e* and thereafter load from the top a new container 50*e* in direction B shown in FIG. 13D. A hinge is provided at the side of the door 38*e* for swinging movement of the door 38*e*. A use-up cue light emitting diode (LED) 34*e* is provided in the case 30*e*. The LED 34*e* operates as LED 134 described above. The case 30*e* has an inverted J-shaped hanger 44*e* that extends from the case 30*e*. The hanger 44*e* of the case 30*e* allows a user to suspend the case 30*e* from a side wall 24 inside of the toilet tank 22 as shown in FIG. 13D to reduce visibility and conserve water. The case 30*e* also includes a manual activator 41*e* at a lower area of the hanger 44*e* of the case 30*e*. The manual activator 41*e* opens the valve of the container 50*e* and delivers chemical to the conduit 49.

Figure 13B:
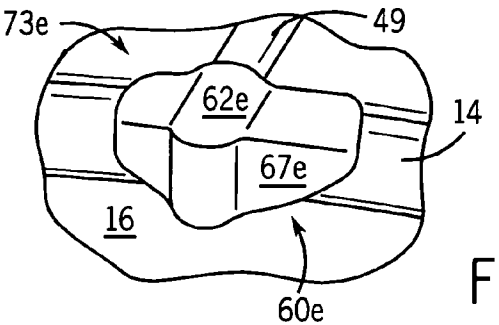
FIG. 13B is a perspective view showing the mounting clip and spray nozzle of the toilet bowl cleaning device of FIG. 13A.
Figure 13E:
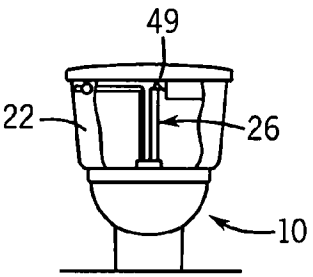
FIG. 13E is a front cutaway view of a toilet bowl cleaning device according to a thirteenth embodiment of the invention having the fluid delivery conduit inserted in the overflow tube of the toilet.
Figure 13C:
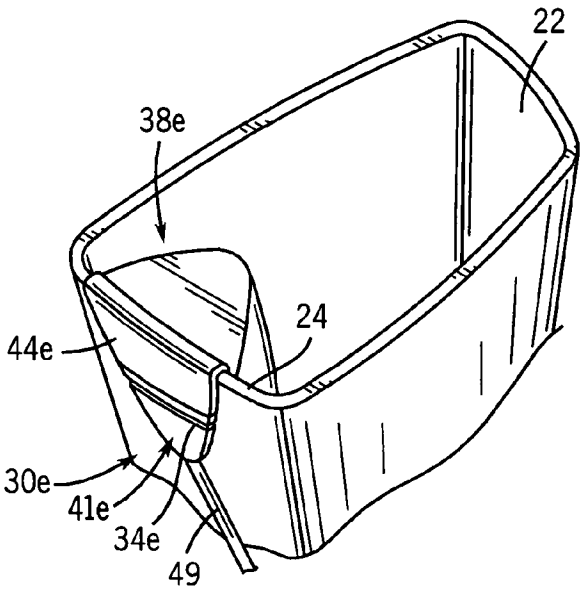
FIG. 13C is a top perspective view showing the chemical container case of the toilet bowl cleaning device of FIG. 13A suspended in the toilet tank.
Figure 13D:
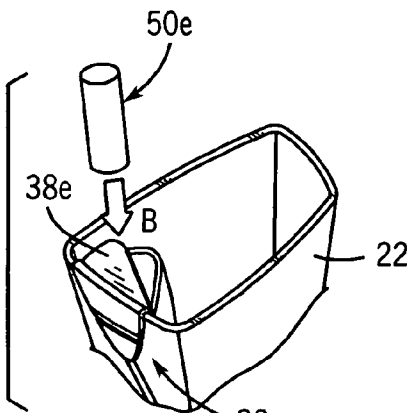
FIG. 13D is a top perspective view showing the chemical container being inserted in the container case of the toilet bowl cleaning device of FIG. 13A.
Figure 13A:
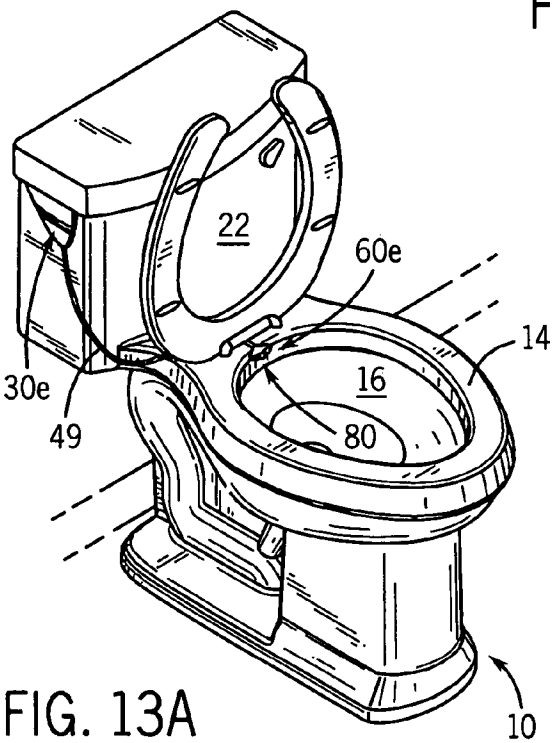
FIG. 13A is a perspective view of a toilet bowl cleaning device according to a thirteenth embodiment of the invention.

FIG. 13B shows the mounting clip 60*e* for attaching the spray nozzle 80 near the rim 14 of the toilet bowl 12 of the toilet 10. The mounting clip 60*e* has a top wall 62*e* and a side wall 67*e* to create an inverted generally L-shaped bracket 73*e* that may be adhered to the toilet rim 14 by a double sided adhesive strip or a suction cup. The conduit 49 is connected to a passageway in the L-shaped bracket 73*e*. The spray nozzle 80 engages an end of the passageway and receives chemical from the passageway. Looking at FIG. 13E, there is shown an alternative version of the invention where the conduit 49 travels down the over-flow tube 26 inside the tank 22 of the toilet 10 to deliver chemical into the flush water.

Referring now to FIGS. 14A-14D, there is shown another embodiment of the invention. The toilet bowl cleaning and/or deodorizing device includes a container 50*f* for a chemical, a spray nozzle 97*f* disposed in the toilet lid 20 through which the chemical can be sprayed laterally around a perimeter of the nozzle 97*f*, and a fluid supply conduit 49 in fluid communication with the container 50*f* and the spray nozzle 97*f*. The chemical can be sprayed by the spray nozzle 97*f* directly onto the inner surface 16 of the toilet bowl 12 and/or into the toilet water as described below.

Figures 14A, 14B, 14C, 14D:
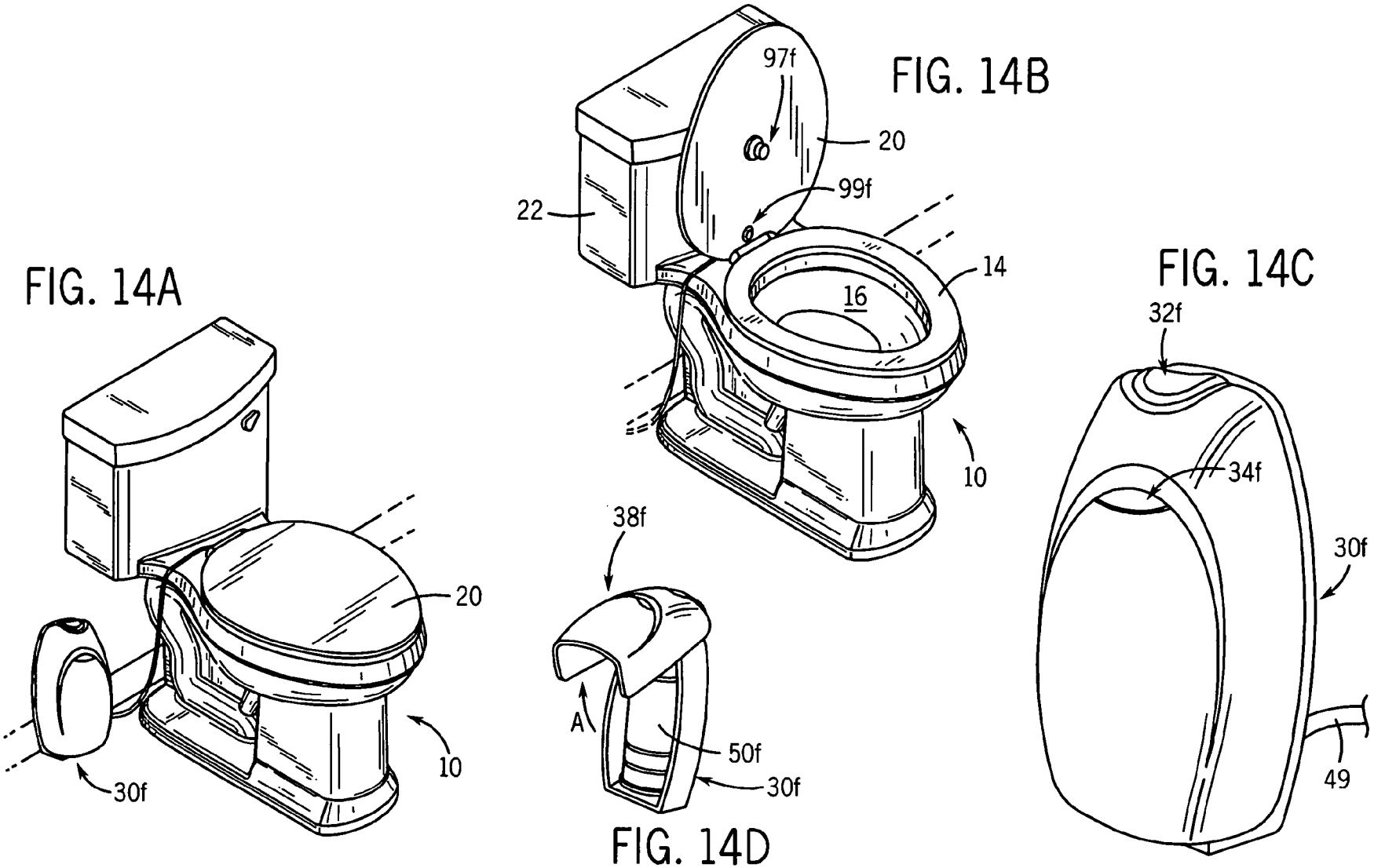
FIG. 14A is a perspective view of a toilet bowl cleaning device according to a fourteenth embodiment of the invention.
FIG. 14B is a perspective view showing the under-the-lid spray nozzle of the toilet bowl cleaning device of FIG. 14A.
FIG. 14C is a perspective view showing the chemical container case of the toilet bowl cleaning device of FIG. 14A.
FIG. 14D is a perspective view showing the chemical container inserted in the container case of the toilet bowl cleaning device of FIG. 14A.

The container 50*f* is housed in a case 30*f*. A fitment is provided in the case 30*f* for engaging an outlet of the container 50*f*. The fitment of the case 30*f* is connected to the fluid supply conduit 49. The case 30*f* includes an access door 38*f* that may be opened by a user in direction A as shown in FIG. 14D to remove an empty container 50*f* and thereafter load a new container 50*f*. A hinge is provided at the top of the door 38*f* for swinging movement of the door 38*f*. A use-up cue light emitting diode (LED) 34*f* is provided in the case 30*f*. The LED 34*f* operates as LED 134 described above.

The case 30*f* also includes a manual activator button 32*f*. In one version of the invention, the container 50*f* is pressurized and includes a propellant in the container 50*f* and an outlet valve. The manual activator button 32*f* moves the valve into an open position for delivering chemical from the container 50*f* through the conduit 49 and to the spray nozzle 97*f*. For example, the activator button 32*f* pushes the container 50*f* downward such that the valve at the bottom of the container 50*f* opens.

Looking at FIG. 14B, the spray nozzle 97*f* is integrated into the toilet lid 20 for spraying the chemical laterally around a perimeter of the nozzle 97*f*. The toilet lid also includes a pressure sensor or proximity sensor 99*f* to sense when the lid 20 is down. The toilet bowl cleaning and/or deodorizing device only operates when the lid 20 is closed as sensed by the pressure sensor or proximity sensor 99*f*. A control circuit for operation of the pressure sensor or proximity sensor 99*f* is described below.

Figure 15C:
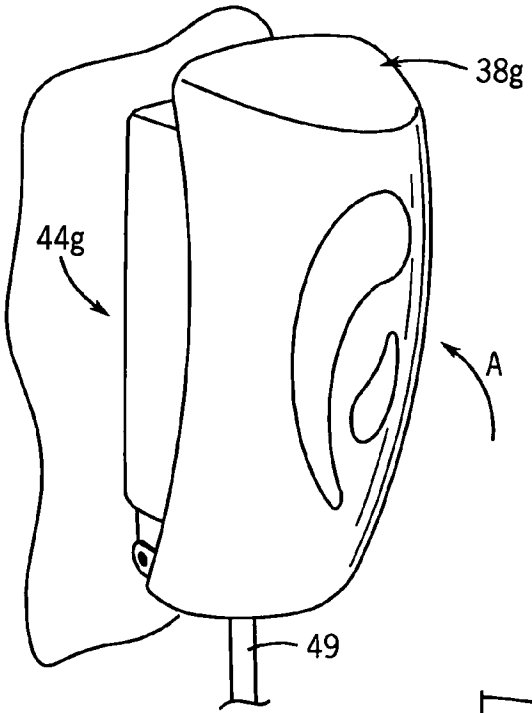
FIG. 15C is a perspective view showing the chemical container case of the toilet bowl cleaning device of FIG. 15A.
Figure 15B:
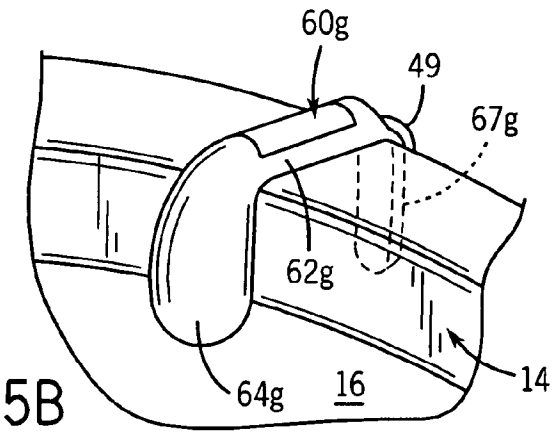
FIG. 15B is a perspective view showing the mounting clip and spray nozzle of the toilet bowl cleaning device of FIG. 15A.
Figure 15A:
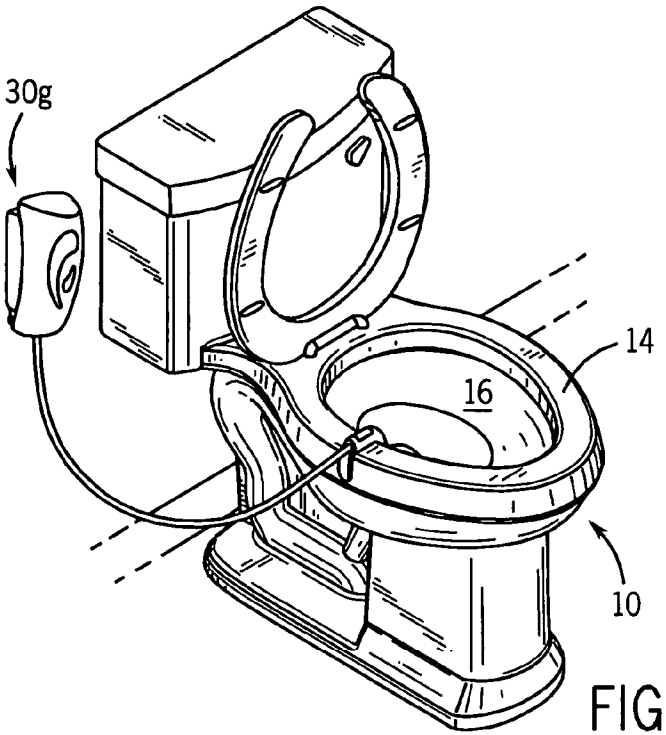
FIG. 15A is a perspective view of a toilet bowl cleaning device according to a fifteenth embodiment of the invention.

Turning to FIGS. 15A-15C, there is shown another embodiment of the invention. The toilet bowl cleaning and/or deodorizing device includes a container for a chemical, a spray nozzle through which the chemical can be sprayed laterally around a perimeter of the nozzle, a fluid supply conduit 49 in fluid communication with the container and the spray nozzle, and a mounting clip 60*g* for attaching the spray nozzle near the rim 14 of the toilet bowl 12 of the toilet 10. The chemical can be sprayed by the spray nozzle directly onto the inner surface 16 of the toilet bowl 12 and/or into the toilet water as described below.

The container is housed in a case 30*g*. The case 30*g* may be a translucent housing so the user can see when the container is empty. The translucent housing may also provide a use-up cue. A pressure sensor senses a pressure drop in the container when the container is empty and the pressure sensor triggers a light within the translucent housing. The housing then glows to signal that an empty container exists.

A fitment is provided in the case 30*g* for engaging an outlet of the container. The fitment of the case 30*g* is connected to the fluid supply conduit 49. The case 30*g* acts as a manual activator button. In one version of the invention, the container is pressurized and includes a propellant in the container and an outlet valve. The case 30*g* acts as a manual activator button by the user pressing the case 30*g* in direction A to move the valve into an open position for delivering chemical from the container through the conduit 49 and to the spray nozzle. For example, the case 30*g* pushes the container sideways such that a tilt valve at the bottom of the container opens. An adhesive strip 44*g* is provided at the rear of the case 30*g* for mounting the case 30*g* on a wall as shown in FIG. 15C, or on the toilet tank.

FIG. 15B shows the mounting clip 60*g* for attaching the spray nozzle near the rim 14 of the toilet bowl 12 of the toilet 10. The mounting clip 60*g* has a base wall 62*g*, a first side wall 64*g*, and a second side wall 67*g* spaced from the first side wall 64*g* to create an inverted generally U-shaped clip 60*g*. The clip 60*g* is formed from a flexible plastic to allow for expansion and contraction to accommodate various toilet bowl rim sizes. The conduit 49 is connected to a passageway in the base wall 62*g* and the first side wall 64*g*. The spray nozzle engages an end of the conduit 49 and receives chemical from the conduit 49.

Figure 16C:
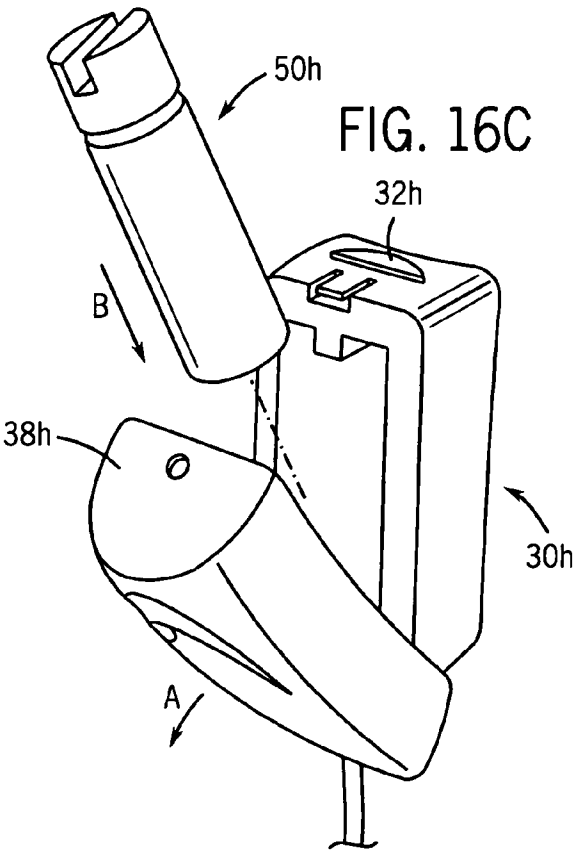
FIG. 16C is a perspective view showing the chemical container being inserted in the container case of the toilet bowl cleaning device of FIG. 16A.
Figure 16B:
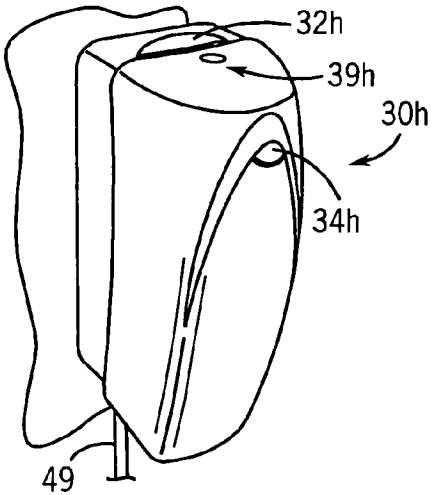
FIG. 16B is a perspective view showing the chemical container case of the toilet bowl cleaning device of FIG. 16A attached to a wall.
Figure 16A:
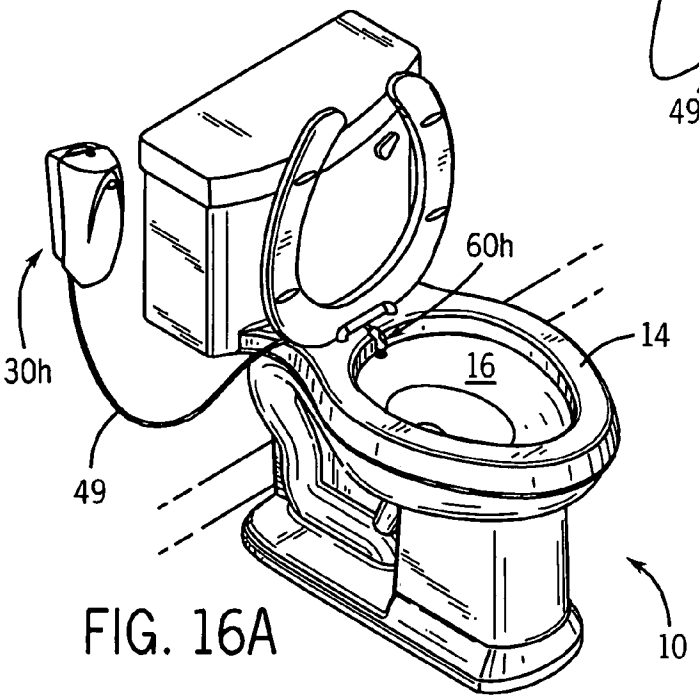
FIG. 16A is a perspective view of a toilet bowl cleaning device according to a sixteenth embodiment of the invention.

Referring now to FIGS. 16A-16C, there is shown another embodiment of the invention. The toilet bowl cleaning and/or deodorizing device includes a container 50*h* for a chemical, a spray nozzle 80 through which the chemical can be sprayed laterally around a perimeter of the nozzle 80, a fluid supply conduit 49 in fluid communication with the container 50*h* and the spray nozzle 80, and a mounting clip 60*h* for attaching the spray nozzle 80 near the rim 14 of the toilet bowl 12 of the toilet 10. The chemical can be sprayed by the spray nozzle 80 directly onto the inner surface 16 of the toilet bowl 12 and/or into the toilet water as described below.

The container 50*h* is housed in a case 30*h*. A fitment is provided in the case 30*h* for engaging an outlet of the container 50*h*. The fitment of the case 30*h* is connected to the fluid supply conduit 49. The case 30*h* includes an access door 38*h* that may be opened by a user as shown in FIG. 16C to remove an empty container 50*h* and thereafter load a new container 50*h* in direction B shown in FIG. 16C. A hinge is provided at the bottom of the door 38*h* for swinging movement of the door 38*h* in direction A of FIG. 16C. A cover release button 39*h* keeps the door 38*h* shut until a user unlatches the door 38*h*. A use-up cue light emitting diode (LED) 34*h* is provided in the case 30*h*. The LED 34*h* operates as LED 134 described above. The case 30*h* also includes a manual activator button 32*h*. In one version of the invention, the container 50*h* is pressurized and includes a propellant in the container 50*h* and an outlet valve. The manual activator button 32*h* moves the container 50*h* downward such that the valve at the bottom of the container 50*h* opens and delivers chemical to the conduit 49. An adhesive strip is provided at the rear of the case 30*h* for mounting the case 30*h* on a wall as shown in FIG. 16A or on the toilet tank.

Turning to FIGS. 17A-17E, there is shown another embodiment of the invention. The toilet bowl cleaning and/or deodorizing device includes a container 50*i* for a chemical, a spray nozzle 80 through which the chemical can be sprayed laterally around a perimeter of the nozzle 80, a fluid supply conduit 49 in fluid communication with the container 50*i* and the spray nozzle 80, and a mounting clip 60*i* for attaching the spray nozzle 80 near the rim 14 of the toilet bowl 12 of the toilet 10. The chemical can be sprayed by the spray nozzle 80 directly onto the inner surface 16 of the toilet bowl 12 and/or into the toilet water as described below.

Figure 17C:
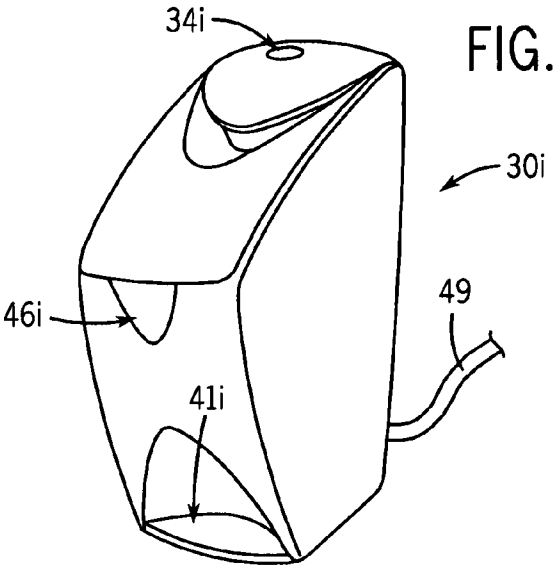
FIG. 17C is a perspective view showing the chemical container case of the toilet bowl cleaning device of FIG. 17A.
Figure 17E:
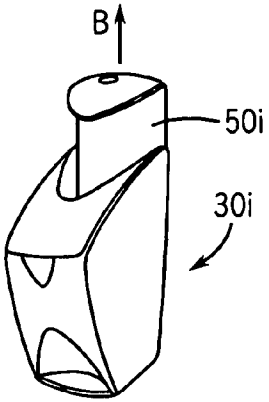
FIG. 17E is a perspective view showing the chemical container being inserted in the container case of the toilet bowl cleaning device of FIG. 17A.
Figure 17B:
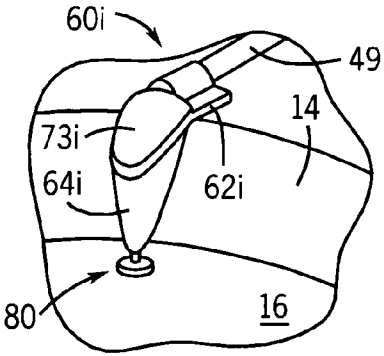
FIG. 17B is a perspective view showing the mounting clip and spray nozzle of the toilet bowl cleaning device of FIG. 17A.

FIG. 17B shows the mounting clip 60*i* for attaching the spray nozzle 80 near the rim 14 of the toilet bowl 12 of the toilet 10. The mounting clip 60*i* has a base wall 62*i* and a side wall 64*i* to create an inverted generally L-shaped bracket 73*i* that may be adhered to the toilet rim 14 by an adhesive or a suction cup. The conduit 49 is connected to a passageway in the base wall 62*i* and the side wall 64*i*. The spray nozzle 80 engages an end of the passageway and receives chemical from the passageway.

The container 50*i* is housed in a case 30*i*. A fitment is provided in the case 30*i* for engaging an outlet of the container 50*i*. The fitment of the case 30*i* is connected to the fluid supply conduit 49. The case 30*i* includes an access door that may be opened by a user to remove an empty container 50*i* in direction B as shown in FIG. 17E and thereafter load a new container 50*i*. A use-up cue light emitting diode (LED) 34*i* is provided in the case 30*i*. A pressure sensor senses a pressure drop in the container 50*i* when the container 50*i* is empty and the pressure sensor triggers the LED to emit light and signal that an empty container 50*i* exists.

Figure 17D:
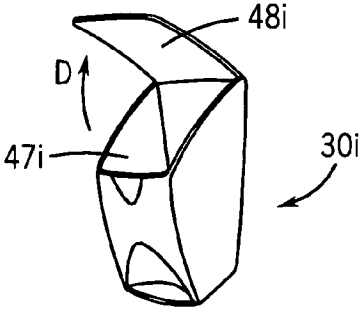
FIG. 17D is a perspective view showing the waste bin of the container case of the toilet bowl cleaning device of FIG. 17A.
Figure 17A:
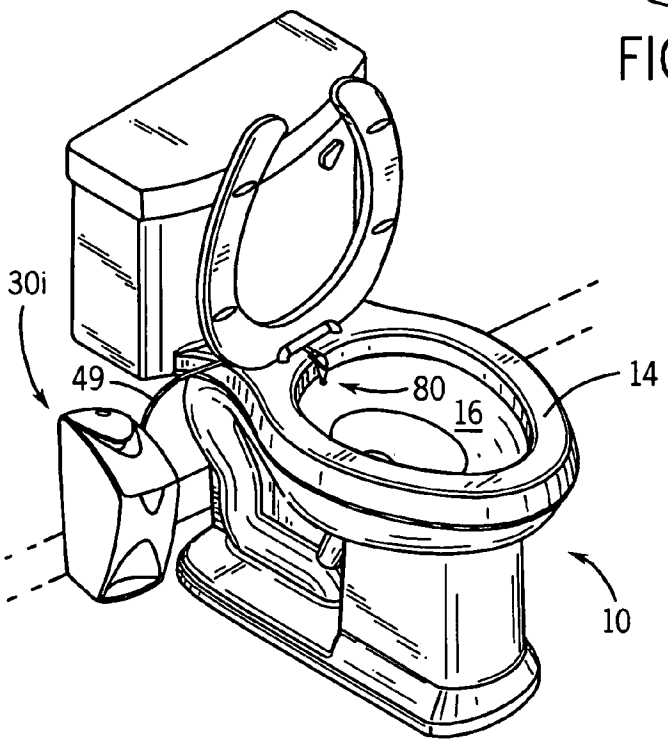
FIG. 17A is a perspective view of a toilet bowl cleaning device according to a seventeenth embodiment of the invention.

The case 30*i* also includes a storage bin section 47*i* covered by a storage bin lid 48*i* that opens in direction D as shown in FIG. 17D to access the storage bin section 47*i*. A recess 46*i* in the case 30*i* provides an area for a user's hand to open the lid 48*i*. The case 30*i* also includes a manual activator foot pedal 41*i*. In one version of the invention, the container 50*i* is pressurized and includes a propellant in the container 50*i* and an outlet valve. The manual activator foot pedal 41*i* moves the container 50*i* downward such that the valve at the bottom of the container 50*i* opens and delivers chemical to the conduit 49. The case 30*i* sits next to the toilet 10 and provides storage for garbage, toilet tissue or sanitary products.

Referring now to FIGS. 18A-18D, there is shown another embodiment of the invention. The toilet bowl cleaning and/or deodorizing device includes a container 50*j* for a chemical, a spray nozzle 80 through which the chemical can be sprayed laterally around a perimeter of the nozzle 80, a fluid supply conduit 49 in fluid communication with the container 50*j* and the spray nozzle 80, and a mounting clip 60*j* for attaching the spray nozzle 80 near the rim 14 of the toilet bowl 12 of the toilet 10. The chemical can be sprayed by the spray nozzle 80 directly onto the inner surface 16 of the toilet bowl 12 and/or into the toilet water as described below.

Figure 18D:
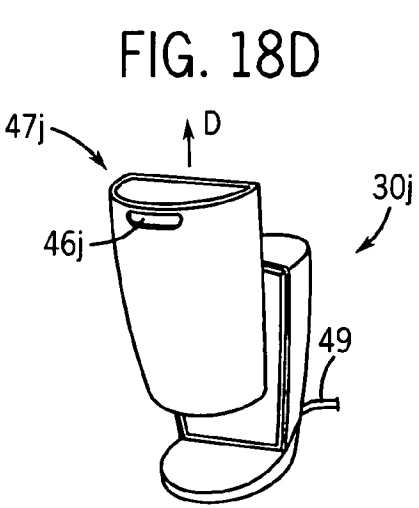
FIG. 18D is a perspective view showing the removable waste bin of the container case of the toilet bowl cleaning device of FIG. 18A.
Figure 18C:
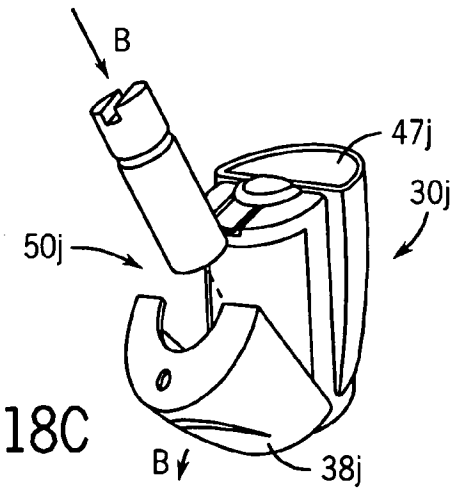
FIG. 18C is a perspective view showing the chemical container being inserted in the container case of the toilet bowl cleaning device of FIG. 18A.
Figure 18B:
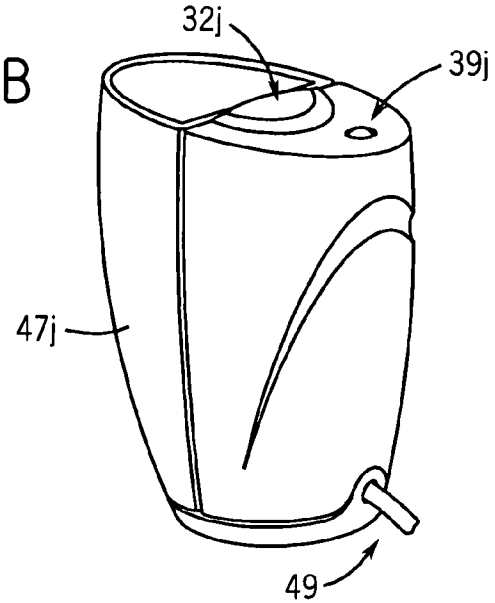
FIG. 18B is a perspective view showing the chemical container case of the toilet bowl cleaning device of FIG. 18A.
Figure 18A:
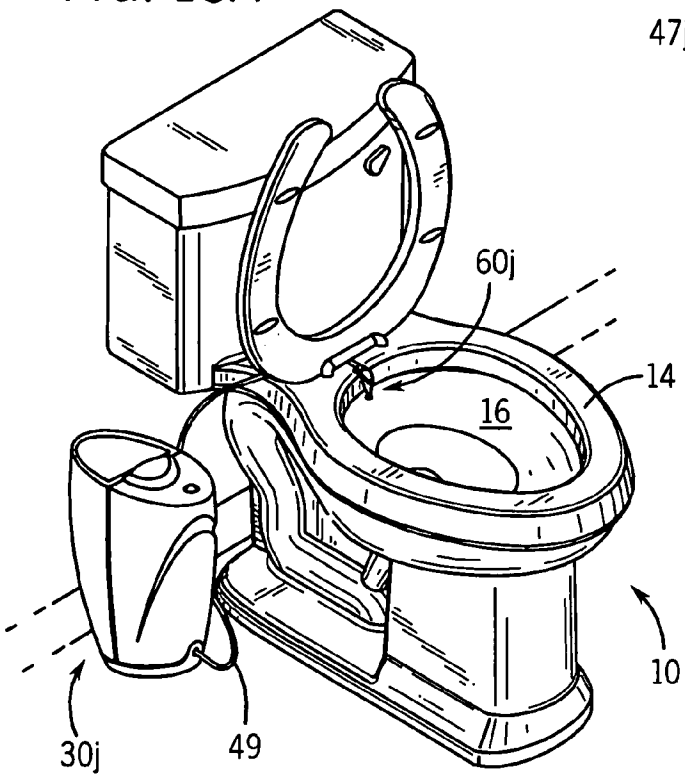
FIG. 18A is a perspective view of a toilet bowl cleaning device according to a eighteenth embodiment of the invention.

The container 50*j* is housed in a case 30*j*. A fitment is provided in the case 30*j* for engaging an outlet of the container 50*j*. The fitment of the case 30*j* is connected to the fluid supply conduit 49. The case 30*j* includes an access door 38*j* that may be opened by a user to remove an empty container 50*j* and thereafter load a new container 50*j* and batteries (if provided) in direction B as shown in FIG. 18*c*. A door latch button 39*j* keeps the door 38*j* shut until a user unlatches the door 38*j*. The case 30*j* also includes a removable storage bin 47*j*. A recess 46*j* in the storage bin 47*j* provides an area for a user's hand to lift the storage bin 47*j* in direction D shown in FIG. 18D.

The case 30*j* also includes a manual activator button 32*j*. In one version of the invention, the container 50*j* is pressurized and includes a propellant in the container 50*j* and an outlet valve. The manual activator button 32*j* moves the container 50*j* downward such that the valve at the bottom of the container 50*j* opens and delivers chemical to the conduit 49. The case 30*j* sits next to the toilet 10 and provides storage for garbage.

Figure 19C:
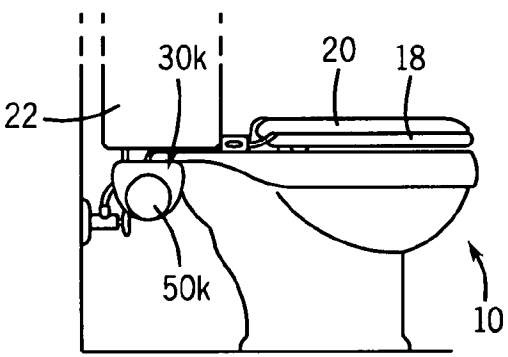
FIG. 19C is a side view showing the chemical container case of the toilet bowl cleaning device of FIG. 19A mounted on a toilet.
Figure 19B:
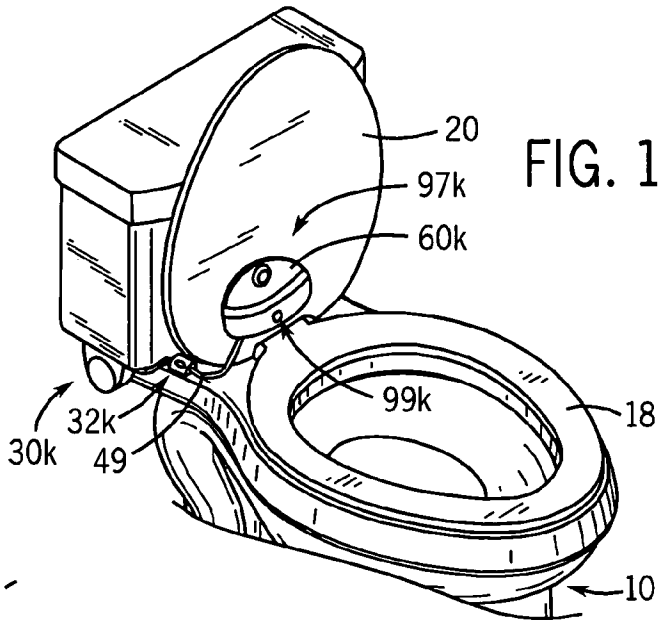
FIG. 19B is a perspective view showing the mounting base and spray nozzle of the toilet bowl cleaning device of FIG. 19A.
Figure 19A:
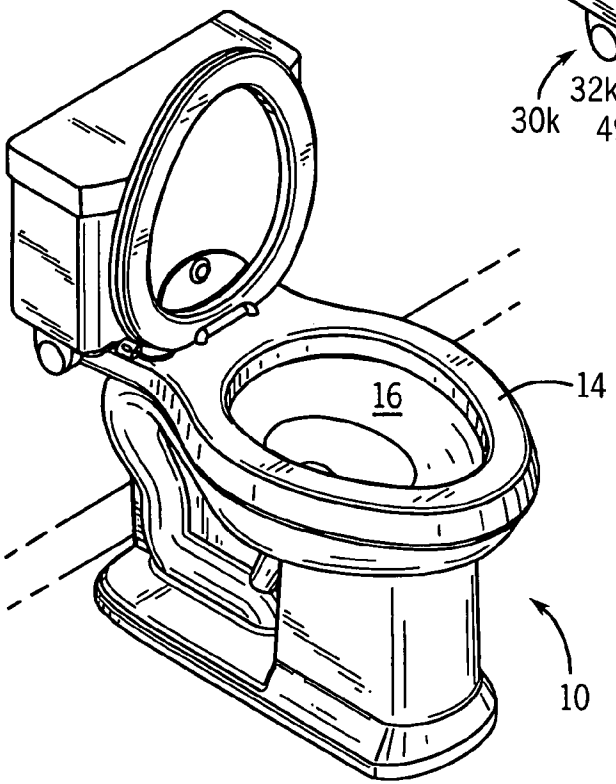
FIG. 19A is a perspective view of a toilet bowl cleaning device according to a nineteenth embodiment of the invention.

Turning to FIGS. 19A-19C, there is shown another embodiment of the invention. The toilet bowl cleaning and/or deodorizing device includes a container 50*k* for a chemical, a spray nozzle 97*k* through which the chemical can be sprayed laterally around a perimeter of the nozzle 97*k*, a fluid supply conduit 49 in fluid communication with the container 50*k* and the spray nozzle 97*k*, and a mounting pad 60*k* for attaching the spray nozzle 97*k* to the lid 20 of the toilet 10. The chemical can be sprayed by the spray nozzle 97*k* directly onto the inner surface 16 of the toilet bowl 12 and/or into the toilet water as described below.

The container 50*k* is housed in a case 30*k*. The case 30*k* hooks on the back of the toilet 10 under the tank 22 as shown in FIG. 19C. A fitment is provided in the case 30*k* for engaging an outlet of the container. The fitment of the case 30*k* is connected to the fluid supply conduit 49. The container 50*k* may be pressurized and include a propellant in the container and an outlet valve. An activator button 32*k* opens the valve such that the container 50*k* delivers chemical from the container through the conduit 49 and to the spray nozzle 97*k*.

Looking at FIG. 19B, the spray nozzle 97*k* is mounted to the toilet lid 20 by a mounting pad 60*k* for spraying the chemical laterally around a perimeter of the nozzle 97*k*. The mounting pad 60*k* also includes a pressure sensor or proximity sensor 99*k* to sense when the lid 20 is down. The toilet bowl cleaning and/or deodorizing device only operates when the lid 20 is closed as sensed by the pressure sensor or proximity sensor 99*k*.

Referring now to FIGS. 20A-20B, there is shown another embodiment of the invention. The toilet bowl cleaning and/or deodorizing device includes a container for a chemical, a spray nozzle 80 through which the chemical can be sprayed laterally around a perimeter of the nozzle 80, a fluid supply conduit 49 in fluid communication with the container and the spray nozzle 80, and a mounting clip 60*m* for attaching the spray nozzle 80 near the rim 14 of the toilet bowl 12 of the toilet 10. The chemical can be sprayed by the spray nozzle 80 directly onto the inner surface 16 of the toilet bowl 12 and/or into the toilet water as described below. The toilet bowl cleaning and/or deodorizing device also includes a valve assembly 73*m* with a proximity sensor 98*m* to detect the presence of a person. When a person is not present (as detected by the proximity sensor 98*m*), a valve in the valve assembly 73*m* is in an open position such that chemical may be delivered to the spray nozzle 80. When a person is present (as detected by the proximity sensor 98*m*), the valve in the valve assembly 73*m* is in a closed position such that chemical cannot be delivered to the spray nozzle 80. A control circuit for operation of the pressure sensor or proximity sensor 98*m* is described below.

Figure 21B:
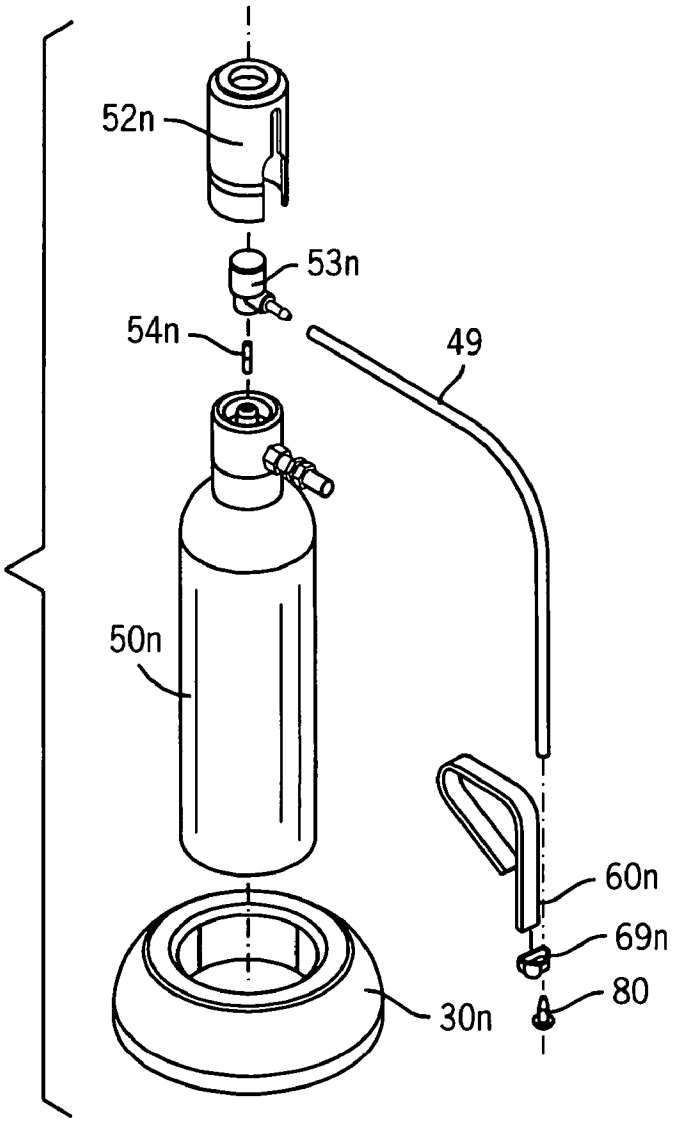
FIG. 21B is an exploded perspective view of the toilet bowl cleaning device of FIG. 21A.
Figure 21A:
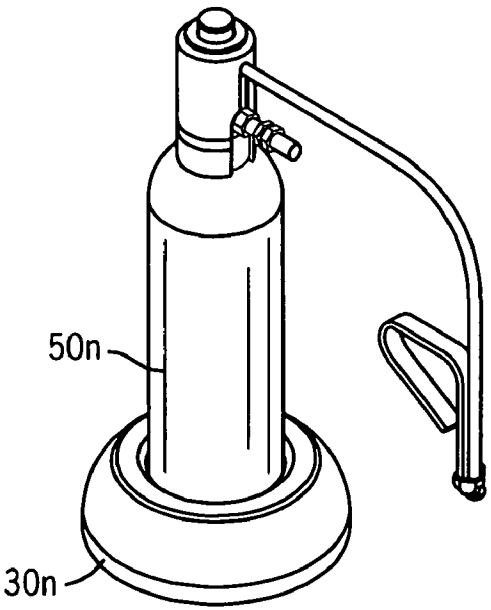
FIG. 21A is a perspective view of the container base, container, fluid conduit, mounting clip, and spray nozzle of a toilet bowl cleaning device according to a twenty-first embodiment of the invention.

Turning to FIGS. 21A-21B, there is shown another embodiment of the invention. The toilet bowl cleaning and/or deodorizing device includes a container 50*n* for a chemical, a spray nozzle 80 through which the chemical can be sprayed laterally around a perimeter of the nozzle 80, a fluid supply conduit 49 in fluid communication with the container 50*n* and the spray nozzle 80, and a mounting clip 60*n* for attaching the spray nozzle 80 near the rim of the toilet bowl. An annular base 30*n* is provided for holding the container 50*n*. A connector 69*n* attaches the conduit 49 to the clip 60*n*. The chemical can be sprayed by the spray nozzle 80 directly onto the inner surface of the toilet bowl and/or into the toilet water as described below.

A spigot 54*n* is fluid communication with the container 50*n* and an actuator button 53*n* which is in fluid communication with the conduit 49. An actuator cap 52*n* surrounds the actuator button 53*n*. The container 50*n* is pressurized and includes a propellant in the container 50*n* and an outlet valve. The actuator button 53*n* moves the valve downward into an open position for delivering chemical from the container 50*n* through the conduit 49 and to the spray nozzle 80. Output pressures of 30-35 psi from the valve are some non-limiting examples of suitable pressures.

A variation of the device of FIGS. 21A-21B can provide another toilet bowl cleaning and/or deodorizing device that is manually activated. For example, the outside diameter of the end of the conduit 49 that is opposite the spray nozzle 80 may be properly sized such that the end may be inserted into an orifice of an actuator button of a pressurized container. The user then activates the device by pressing the actuator button downward (or laterally) into an open position for delivering chemical from the container through the conduit and to the spray nozzle 80 to dispense cleaning solution into the toilet. In this device, the fluid supply conduit 49, the spray nozzle 80, and the mounting clip 60*n* for attaching the spray nozzle 80 near the rim of the toilet bowl may be conveniently provided as a kit for connection to separately available pressurized containers including cleaning and/or deodorizing chemical.

Thus, the nozzle, conduit and mounting clip can be disconnected from the container and thrown away, and a new kit can be installed. This can be important to consumers if they feel the nozzle gets soiled, or they do not like to keep the nozzle in their toilet for a long time.

Referring now to FIGS. 22A-22K, there is shown another embodiment of the invention. The toilet bowl cleaning and/or deodorizing device includes a container 50*p* for a chemical, a spray nozzle through which the chemical can be sprayed laterally around a perimeter of the nozzle, a fluid supply conduit 49*p* in fluid communication with the container 50*p* and the spray nozzle, and a mounting clip for attaching the spray nozzle near the rim of the toilet bowl of the toilet. The chemical can be sprayed by the spray nozzle directly onto the inner surface of the toilet bowl and/or into the toilet water as described below.

Figure 22A:
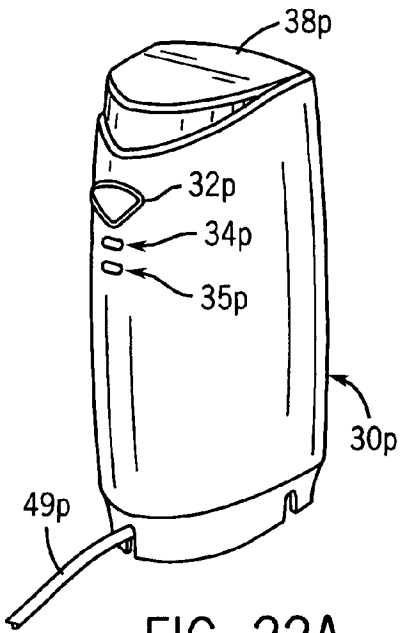
FIG. 22A is a right perspective view of the container case and fluid conduit of a toilet bowl cleaning device according to a twenty-second embodiment of the invention.
Figure 22B:
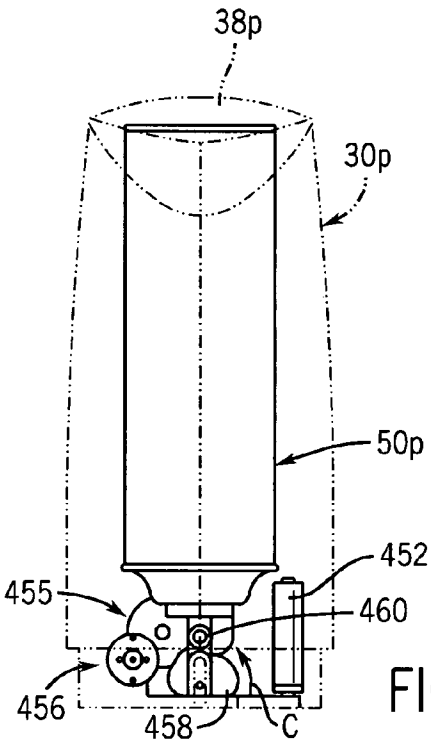
FIG. 22B is a front view showing the internal container and fluid delivery means of the toilet bowl cleaning device of FIG. 22A.
Figure 22D:
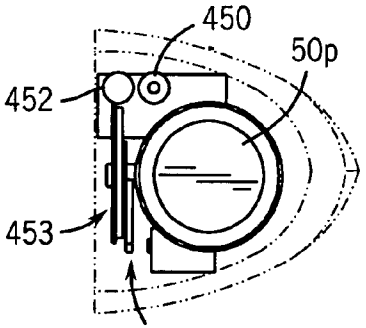
FIG. 22D is a top view showing the internal container and fluid delivery means of the toilet bowl cleaning device of FIG. 22A.
Figure 22C:
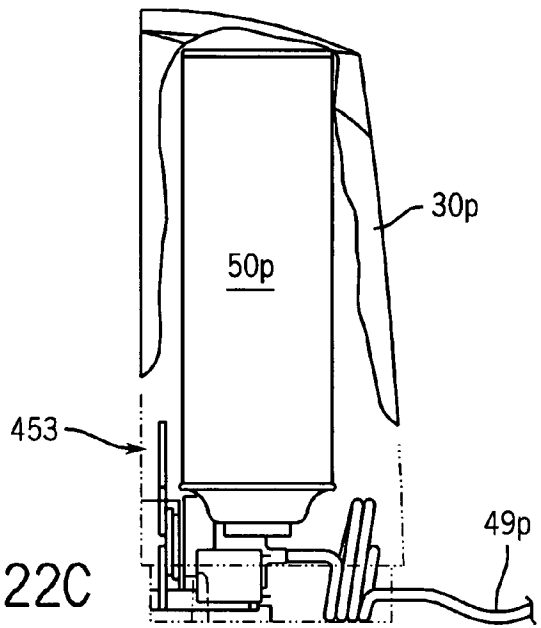
FIG. 22C is a right side view showing the internal container and fluid delivery means of the toilet bowl cleaning device of FIG. 22A.
Figure 22F:
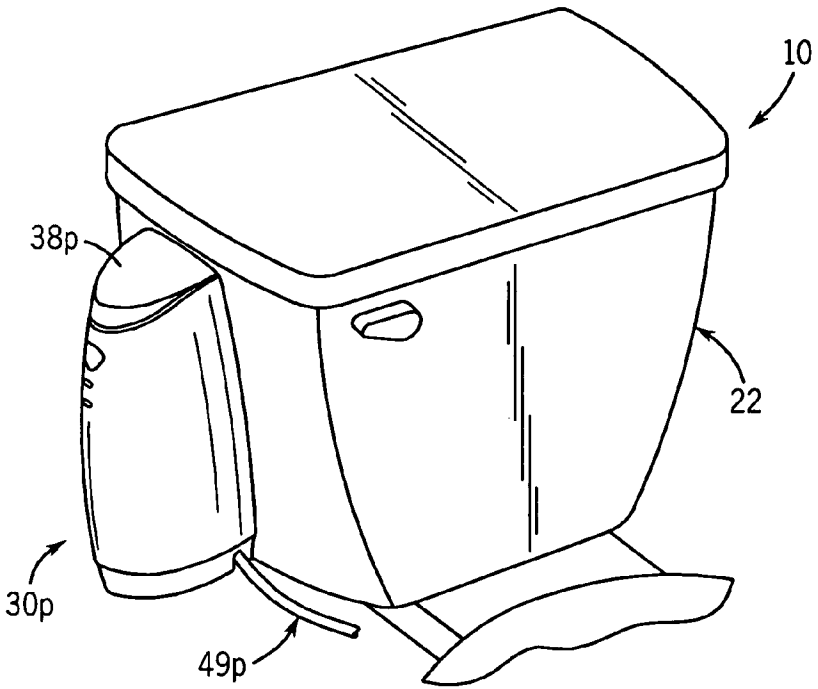
FIG. 22F is a perspective view showing the toilet bowl cleaning device of FIG. 22A mounted on the side wall of a toilet tank.
Figure 22E:
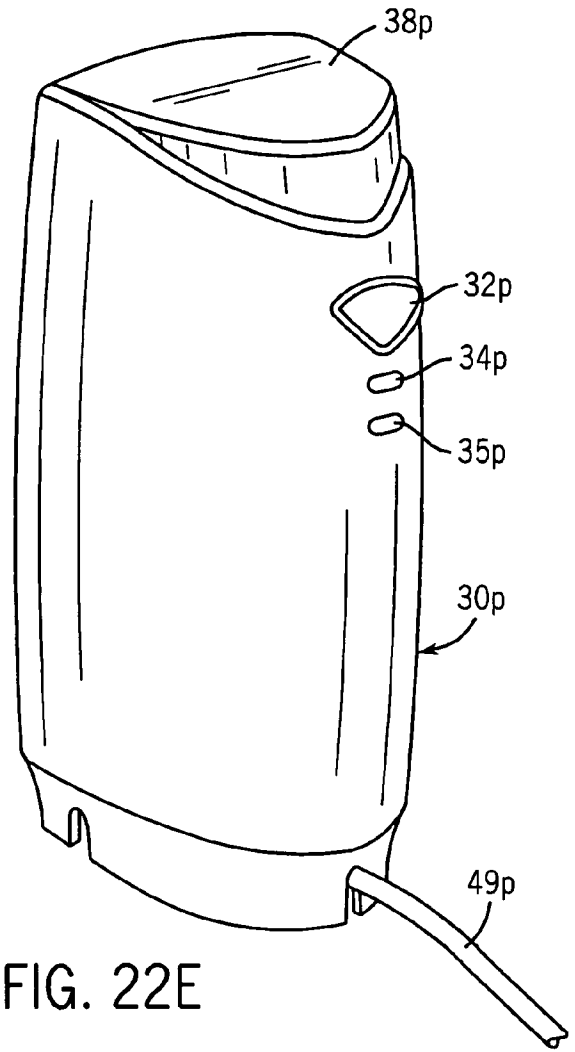
FIG. 22E is a left perspective view showing the container case and fluid conduit of the toilet bowl cleaning device of FIG. 22A.
Figure 22H:
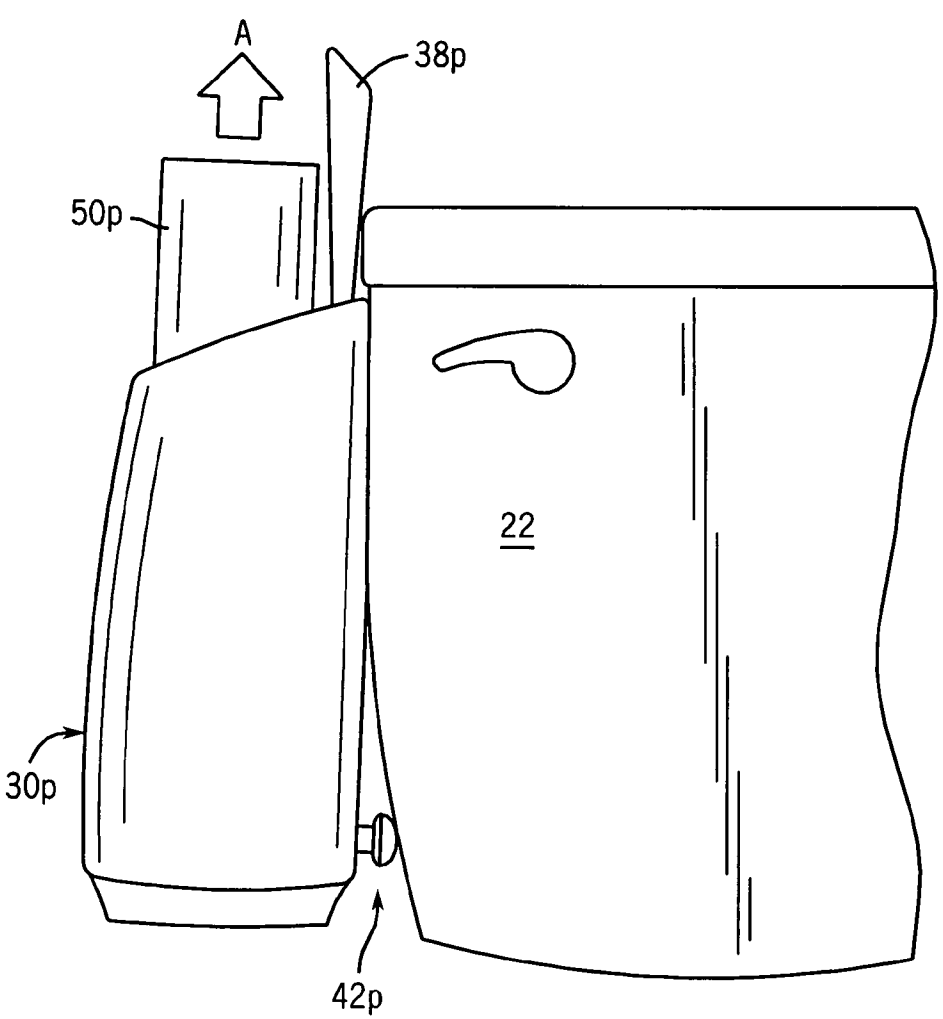
FIG. 22H is a side view showing the toilet bowl cleaning device of FIG. 22A mounted on the side wall of a toilet tank.
Figure 22G:
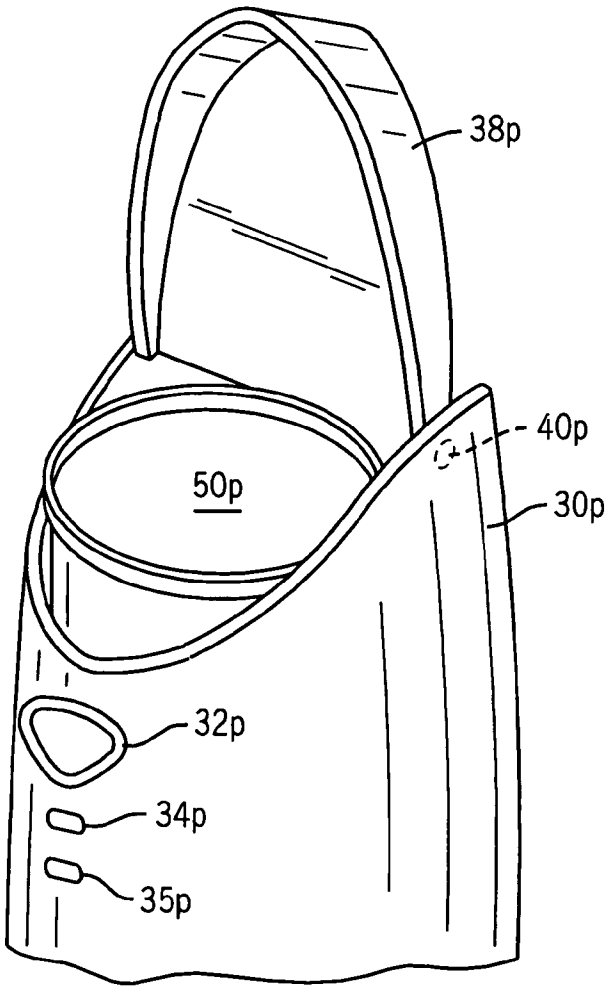
FIG. 22G is a right perspective view showing the container case and container access door of the toilet bowl cleaning device of FIG. 22A.

The container 50*p* is housed in a case 30*p*. A fitment is provided in the case 30*p* for engaging an outlet of the container 50*p*. The fitment of the case 30*p* is connected to the fluid supply conduit 49*p*. The case 30*p* includes a top access door 38*p* that may be opened by a user as shown in FIGS. 22G and 22H to remove an empty container 50*p* in direction A shown in FIG. 22H and thereafter load a new container 50*p*. A hinge 40*p* is provided at the side of the door 38*p* for swinging movement of the door 38*p*. A use-up cue light emitting diode (LED) 34*p* is provided in the case 30*p*. The LED 34*p* operates as LED 134 described above. The case 30*p* also includes a battery use-up cue light 35*p* that signals a low voltage on the batteries 450 and 452. The case 30*p* also includes a manual activator switch 32*p*. The base of the container 30*p* provides extra space for storage of extra conduit 49*p* as shown by the coiled conduit 49*p* in FIG. 22C. This allows a user to shorten the portion of the conduit 49*p* that is exposed to a user's view.

In one version of the invention of FIGS. 22A-22K, the container 50*p* is pressurized and includes a propellant in the container 50*p* and an outlet valve 460. The manual activator switch 32*p* completes a circuit that provides power from the batteries 450, 452 to a motor that drives a set of meshing gears 453, 454, 455, 456. The gears rotate a cam 458 in circular direction C of FIG. 22B such that the cam 458 moves the valve 460 of the container 50*p* to open the valve 460 and deliver chemical to the conduit 49*p*.

Figure 22J:
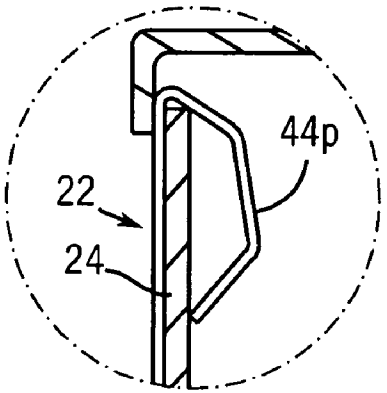
FIG. 22J is a side detailed view showing the hanger of the toilet bowl cleaning device of FIG. 22A as mounted on a toilet tank.
Figure 22K:
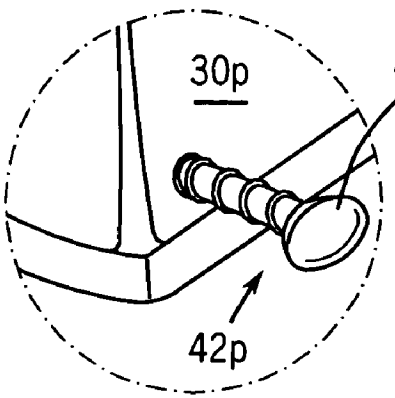
FIG. 22K is a perspective detailed view showing one case leveling set screw of the toilet bowl cleaning device of FIG. 22A.
Figure 22I:
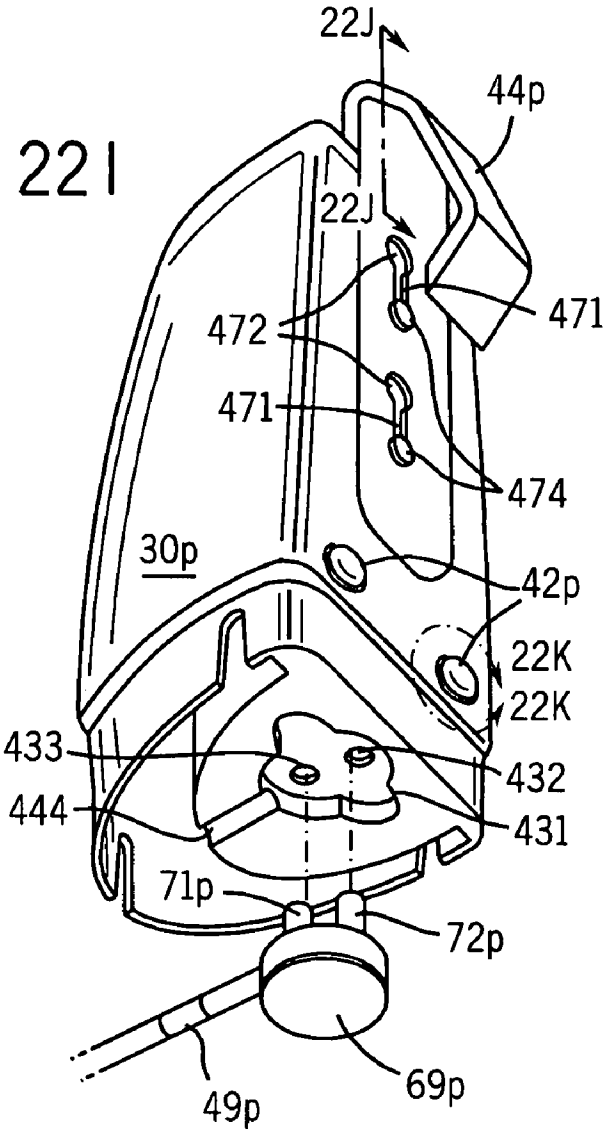
FIG. 22I is a rear perspective view showing the container case and hanger of the toilet bowl cleaning device of FIG. 22A.

The case 30*p* has an inverted generally J-shaped hanger 44*p* that extends upwardly from the case 30*p* as shown in FIGS. 221 and 22J. The hanger 44*p* of the case 30*p* allows a user to suspend the case 30*p* from a side wall 24 of the toilet tank 22 as shown in FIGS. 22F and 22J. Looking at FIG. 22I, the hanger 44*p* has a pair of oblong slots 471 with an enlarged hole 472 at one end. Pins 474 are mounted on the case 30*p*. The pins 474 include a shank having a width that is slightly less than the width of the slots 471 and a head having a diameter that is slightly less than the diameter of the holes 472. The hanger 44*p* may be attached to the case 30*p* by inserting the head of the pins 474 into the holes 472 and pulling the hanger 44*p* upward such that the shanks of the pins 474 move into the bottom of the slots 471 as shown in FIG. 22I. In this manner, the toilet bowl cleaning and/or deodorizing device of FIGS. 22A-22K may be mounted on the toilet tank 22 using the hanger 44*p*, or the hanger 44*p* may be removed for placing the case 30*p* on the floor. The case 30*p* may also include leveling set screws 42*p* that may be screwed in or out to vary the distance between the set screw head 43*p* and the case 30*p*. As shown in FIG. 22H, the leveling set screws 42*p* may be set such that the leveling set screws 42*p* contact the toilet tank 22 and keep the case 30*p* level with respect to the floor on which the toilet is installed.

The conduit 49*p* is connected to the case 30*p* with a connector 69*p* as shown in FIG. 22I. The connector 69*p* includes a chemical orifice 71*p* that is in fluid communication with the fitment and the container 50*p* for delivering chemical from the container 50*p* and into the conduit 49*p*. The connector 69*p* also includes an electrical connector 72*p* that places a control circuit of the device in electrical communication with a proximity sensor near the toilet. This feature will be described below with reference to FIGS. 24A-24E. The connector 69*p* is press fit into a recess 431 in the bottom of the case 30*p*. A first hole 432 of the recess 431 receives the electrical connector 72*p*, and a second hole 433 of the recess 431 receives the chemical orifice 71*p*.

Turning now to FIGS. 23A-23K, there is shown another embodiment of the invention. The toilet bowl cleaning and/or deodorizing device includes a container 50*q* for a chemical, a spray nozzle through which the chemical can be sprayed laterally around a perimeter of the nozzle, a fluid supply conduit 49*q* in fluid communication with the container 50*q* and the spray nozzle, and a mounting clip for attaching the spray nozzle near the rim of the toilet bowl of the toilet. The chemical can be sprayed by the spray nozzle directly onto the inner surface of the toilet bowl and/or into the toilet water as described below.

The container 50*q* is mounted upside down (i.e., outlet valve down) in a base 30*q*. A fitment is provided in the base 30*q* for engaging an outlet of the container 50*q*. The fitment of the base 30*q* is connected to the fluid supply conduit 49*q*. A user may remove an empty container 50*q* in direction A shown in FIG. 23H and thereafter load a new container 50*q*. A use-up cue light emitting diode (LED) 34*q* is provided in the base 30*q* (see FIG. 23E). The LED 34*q* operates as LED 134 described above. The base 30*q* also includes a battery use-up cue light 35*q* that signals a low voltage on the batteries 450 and 452. The case 30*q* also includes a manual activator switch 32*q*.

In one version of the invention of FIGS. 23A-23K, the container 50*q* is pressurized and includes a propellant in the container 50*q* and an outlet valve 460. The manual activator switch 32*q* completes a circuit that provides power from the batteries 450, 452 to a motor that drives a set of meshing gears 453, 454, 455, 456. The gears rotate a cam 458 in circular direction C of FIG. 23B such that the cam 458 moves the valve 460 of the container 50*q* to open the valve 460 and deliver chemical to the conduit 49*q*.

Figure 23A:
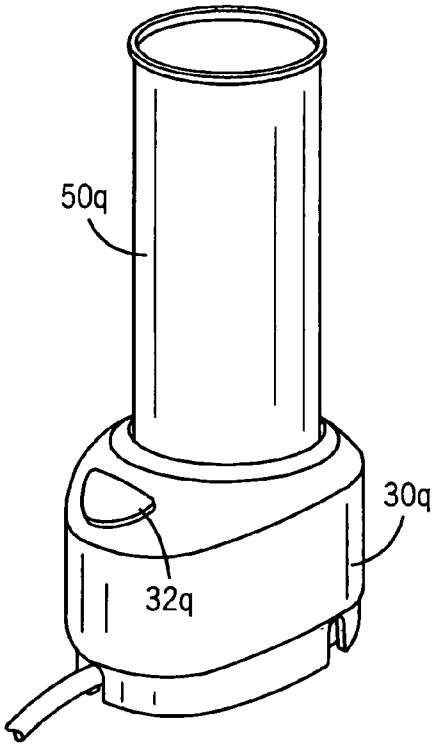
FIG. 23A is a right perspective view of the container case and fluid conduit of a toilet bowl cleaning device according to a twenty-third embodiment of the invention.
Figure 23B:
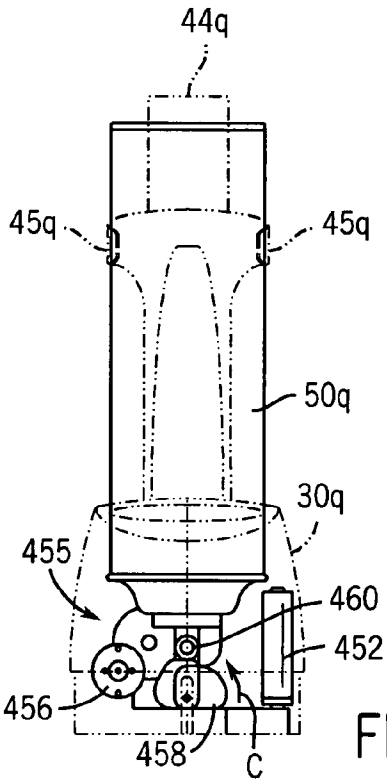
FIG. 23B is a front view showing the internal container and fluid delivery means of the toilet bowl cleaning device of FIG. 23A.
Figure 23D:
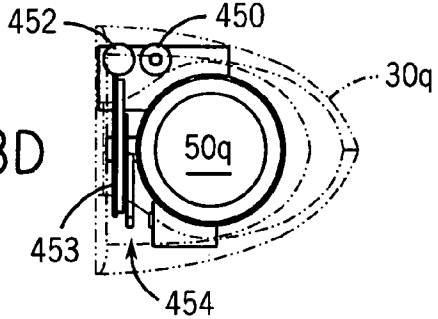
FIG. 23D is a top view showing the internal container and fluid delivery means of the toilet bowl cleaning device of FIG. 23A.
Figure 23C:
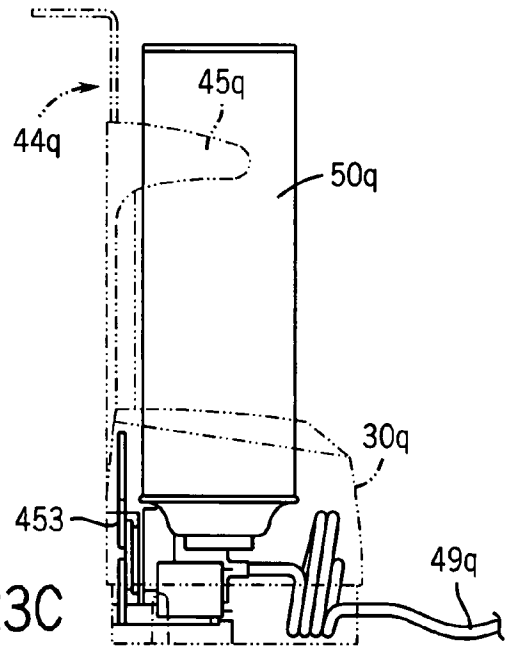
FIG. 23C is a right side view showing the internal container and fluid delivery means of the toilet bowl cleaning device of FIG. 23A.
Figure 23F:
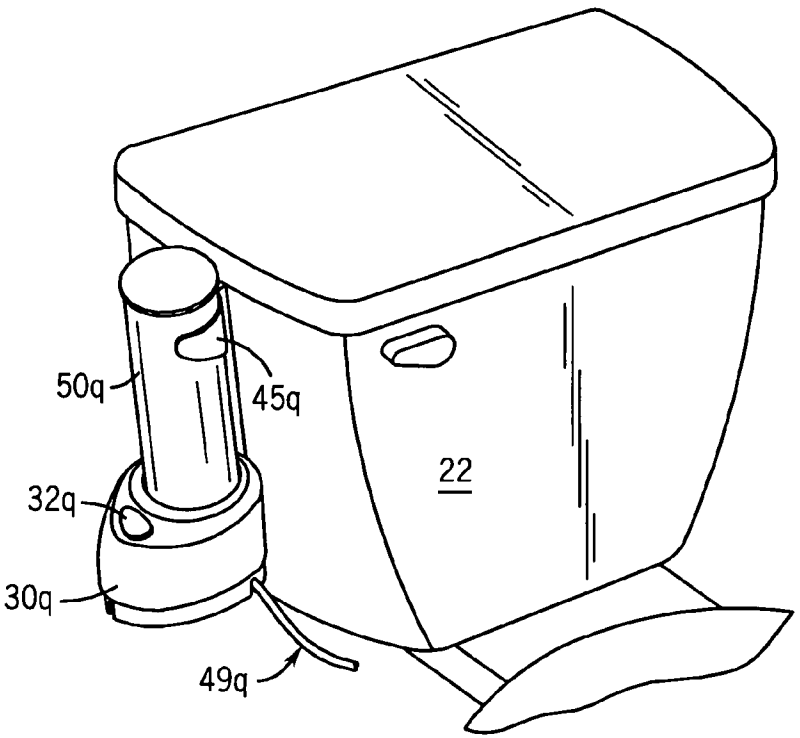
FIG. 23F is a perspective view showing the toilet bowl cleaning device of FIG. 23A mounted on the side wall of a toilet tank.
Figure 23E:
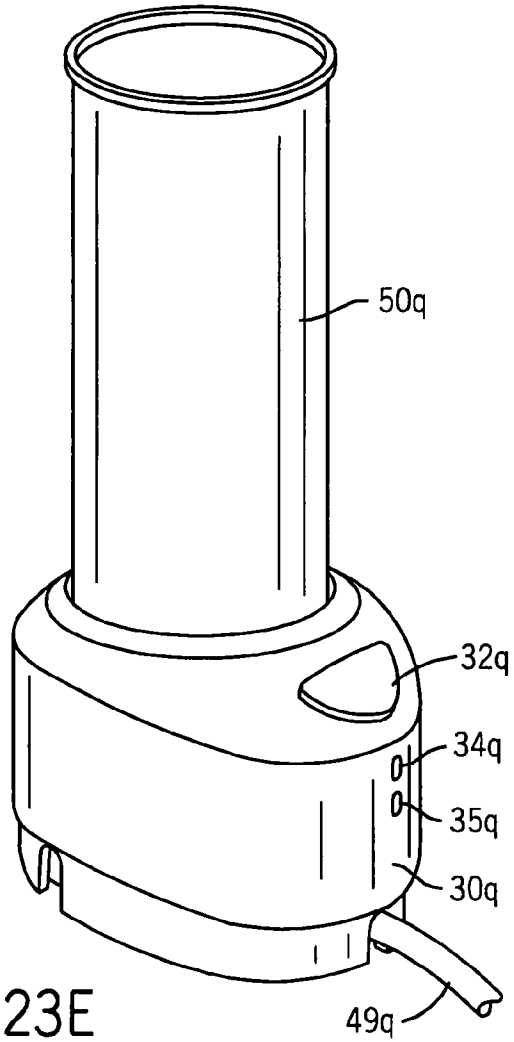
FIG. 23E is a left perspective view showing the container case and fluid conduit of the toilet bowl cleaning device of FIG. 23A.
Figure 23H:
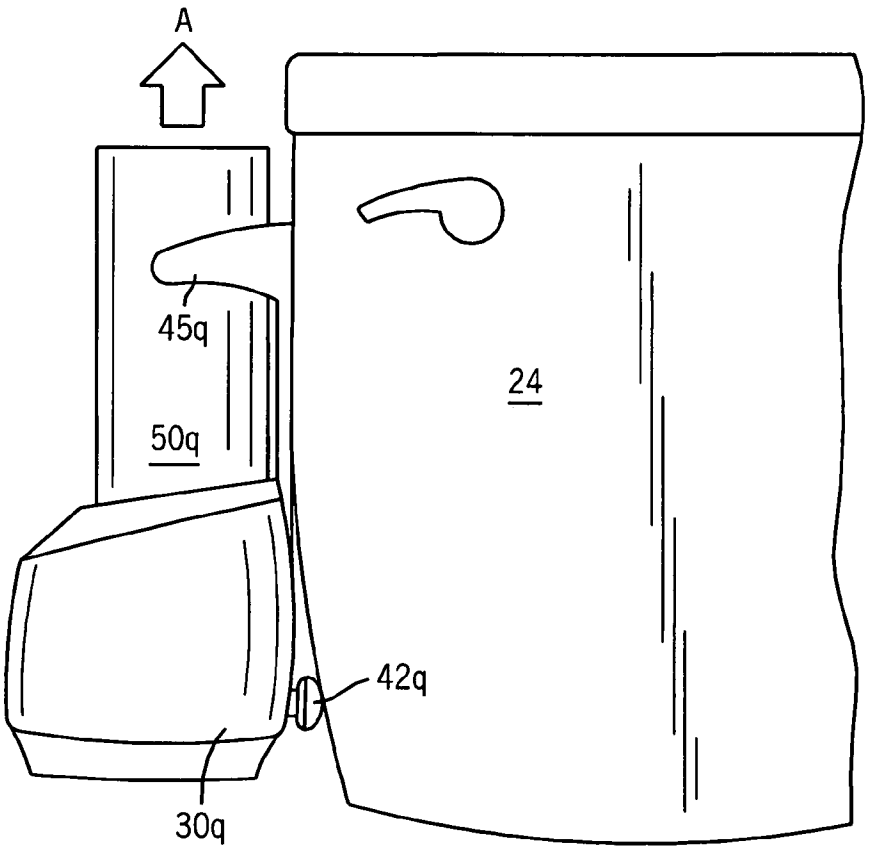
FIG. 23H is a side view showing the toilet bowl cleaning device of FIG. 23A mounted on the side wall of a toilet tank.
Figure 23G:
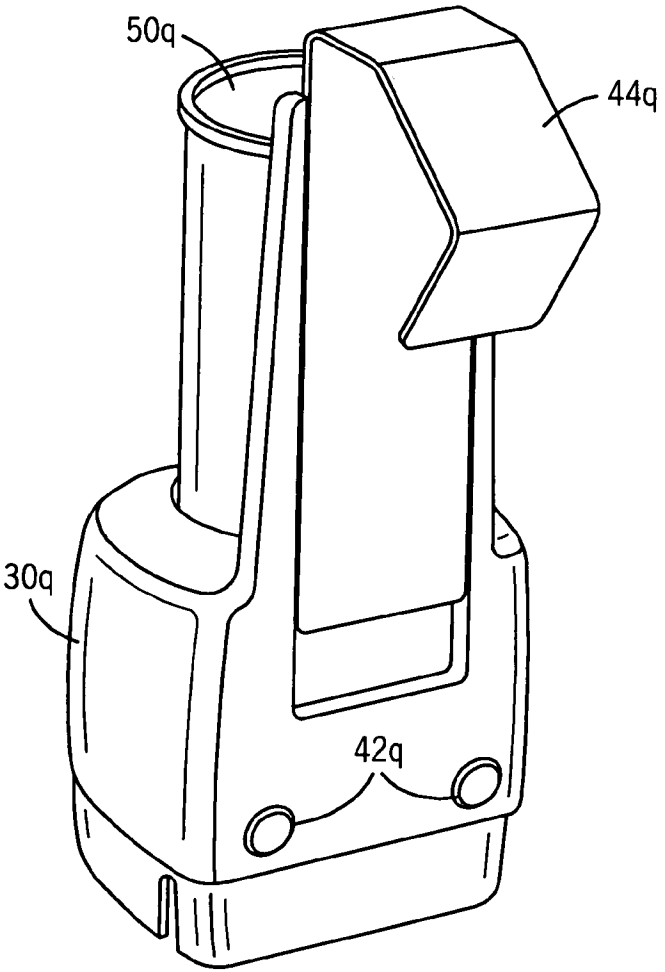
FIG. 23G is a right perspective view showing the container case and container access door of the toilet bowl cleaning device of FIG. 23A.
Figure 23J:
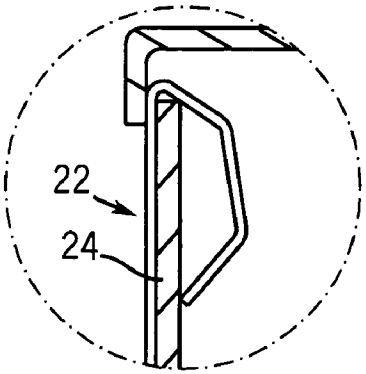
FIG. 23J is a side detailed view showing the hanger of the toilet bowl cleaning device of FIG. 23A as mounted on a toilet tank.
Figure 23K:
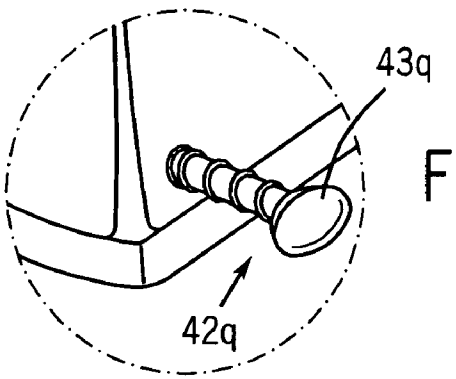
FIG. 23K is a perspective detailed view showing one case leveling set screw of the toilet bowl cleaning device of FIG. 23A.
Figure 23I:
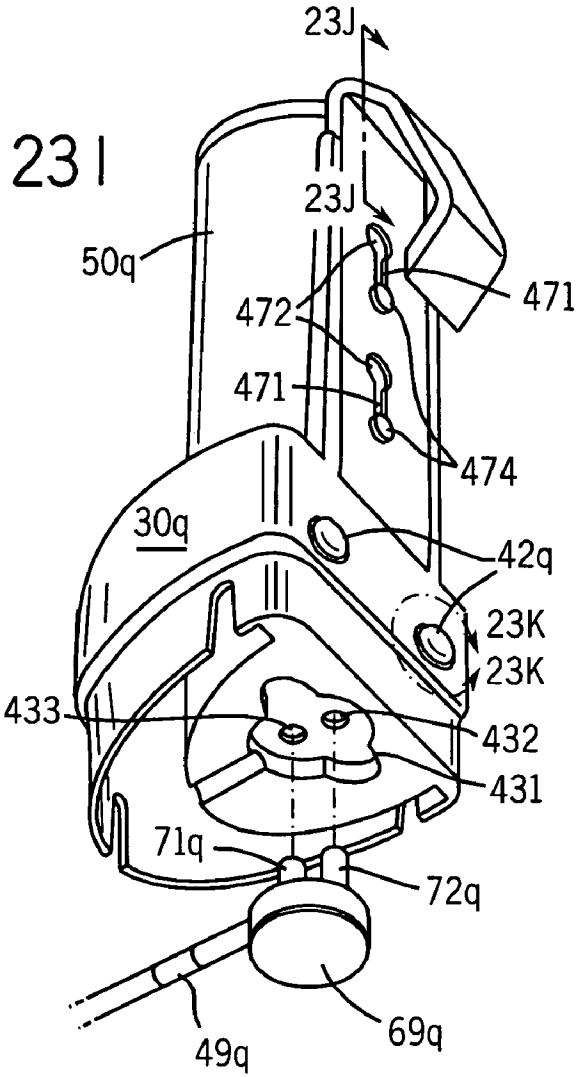
FIG. 23I is a rear perspective view showing the container case and hanger of the toilet bowl cleaning device of FIG. 23A.

The case 30*q* has an inverted generally J-shaped hanger 44*q* that extends upwardly from the base 30*q* as shown in FIGS. 23G and 23I. The hanger 44*q* of the base 30*q* allows a user to suspend the base 30*q* from a side wall 24 of the toilet tank 22 as shown in FIGS. 23F and 23J. Looking at FIG. 23I, the hanger 44*q* has a pair of oblong slots 471 with an enlarged hole 472 at one end. Pins 474 are mounted on the base 30*q*. The pins 474 include a shank having a width that is slightly less than the width of the slots 471 and a head having a diameter that is slightly less than the diameter of the holes 472. The hanger 44*p* may be attached to the base 30*q* by inserting the head of the pins 474 into the holes 472 and pulling the hanger 44*q* upward such that the shanks of the pins 474 move into the bottom of the slots 471 as shown in FIG. 23I. In this manner, the toilet bowl cleaning and/or deodorizing device of FIGS. 23A-23K may be mounted on the toilet tank 22 using the hanger 44*q*, or the hanger 44*q* may be removed for placing the base 30*q* on the floor. The base 30*p* may also include leveling set screws 42*q* that may be screwed in or out to vary the distance between the set screw head 43*q* and the base 30*q*. As shown in FIG. 23H, the leveling set screws 42*q* may be set such that the leveling set screws 42*q* contact the toilet tank 22 and keep the base 30*q* level with respect to the floor on which the toilet sits. The hanger 44*q* also includes a pair of resilient arms 45*q* (see FIGS. 23B, 23C, 23F, 23H) that secures the container 50*q* in the base 30*q*. Because the base 30*g* has no top, a container of any height can be placed in the base 30*q*.

The conduit 49*q* is connected to the base 30*q* with a connector 69*q* as shown in FIG. 23I. The connector 69*q* includes a chemical orifice 71*q* that is in fluid communication with the fitment and the container 50*q* for delivering chemical from the container 50*q* and into the conduit 49*q*. The connector 69*q* also includes an electrical connector 72*q* that places a control circuit of the device in electrical communication with a proximity sensor near the toilet. This feature will be described below with reference to FIGS. 24A-24E. The connector 69*q* is press fit into a recess 431 in the bottom of the base 30*q*. A first hole 432 of the recess 431 receives the electrical connector 72*q*, and a second hole 433 of the recess 431 receives the chemical orifice 71*q*.

Referring now to FIGS. 24A-24E, there is shown another mounting clip 60*p* and spray nozzle 80 for use with the invention. The mounting clip 60*p* has a base wall 62*p* and a side wall 64*p* that create an inverted generally L-shaped bracket 73*p* that may be adhered to the toilet rim 14 by a flexible mounting strip 74*p*. The mounting strip 74*p* is formed from an elastomeric material (such as rubber) that can conform to the shape of the top of the toilet rim and the outer side surface of the toilet bowl. The mounting strip 74*p* includes suction cups 75*p* on its inner surface.

Figure 24D:
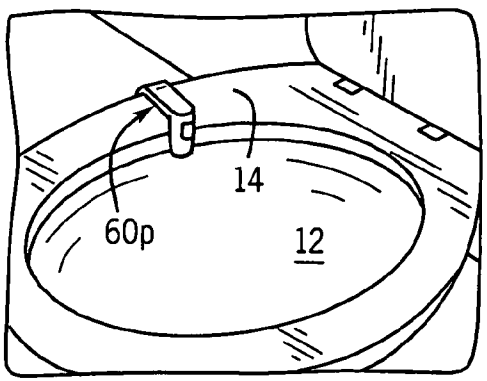
FIG. 24D is a top right perspective view showing the mounting clip and spray nozzle of FIG. 24A mounted on the rim of a toilet bowl.
Figure 24E:
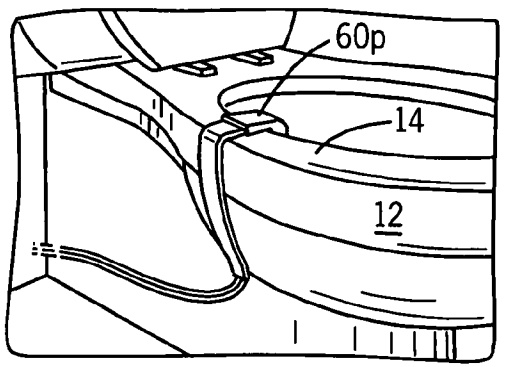
FIG. 24E is a top left perspective view showing the mounting clip and spray nozzle of FIG. 24A mounted on the rim of a toilet bowl.
Figure 24C:
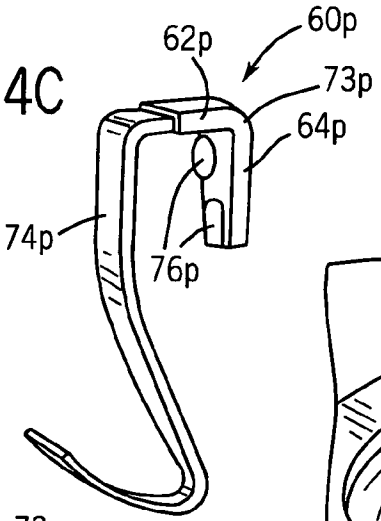
FIG. 24C is another perspective of the mounting clip and spray nozzle of FIG. 24A.
Figure 24B:
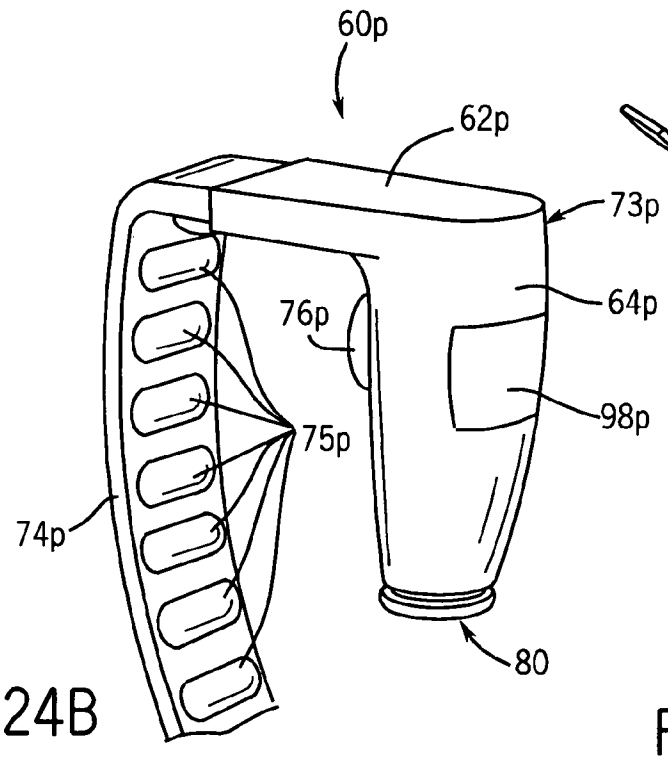
FIG. 24B is an enlarged perspective of the mounting clip and spray nozzle of FIG. 24A.
Figure 24A:
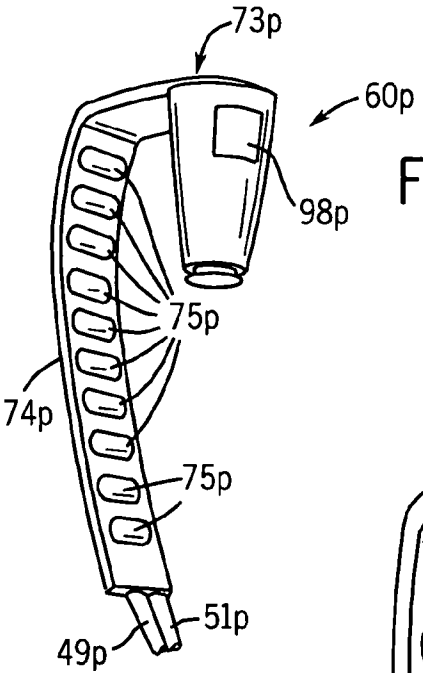
FIG. 24A is a perspective showing yet another mounting clip and spray nozzle suitable for use with a toilet bowl cleaning device according to the invention.

When installing the mounting clip 60*p* on the toilet rim 14, the L-shaped bracket 73*p* is placed on top of the toilet rim as shown in FIG. 24D, and the mounting strip is then pushed onto the top of the toilet rim and the outer side surface of the toilet bowl. The suction cups 75*p* keep the mounting strip 74*p* secured on the toilet bowl. Other suction cups 76*p* are provided on the inner surface of the L-shaped bracket 73*p* to keep the mounting clip secured on the toilet bowl. The L-shaped bracket 73*p* provides the structure to keep the nozzle at a fixed height in relation to the toilet rim.

The nozzle 80 is mounted to the side wall 64*p* of the clip 60*p*. The conduit 49*p* is connected to a fluid passageway in the mounting strip 74*p*, the base wall 62*p*, and the side wall 64*p*. The fluid passageway receives chemical from the conduit 49, and the spray nozzle 80 engages an end of the fluid passageway and receives chemical from the fluid passageway.

The side wall 64*p* of the mounting clip 60*p* defines a space that houses a proximity sensor 98*p*. The proximity sensor 98*p* detects the presence of a person. A control circuit for operation of the proximity sensor 98*p* is described below. The control circuit and the proximity sensor 98*p* are placed in electrical communication by way of wire 51*p* that extends from the proximity sensor 98*p* to the control circuit. Using the device of FIGS. 22A-22K as an example, the control circuit is housed in the case 30*p*, and the wire 51*p* extends from the proximity sensor 98*p* to the control circuit by way of the electrical connector 72*p* of FIG. 22I.

Figure 25:
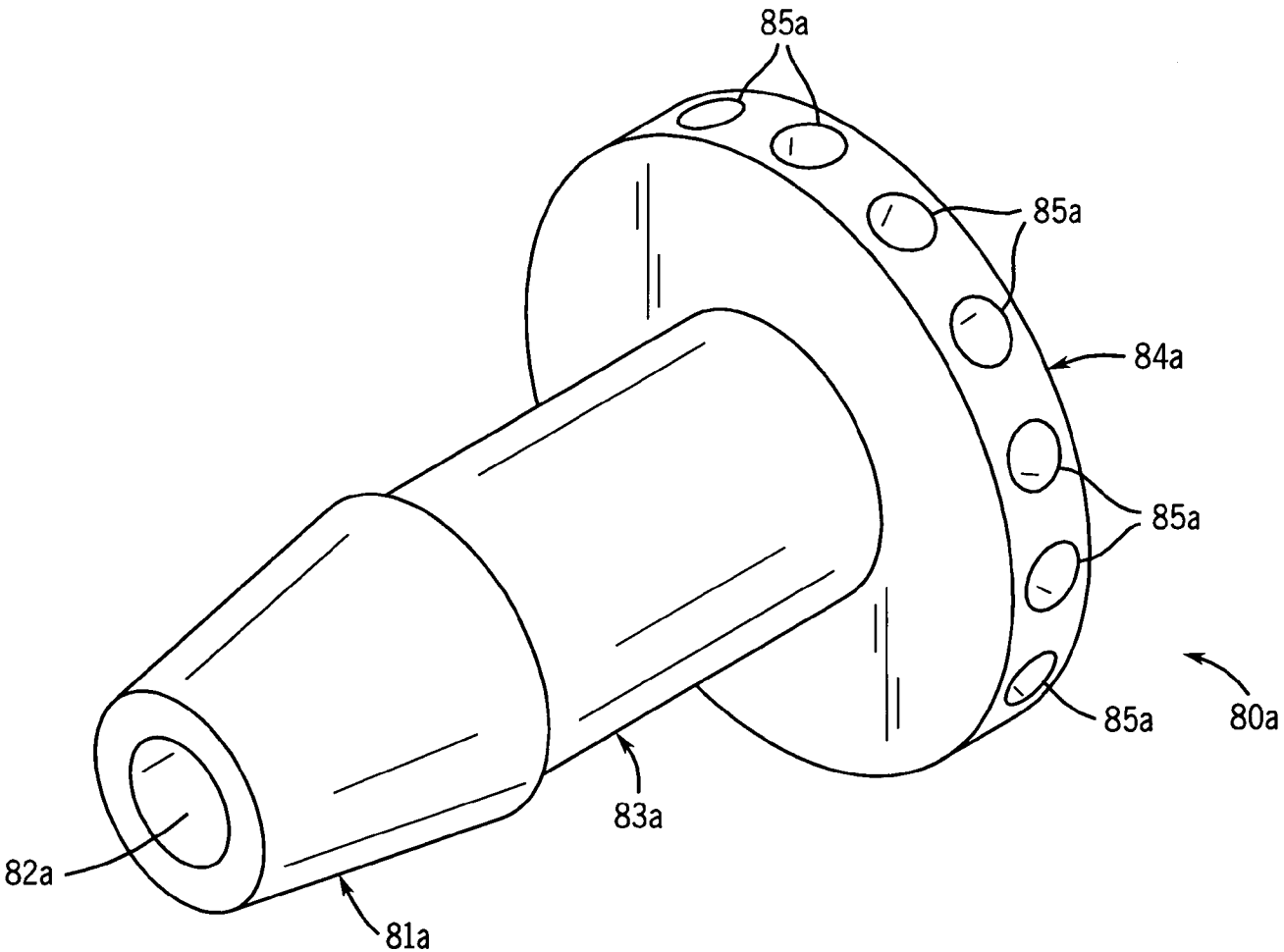
FIG. 25 is a perspective view of one embodiment of a spray nozzle suitable for use with a toilet bowl cleaning device according to the invention.

Referring now to FIG. 25, there is shown an embodiment of a static spray nozzle 80*a* for use with the invention. The spray nozzle 80*a* may be formed from a thermoplastic material such as polyethylene or polypropylene. The spray nozzle 80*a* has a sealing head 81*a* that may be inserted into the open end of the conduit 49 in the manner shown in FIG. 1B. The sealing head 81*a* increases in outside diameter toward a middle section 83*a* of the spray nozzle 80*a*. A disc shaped dispensing head 84*a* is integrally connected to the middle section 83*a*. The disc shaped dispensing head 84*a* has dispensing orifices 85*a* arranged around the perimeter of the disc shaped dispensing head 84*a*. The dispensing orifices 85*a* are in fluid communication with a central fluid passageway 82*a* that runs along the axis of the spray nozzle 80*a* from the sealing head 81*a* to the disc shaped dispensing head 84*a*. Preferably, the dispensing orifices 85*a* are evenly spaced around the perimeter of the disc shaped dispensing head 84*a*.

An illustration of the use of the spray nozzle 80*a* can be detailed with reference to FIGS. 1A-1C. When a user presses the manual activator button 32, the valve of the pressurized container 50 moves into an open position for delivering chemical from the container 50 through the conduit 49 and to the central fluid passageway 82*a* of the spray nozzle 80*a*. The chemical then exits the dispensing orifices 85*a* arranged around the perimeter of the disc shaped dispensing head 84*a*. Because the dispensing orifices 85*a* are arranged around the entire perimeter of the disc shaped dispensing head 84*a*, the chemical is sprayed laterally around the entire perimeter of the nozzle 80*a*. The angle of the dispensing orifices 85*a* with respect to the axis of the disc shaped dispensing head 84*a* of the spray nozzle 80*a* can be varied to directly spray chemical below the toilet waterline, and/or at the toilet waterline, and/or above the toilet waterline. Also, the distance between the disc shaped dispensing head 84*a* of the spray nozzle 80*a* and the toilet waterline can be varied to directly spray chemical below the toilet waterline, and/or at the toilet waterline, and/or above the toilet waterline. By proper selection of the angle of the dispensing orifices 85*a* with respect to the axis of the disc shaped dispensing head 84*a* of the spray nozzle 80*a*, chemical can also be directed under the toilet rim. The angle of each of the dispensing orifices 85*a* can be individually set to create any number of spray patterns.

Figure 26:
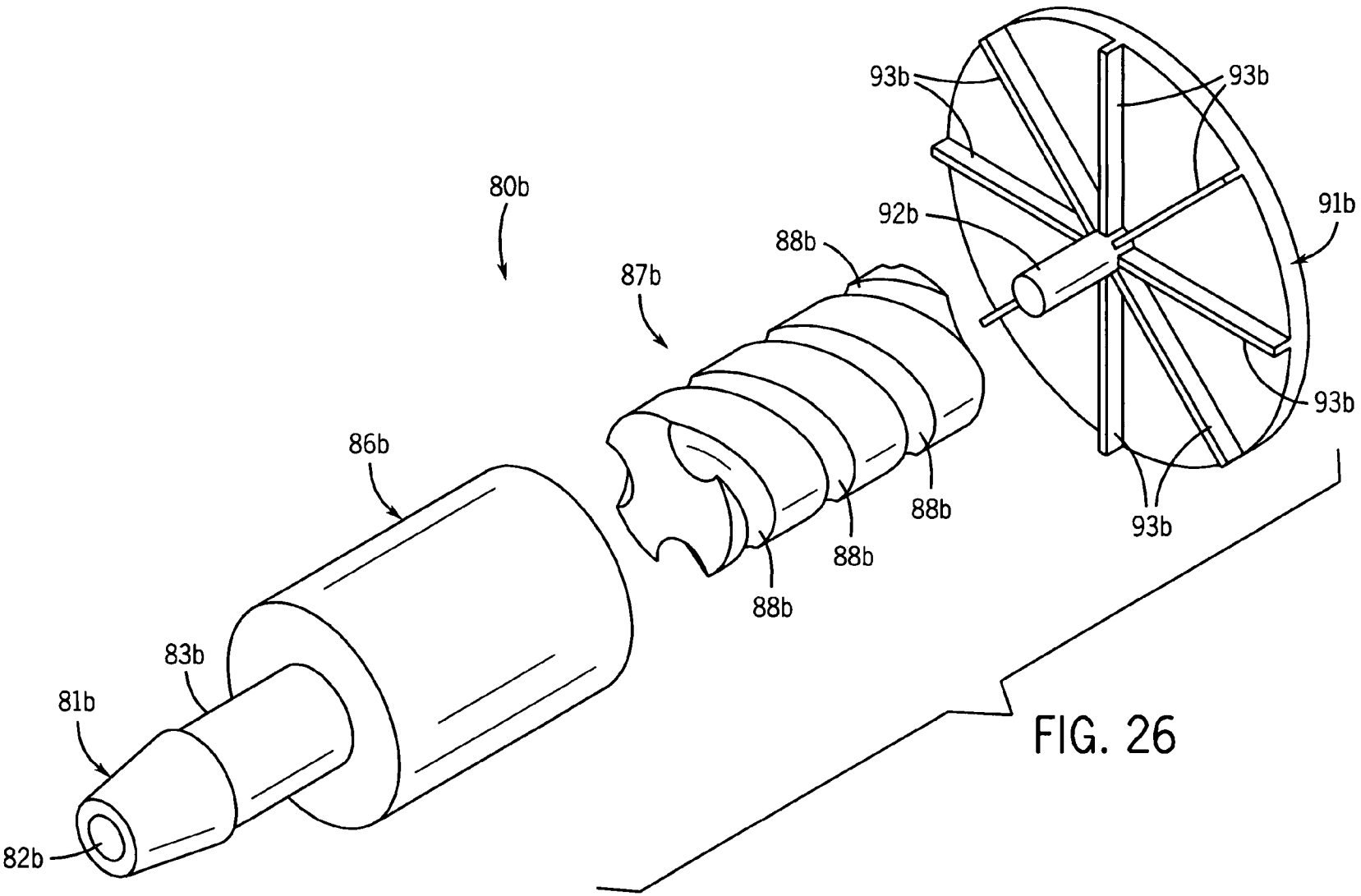
FIG. 26 is an exploded perspective view of another embodiment of a spray nozzle suitable for use with a toilet bowl cleaning device according to the invention.

Turning to FIG. 26, there is shown an embodiment of a rotating spray nozzle 80*b* for use with the invention. The components of the spray nozzle 80*b* may be formed from a thermoplastic material such as polyethylene or polypropylene. The spray nozzle 80*b* has a sealing head 81*a* that may be inserted into the open end of the conduit 49 in the manner shown in FIG. 1B. The sealing head 81*a* increases in outside diameter toward a middle section 83*b* of the spray nozzle 80*b*. A tubular flow passage 86*b* is integrally connected to the middle section 83*b*. The tubular flow passage 86*b* is in fluid communication with a central fluid passageway 82*a* that runs along the axis of the spray nozzle 80*b* from the sealing head 81*b* to the tubular flow passage 86*b*.

The spray nozzle 80*b* has a fluid spinner 87*b* located within the tubular flow passage 86*b*. The fluid spinner 87*b* is generally cylindrical and has a helical groove 88*b* extending from one end to the other end of the fluid spinner 87*b*. An interference fit can be used to keep the fluid spinner 87*b* in the tubular flow passage 86*b* of the spray nozzle 80*b*. The spray nozzle 80*b* also has a deflector plate 91*b* connected to the bottom end of the fluid spinner 87*b*. The deflector plate 91*b* has a connector shaft 92*b* that may be inserted in a central hole in the end of the fluid spinner 87*b* for rotation with respect to the fluid spinner 87*b*. The deflector plate 91*b* also has radial ribs 93*b* that extend radially from the connector shaft 92*b* to the edge of the deflector plate 91*b*.

An illustration of the use of the spray nozzle 80*b* can be detailed with reference to FIGS. 1A-1C. When a user presses the manual activator button 32, the valve of the pressurized container 50 moves into an open position for delivering chemical from the container 50 through the conduit 49 and to the central fluid passageway 82*b* of the spray nozzle 80*b*. The chemical enters the tubular flow passage 86*b* and flows in the helical groove 88*b* of the fluid spinner 87*b*. The helical groove 88*b* creates a spinning motion in the chemical. The spinning chemical then contacts the deflector plate 91*b*. The chemical creates rotation of the deflector plate 91*b* when impacting the radial ribs 93*b* of the deflector plate 91*b*. The chemical is then sprayed laterally around the entire perimeter of the nozzle 80*b*. As a result, the rotating deflector plate 91*b* can uniformly spread the chemical around the entire perimeter of the inner surface of the toilet bowl with sudsing and without seat interference. The slope of the surface of the deflector plate 91*b* and/or the shape of the radial ribs 93*b* can be varied to directly spray chemical below the toilet waterline, and/or at the toilet waterline, and/or above the toilet waterline. Also, the distance between the deflector plate 91*b* of the spray nozzle 80*b* and the toilet waterline can be varied to directly spray chemical below the toilet waterline, and/or at the toilet waterline, and/or above the toilet waterline. By proper selection of the shape of the deflector plate 91*b* of the spray nozzle 80*b*, chemical can also be directed under the toilet rim. For example, the edge of the deflector plate 91*b* may have an upwardly sloping lip. The shape of the radial ribs 93*b* can be individually set to create any number of spray patterns.

Figure 27:
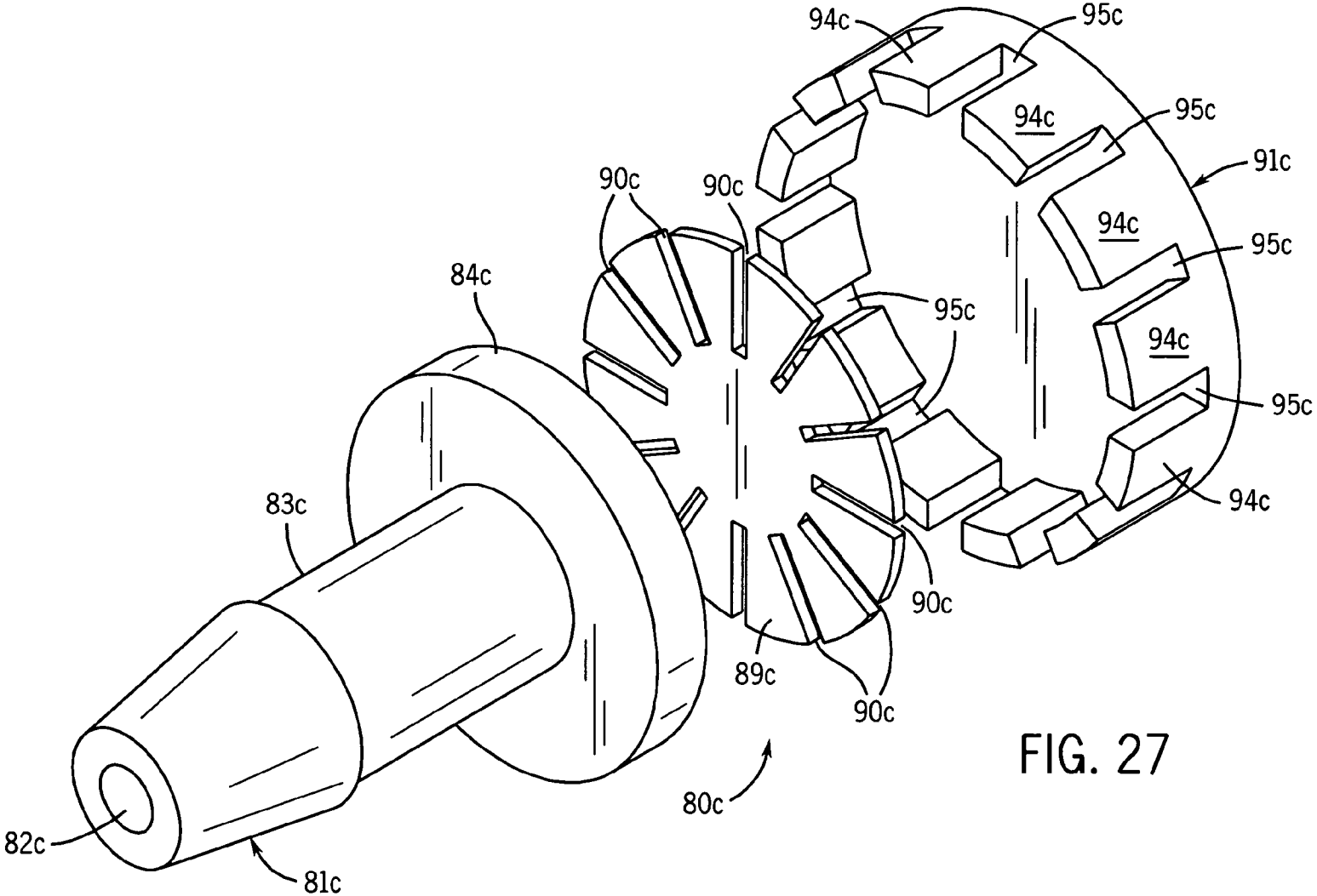
FIG. 27 is an exploded perspective view of yet another embodiment of a spray nozzle suitable for use with a toilet bowl cleaning device according to the invention.

Referring now to FIG. 27, there is shown another embodiment of a spray nozzle 80*c* for use with the invention. The components of the spray nozzle 80*c* may be formed from a thermoplastic material such as polyethylene or polypropylene. The spray nozzle 80*c* has a sealing head 81*c* that may be inserted into the open end of the conduit 49 in the manner shown in FIG. 1B. The sealing head 81*c* increases in outside diameter toward a middle section 83*c* of the spray nozzle 80*c*. A disc shaped flow chamber 84*c* is integrally connected to the middle section 83*c*. The disc shaped flow chamber 84*c* is in fluid communication with a central fluid passageway 82*c* that runs along the axis of the spray nozzle 80*c* from the sealing head 81*c* to the disc shaped flow chamber 84*c*.

The spray nozzle 80*c* has a disc 89*c* with radial slots 90*c*. The disc 89*c* is located within the disc shaped flow chamber 84*c*. The spray nozzle 80*c* also has a deflector plate 91*c* connected to the disc shaped flow chamber 84*c*. An interference fit can be used to keep the deflector plate 91*c* connected to the disc shaped flow chamber 84*c*. The deflector plate 91*c* has teeth 94*c* around its perimeter that create dispensing slots 95*c* around a perimeter of the deflector plate 91*c*.

An illustration of the use of the spray nozzle 80*c* can be detailed with reference to FIGS. 1A-1C. When a user presses the manual activator button 32, the valve of the pressurized container 50 moves into an open position for delivering chemical from the container 50 through the conduit 49 and to the central fluid passageway 82*c* of the spray nozzle 80*c*. The chemical then exits the dispensing slots 95*c* that are arranged around the perimeter of the deflector plate 91*c*. Because the dispensing slots 95*c* are arranged around the entire perimeter of the deflector plate 91*c*, the chemical is sprayed laterally around the entire perimeter of the nozzle 80*c*. The dimensions of the dispensing slots 95*c* of the spray nozzle 80*c* can be varied to directly spray chemical below the toilet waterline, and/or at the toilet waterline, and/or above the toilet waterline. Also, the distance between the deflector plate 91*c* of the spray nozzle 80*c* and the toilet waterline can be varied to directly spray chemical below the toilet waterline, and/or at the toilet waterline, and/or above the toilet waterline. By proper selection of the dispensing slots 95*c* of the spray nozzle 80*a*, chemical can also be directed under the toilet rim. The dimensions of each of the dispensing slots 95*c* can be individually set to create any number of spray patterns.

Figure 28:
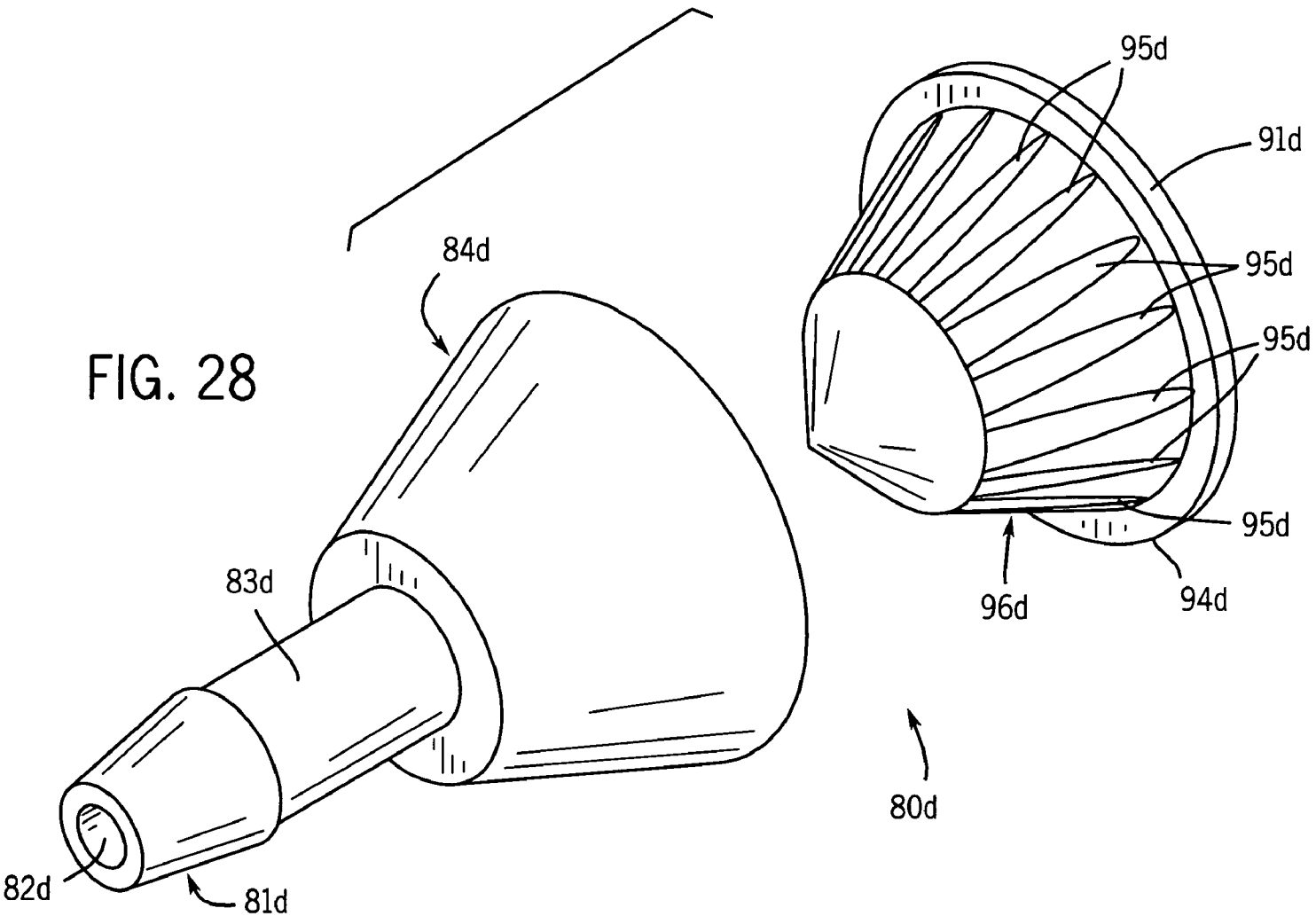
FIG. 28 is an exploded perspective view of still another embodiment of a spray nozzle suitable for use with a toilet bowl cleaning device according to the invention.

Turning to FIG. 28, there is shown another embodiment of a static spray nozzle 80*d* for use with the invention. The components of the spray nozzle 80*d* may be formed from a thermoplastic material such as polyethylene or polypropylene. The spray nozzle 80*d* has a sealing head 81*d* that may be inserted into the open end of the conduit 49 in the manner shown in FIG. 1B. The sealing head 81*d* increases in outside diameter toward a middle section 83*d* of the spray nozzle 80*d*. A frustoconical flow chamber 84*d* is integrally connected to the middle section 83*d*. The flow chamber 84*d* is in fluid communication with a central fluid passageway 82*d* that runs along the axis of the spray nozzle 80*d* from the sealing head 81*d* to the flow chamber 84*d*.

The spray nozzle 80*d* has a deflector plug 91*d* connected to the flow chamber 84*d*. An interference fit can be used to keep the deflector plug 91*d* connected to the flow chamber 84*d*. The deflector plug 91*d* has a generally dome-shaped section 96*d* with dispensing channels 95*d* around its perimeter. A lower flange 94*d* extends outward from the bottom of the dome-shaped section 96*d*.

An illustration of the use of the spray nozzle 80*d* can be detailed with reference to FIGS. 1A-1C. When a user presses the manual activator button 32, the valve of the pressurized container 50 moves into an open position for delivering chemical from the container 50 through the conduit 49 and to the central fluid passageway 82*d* of the spray nozzle 80*d*. The chemical then enters the dispensing channels 95*d* that are arranged around the perimeter of the dome-shaped section 96*d* of the deflector plug 91*d*. The chemical then contacts the flange 94*d* and because the dispensing channels 95*d* are arranged around the entire perimeter of the deflector plug 91*d*, the chemical is sprayed laterally around the entire perimeter of the nozzle 80*d*. The dimensions of the dispensing channels 95*d* and lower flange 94*d* of the spray nozzle 80*d* can be varied to directly spray chemical below the toilet waterline, and/or at the toilet waterline, and/or above the toilet waterline. Also, the distance between the deflector plug 91*d* of the spray nozzle 80*d* and the toilet waterline can be varied to directly spray chemical below the toilet waterline, and/or at the toilet waterline, and/or above the toilet waterline. By proper dimensioning of the dispensing channels 95*d* and flange 94*d* of the spray nozzle 80*d*, chemical can also be directed under the toilet rim. For example, the edge of the flange 94*d* may have an upwardly sloping lip. The dimensions of each of the dispensing channels 95*d* can be individually set to create any number of spray patterns.

Figure 29:
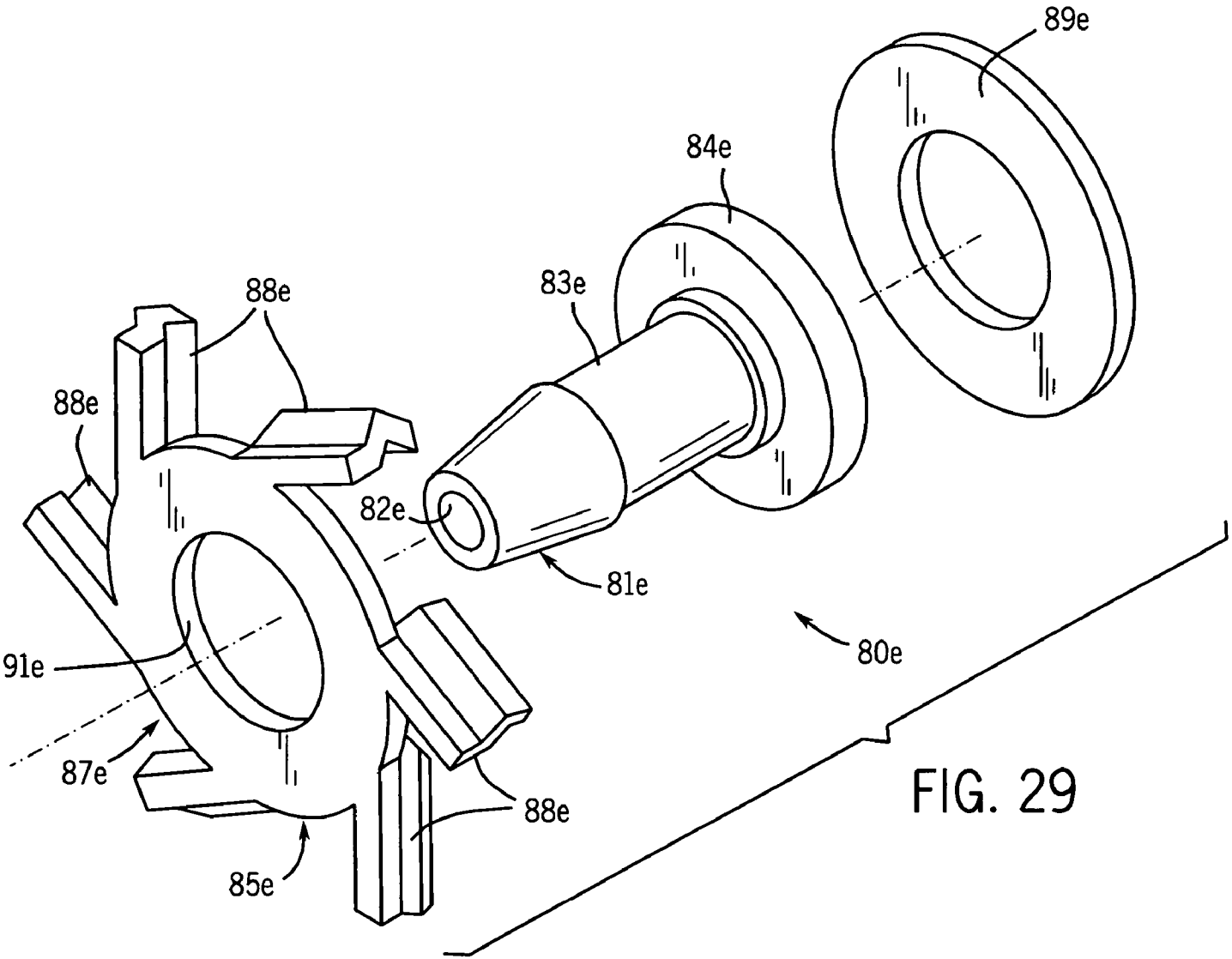
FIG. 29 is an exploded perspective view of yet another embodiment of a spray nozzle suitable for use with a toilet bowl cleaning device according to the invention.
Figure 30:
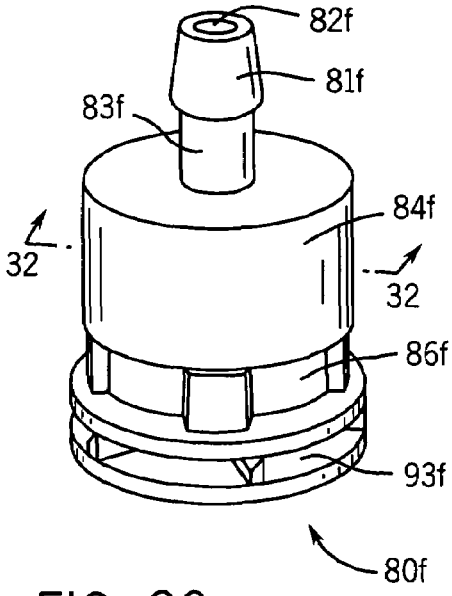
FIG. 30 is a perspective view of still another embodiment of a spray nozzle suitable for use with a toilet bowl cleaning device according to the invention.

Referring now to FIG. 29, there is shown another embodiment of a rotating spray nozzle 80*e* for use with the invention. The components of the spray nozzle 80*e* may be formed from a thermoplastic material such as polyethylene or polypropylene. The spray nozzle 80*e* has a sealing head 81*e* that may be inserted into the open end of the conduit 49 in the manner shown in FIG. 1B. The sealing head 81*e* increases in outside diameter toward a middle section 83*e* of the spray nozzle 80*e*. A disc shaped flow chamber 84*e* is integrally connected to the middle section 83*e*. The disc shaped flow chamber 84*e* is in fluid communication with a central fluid passageway 82*e* that runs along the axis of the spray nozzle 80*e* from the sealing head 81*e* to the disc shaped flow chamber 84*e*.

The spray nozzle 80*e* also includes a fluid spinner 87*e* and associated mounting disc 89*e*. The fluid spinner 87*e* is placed on the disc shaped flow chamber 84*e* by inserting the sealing head 81*e* and the middle section 83*e* through a central hole 91*e* in the fluid spinner 87*e*. The mounting disc 89*e* may be press fit into the fluid spinner 87*e* such that the fluid spinner 87*e* and the mounting disc 89*e* may rotate with respect to the disc shaped flow chamber 84*e*. The fluid spinner 87*e* has flow deflectors 88*e* that extend outward from an annular section 85*e* of the fluid spinner 87*e*.

An illustration of the use of the spray nozzle 80*e* can be detailed with reference to FIGS. 1A-1C. When a user presses the manual activator button 32, the valve of the pressurized container 50 moves into an open position for delivering chemical from the container 50 through the conduit 49 and to the central fluid passageway 82*e* of the spray nozzle 80*e*. The chemical enters the disc shaped flow chamber 84*e* and then contacts the mounting disc 89*e*. The chemical then flows outward and contacts the flow deflectors 88*e* of the fluid spinner 87*e* creating rotation of the fluid spinner 87*e*. The chemical is then sprayed laterally around the entire perimeter of the nozzle 80*e*. The slope of the surface of the mounting disc 89*e* and/or the shape of the flow deflectors 88*e* of the fluid spinner 87*e* can be varied to directly spray chemical below the toilet waterline, and/or at the toilet waterline, and/or above the toilet waterline. Also, the distance between the mounting disc 89*e* of the spray nozzle 80*e* and the toilet waterline can be varied to directly spray chemical below the toilet waterline, and/or at the toilet waterline, and/or above the toilet waterline. By proper selection of the shape of the mounting disc 89*e* and fluid spinner 87*e* of the spray nozzle 80*e*, chemical can also be directed under the toilet rim. The shape of the flow deflectors 88*e* of the fluid spinner 87*e* can be individually set to create any number of spray patterns.

Referring now to FIGS. 30-33, there is shown yet another embodiment of a rotating spray nozzle 80*f* for use with the invention. The components of the spray nozzle 80*f* may be formed from a thermoplastic material such as polyethylene or polypropylene. The spray nozzle 80*f* has a sealing head 81*f* that may be inserted into the open end of the conduit 49 in the manner shown in FIG. 1B. The sealing head 81*f* increases in outside diameter toward a tubular middle section 83*f* of the spray nozzle 80*f*. A tubular flow passage 84*f* is integrally connected to the middle section 83*f*. The tubular flow passage 84*f* is in fluid communication with a central fluid passageway 82*f* that runs along the axis of the spray nozzle 80*f* from the sealing head 81*f* to the tubular flow passage 84*f*. The central fluid passageway 82*f* has a conically diverging end 85*f*.

Figure 32:
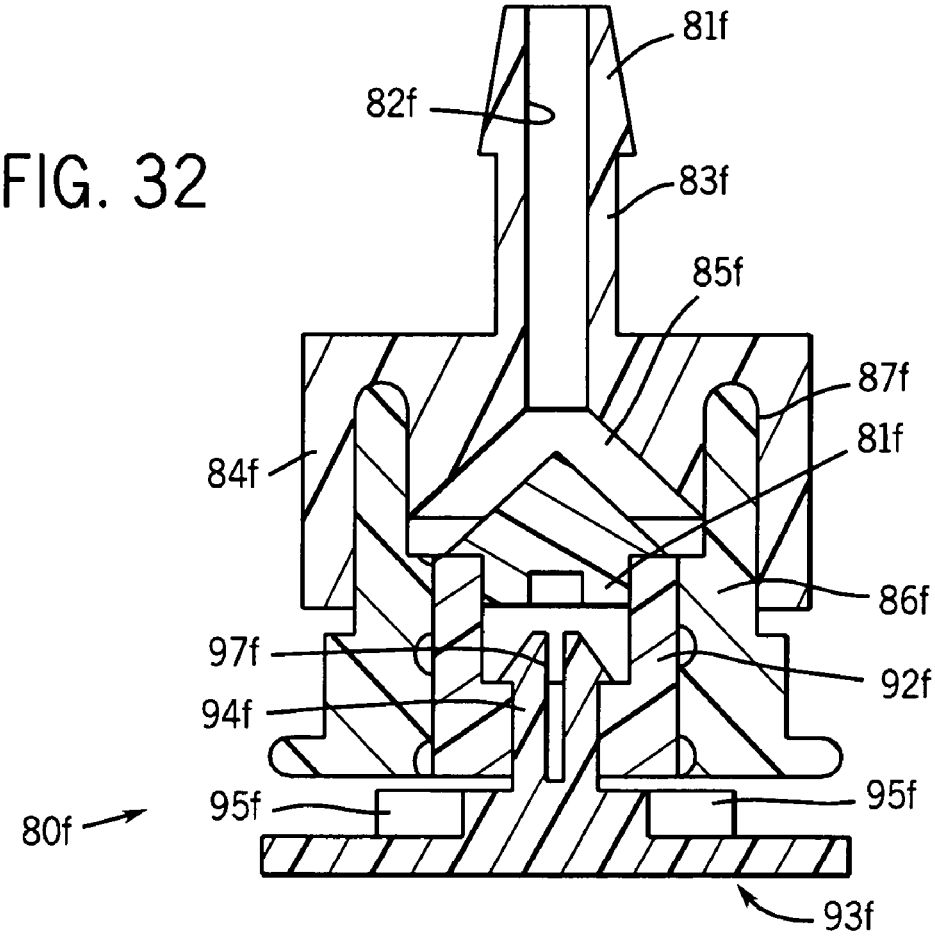
FIG. 32 is a cross-sectional view of the spray nozzle of FIG. 30 taken along line 32-32 of FIG. 30.
Figure 33:
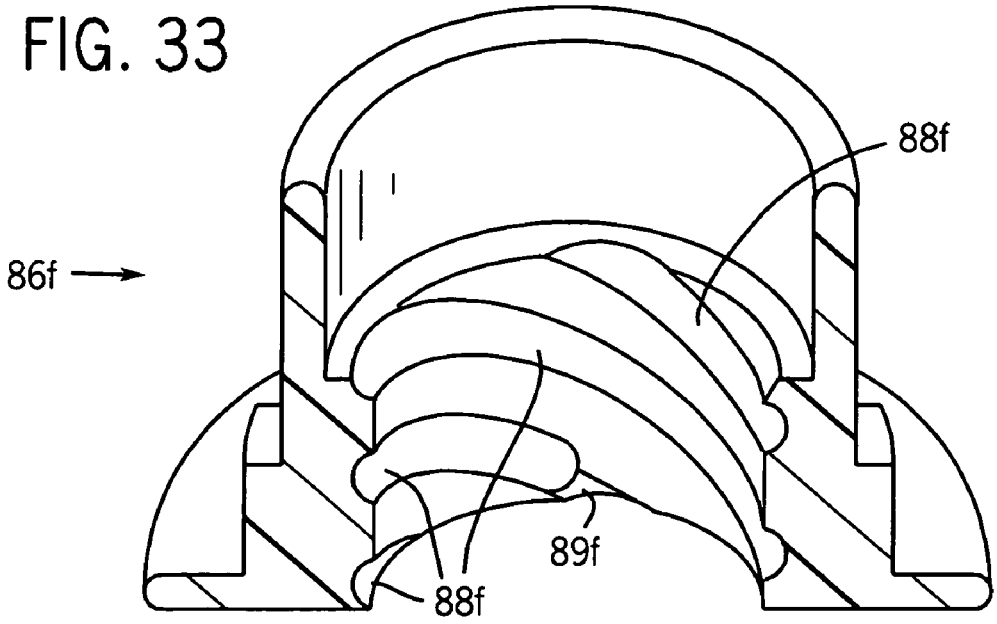
FIG. 33 is a cross-sectional view of the fluid spinner body of the spray nozzle of FIG. 31 taken along line 33-33 of FIG. 31.

The spray nozzle 80*f* has a tubular fluid spinner 86*f* that is press fit into an annular channel 87*f* in the tubular flow passage 84*f* as shown in FIG. 32. Looking at FIG. 33, the fluid spinner 86*f* is generally cylindrical and has four helical grooves 88*f* on a lower section of the inner surface of the fluid spinner 86*f*. Each of the helical grooves 88*f* tapers to a narrow slot 89*f* creating a high pressure stream of fluid.

Figure 31:
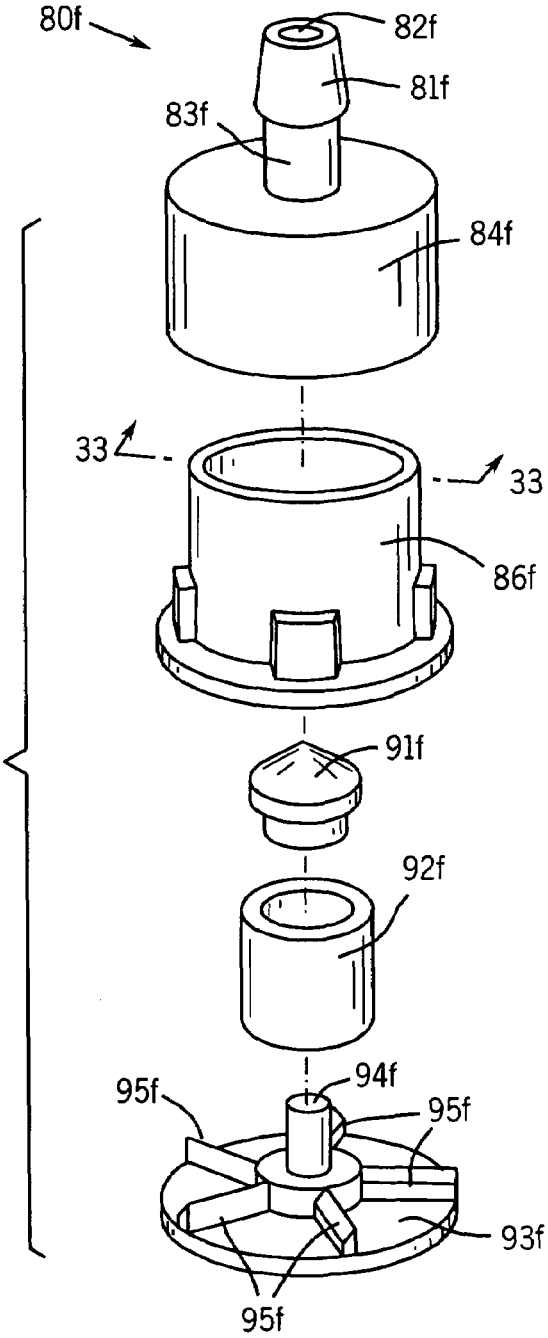
FIG. 31 is an exploded perspective view of the spray nozzle of FIG. 30.

The spray nozzle 80*f* also has a domed deflector button 91*f* connected to the top end of a cylindrical mounting tube 92*f* that is press fit into the fluid spinner 86*f*. A deflector plate 93*f* has a split connector shaft 94*f* that may be inserted in a central hole 97*f* in the end of mounting tube 92*f* for rotation with respect to the fluid spinner 86*f*. The deflector plate 93*f* also has radial ribs 95*f* that extend upward from the deflector plate 93*f* and extend radially from the connector shaft 94*f* to the edge of the deflector plate 93*f*. As shown in FIG. 31, the radial ribs 95*f* may have ramped sections 96*f* at their upper end.

An illustration of the use of the spray nozzle 80*f* can be detailed with reference to FIGS. 1A-1C and FIG. 32. When a user presses the manual activator button 32, the valve of the pressurized container 50 moves into an open position for delivering chemical from the container 50 through the conduit 49 and to the central fluid passageway 82*f* of the spray nozzle 80*f*. The chemical enters the diverging end 85*f* of the passageway 82*f* and flows in the helical grooves 88*f* of the fluid spinner 86*f*. The helical grooves 88*f* create a spinning motion in the chemical. The spinning chemical then contacts the deflector plate 93*f*. The chemical creates rotation of the deflector plate 93*f* when impacting the radial ribs 95*f* of the deflector plate 93*f*. The chemical is then sprayed laterally around the entire perimeter of the nozzle 80*f*. As a result, the rotating deflector plate 93*f* can uniformly spread the chemical around the entire perimeter of the inner surface of the toilet bowl with sudsing and without seat interference. The slope of the surface of the deflector plate 93*f* and/or the shape of the radial ribs 95*f* can be varied to directly spray chemical below the toilet waterline, and/or at the toilet waterline, and/or above the toilet waterline. Also, the distance between the deflector plate 93*f* of the spray nozzle 80*f* and the toilet waterline can be varied to directly spray chemical below the toilet waterline, and/or at the toilet waterline, and/or above the toilet waterline. By proper selection of the shape of the deflector plate 93*f* of the spray nozzle 80*f*, chemical can also be directed under the toilet rim. For example, the edge of the deflector plate 93*f* may have an upwardly sloping lip. The shape of the radial ribs 95*f* can be individually set to create any number of spray patterns.

FIGS. 25 to 33 show non-limiting examples of spray nozzles for use in the invention. In this regard, other nozzles are also suitable for use with the invention. For instance, the invention may include the use of nozzles that sit within the toilet, or on or over the toilet itself. The nozzles may include a stationary head, rotating or spinning heads, or oscillating heads (such as those described in U.S. Pat. No. 4,562,867) provide a means to dispense a variety of chemistries to provide appropriate coverage within the toilet bowl and under the toilet rim.

With respect to the devices described above, manual delivery of the chemical from the container to the conduit can be achieved in many different manners. For example, as described above, manual activation buttons or foot pedals can be used to move the valve of a pressurized container and deliver chemical into the conduit 49 and into the spray nozzle 80. Alternatively, a manual trigger type sprayer, such as that shown in U.S. Pat. No. 4,618,077 can be used to introduce chemical from a container into the conduit 49 and into the spray nozzle 80.

An electric motor driven sprayer such as that shown in U.S. Patent Application Publication No. 2005/0133540 can also be used to introduce chemical from a container into the conduit 49 and into the spray nozzle 80. In this type of electric motor driven sprayer, batteries power a motor for a piston pump. A flexible pick-up tube extends from the container with the chemical. An air vent is provided from the sprayer back down to the container to vent the container as liquid is pulled out. The motor in the spray head housing drives a circular member with a radial projection. The projection rides in a slot of a cam follower up and down to drive a piston head forward and back in a piston cylinder adjacent the outlet nozzle. Suitable check valves permit flow from the container to the outlet in response to piston movement, yet prevent return flow from the piston chamber. The nozzle of such an electric motor driven sprayer could be connected to the conduit 49.

Automatic delivery of the chemical from the container to the conduit and into the spray nozzle can be achieved in many different ways. When using a pressurized container with a tilt valve, chemical can be released from the container into the conduit and into the spray nozzle using a control circuit and a solenoid. In particular, the control circuit can energize the solenoid and when energized, the core of the solenoid moves against (depresses) the tilt valve of the container to release the chemical from the pressurized container and into the conduit. Other means for releasing the chemical from the pressurized container and into the conduit are also suitable. The control circuit can energize a motor that meshes with gears with a lever, and the lever moves against the tilt valve of the container to release the chemical from the pressurized container and into the conduit. The control circuit can also energize a motor that meshes with gears that move against the tilt valve of the container to release the chemical from the pressurized container and into the conduit. The control circuit can also energize a motor that meshes with gears with a cam, and the cam moves against the tilt valve of the container to release the chemical from the pressurized container and into the conduit as shown in FIGS. 22B and 23B.

The control circuit may include a battery and a programmable time-of-day timer such that the solenoid is energized and chemical is released from the container into the conduit according to an adjustable time pattern. For instance, chemical may be released from the container into the conduit at eight hour intervals. Of course, such programmable time-of-day timers allow for any number of time periods between release of chemical into the conduit and spray nozzle. Thus, a control circuit with a programmable time-of-day timer provides for a continuous action toilet bowl cleaning system.

Other control circuits are also suitable. For example, the control circuit may include a processor in electrical communication with a proximity sensor that detects the presence of a person near the toilet. The processor includes a timing circuit such that the solenoid is energized and chemical is released from the container into the conduit at a time period after a person is no longer sensed near the toilet. For instance, the proximity sensor sends a signal to the processor that a person is near the toilet. When the person leaves, the proximity sensor sends another signal to the processor indicating that no person is now near the toilet. A countdown timer in the processor then delays release of chemical from the container into the conduit. The processor then allows for additional time periods between release of chemical into the conduit and spray nozzle. In one example, after the proximity sensor indicates to the processor that a person has left the area of the toilet, delivery of the chemical begins 30 minutes later and continues at periodic intervals. Alternatively, delivery of the chemical may begin immediately after the user presses an activation button and then continues at eight hour (or any other time period) intervals. Thus, these control circuits provide for a continuous action toilet bowl cleaning system that reduces time and effort in cleaning the toilet bowl. Any time period may be chosen for the periodic interval of chemical delivery. Suitable intervals may be at least 30 minutes, at least 2 hours, at least 6 hours, etc.; approximately 8 hours is preferred.

Automatic delivery of chemical from the container to the conduit can also be achieved using an electrically driven pump and a control circuit. For instance, the electrically driven pump sprayer of U.S. Patent Application Publication No. 2005/0133540 described above could include a control circuit with programmable time-of-day timer such that the pump operates according to an adjustable time pattern thereby delivering chemical from the container to the conduit and into the spray nozzle. Such control circuits can be quite advantageous in that automatic and/or manual override of the programmed time periods can be implemented to stop initiation of a spray cycle of the chemical. For example, a user may turn off the device, or a proximity sensor in electrical communication with the control circuit can stop initiation of a spray cycle if a person or household animal is near the toilet bowl. Another example of control circuit can include a toilet water proximity sensor where the level drop of the top of the toilet water during a flush is sensed by the toilet water proximity sensor and a timer circuit automatically initiates a spray cycle at a set time period after the flush.

Various cleaning and/or deodorizing chemicals are suitable for use with a toilet bowl cleaning device according to the invention. For example, mildly acidic and near neutral pH antimicrobial compositions such as those described in U.S. Pat. Nos. 6,471,974 and 6,162,371 can be advantageous when used with a toilet bowl cleaning device according to the invention. Alkaline antimicrobial toilet bowl cleaning formulations such as those described in U.S. Pat. No. 6,425,406 can also be advantageous. Acidic compositions such as those described in U.S. Pat. No. 6,812,196 may also be suitable. When using acidic compositions, a steel container with a plastic liner or a bladder with a surrounding propellant may be desirable to minimize acidic corrosion of the steel container. Aluminum containers may also be an option for acidic compositions. The amount of chemical applied to the toilet bowl and/or toilet water depends on the composition chosen. For example, in an acidic composition including lactic acid, surfactant, and solvent, a 2-10 milliliter dose of chemical may be appropriate. The above chemicals are non-limiting illustrative examples of cleaning and/or deodorizing chemicals suitable for use with a toilet bowl cleaning device according to the invention. Other example suitable chemicals include, for example, enzymes, chelating agents, corrosives and amino acids.

Thus, the present invention provides a toilet bowl cleaning device that manually or automatically sprays a chemical laterally around a perimeter of a nozzle of the device. As a result, full coverage of the chemical around the inner surface of the toilet bowl is possible.

Although the present invention has been described in detail with reference to certain embodiments, one skilled in the art will appreciate that the present invention can be practiced by other than the described embodiments, which have been presented for purposes of illustration and not of limitation. Therefore, the scope of the invention should not be limited to the description of the embodiments contained herein.

INDUSTRIAL APPLICABILITY

The present invention provides a toilet bowl cleaning device for spraying an inner surface of the toilet bowl, and/or the toilet water, and/or under the toilet rim with a chemical.

What is claimed is:

1. A device for automatically spraying an inner surface of a toilet bowl with a chemical, the device comprising:

a container for the chemical;

a spray nozzle through which the chemical can be sprayed laterally at least halfway around a perimeter of the nozzle;

a conduit in fluid communication with the container and the spray nozzle;

fluid delivery means for delivering chemical from the container through the conduit and to the spray nozzle;

means for attaching the spray nozzle near a rim of the toilet bowl, wherein the spray nozzle includes a tubular flow passage in fluid communication with the conduit and the spray nozzle;

a proximity sensor for detecting the presence of a user near the toilet bowl;

a control circuit, wherein the control circuit and proximity sensor are in electrical communication, and wherein the control circuit has at least a first program, the first program set to prevent release of chemical from the container such when the user is detected near the toilet bowl.

2. The device of claim 1 wherein:

the spray nozzle is structured such that that chemical can be sprayed laterally around the entire perimeter of the nozzle.

3. The device of claim 1 wherein:

the container is pressurized, and the fluid delivery means comprises a propellant in the container and a valve in the conduit, the valve having an open position for delivering chemical from the container through the conduit and to the spray nozzle.

4. The device of claim 3 wherein:

the propellant is selected from the group consisting of hydrocarbon based propellants, air, nitrogen, and carbon dioxide.

5. The device of claim 3 further comprising:

a case for the container, the case including an activator for moving the valve into the open position.

6. The device of claim 3 wherein:

the fluid delivery means further comprises (i) an actuator for moving the valve into the open position and keeping the valve in the open position during a spray cycle, and (ii) a timing circuit for automatically initiating and terminating the spray cycle.

7. The device of claim 1 wherein:

the fluid delivery means comprises a pump for delivering chemical from the container through the conduit and to the spray nozzle when the pump is activated.

8. The device of claim 7 wherein:

the pump is activated during a spray cycle, and the fluid delivery means includes a timing circuit for automatically initiating and terminating the spray cycle.

9. The device of claim 8 wherein:

the fluid delivery means further comprises a proximity sensor for detecting presence of a person near the toilet bowl, the proximity sensor being in electrical communication with the timing circuit for preventing automatic initiation of the spray cycle.

10. The device of claim 7 wherein:

the pump is selected from the group consisting of vein pumps, impeller driven pumps, peristaltic pumps, gear driven pumps, bellows pumps, and piston pumps.

11. The device of claim 7 further comprising:

a case for the container, the case including an activator for activating the pump.

12. The device of claim 1 wherein:

the means for attaching the spray nozzle comprises a clip having a base wall and having opposed spaced apart side walls extending away from the base wall.

13. The device of claim 12 wherein:

the opposed spaced apart side walls of the clip are movable toward and away from each other such that a distance between the opposed spaced apart side walls is adjustable.

14. The device of claim 1 wherein:

the means for attaching the spray nozzle comprises a bracket and a flexible attachment strip having at least one suction cup for attaching to the toilet.

15. The device of claim 1 wherein:

the means for attaching the spray nozzle comprises a suction device.

16. The device of claim 1 wherein:

the means for attaching the spray nozzle comprises an adhesive material.

17. The device of claim 1 wherein:

the container has a translucent wall.

18. The device of claim 1 further comprising:

a case for the container, the case including an access door for inserting and removing the container.

19. The device of claim 1 further comprising:

a case for the container, the case including an audible and/or visual indicator that signals a level of chemical in the container.

20. The device of claim 1 further comprising:

a case for the container, the case including a waste bin.

21. The device of claim 1 further comprising:

a case for the container, the case including a receptacle for a toilet cleaning device.

22. The device of claim 1 further comprising:

a case for the container, the case including a hanger for suspending the case from a toilet tank.

23. The device of claim 1 further comprising:

a case for the container, the case including an adhesive surface for suspending the case from a vertical surface.

24. A device for spraying an inner surface of a toilet bowl with a chemical, the device comprising:

a container for the chemical;

a spray nozzle through which the chemical can be sprayed laterally around a perimeter of the toilet bowl;

a conduit in fluid communication with the container and the spray nozzle;

fluid delivery means for delivering chemical from the container through the conduit and to the spray nozzle;

means for positioning the spray nozzle so that in use the spray nozzle is near a rim of the toilet bowl, wherein the spray nozzle includes a tubular flow passage in fluid communication with the conduit and the spray nozzle;

a proximity sensor for detecting the presence of a user near the toilet bowl;

a control circuit, wherein the control circuit and proximity sensor are in electrical communication, and wherein the control circuit has at least a first program, the first program set to prevent release of chemical from the container such when the user is detected near the toilet bowl; and wherein the chemical is provided to the entire perimeter of the toilet bowl.

25. The device of claim 24 wherein:

the spray nozzle is structured such that that chemical can be sprayed laterally around the entire perimeter of the nozzle.

26. The device of claim 24 wherein:

the means for attaching the spray nozzle comprises an adhesive material.

27. The device of claim 1 wherein the control circuit comprises a second program, wherein the second program is a timer that provides for the automatic release of chemical at preset periods of time.

28. The device of claim 1 wherein the spray nozzle further includes a deflector plate that rotates when contacted by the chemical exiting the tubular flow passage, the deflector plate having a continuous peripheral edge.

* * * * *

UNITED STATES PATENT AND TRADEMARK OFFICE

CERTIFICATE OF CORRECTION

PATENT NO. : 7,603,726 B2
APPLICATION NO. : 11/312281
DATED : October 20, 2009
INVENTOR(S) : Sawalski et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 684 days.

Signed and Sealed this

Fifth Day of October, 2010

David J. Kappos

David J. Kappos
*Director of the United States Patent and Trademark Office*